US012104831B2

(12) United States Patent
Kagawa et al.

(10) Patent No.: US 12,104,831 B2
(45) Date of Patent: Oct. 1, 2024

(54) REFRIGERANT FLOW PATH SWITCHING UNIT AND AIR CONDITIONER PROVIDED WITH THE SAME

(71) Applicant: DAIKIN INDUSTRIES, LTD., Osaka (JP)

(72) Inventors: Mikio Kagawa, Osaka (JP); Kazuki Ikari, Osaka (JP); Szeping Beh, Osaka (JP); Junichi Shimoda, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 614 days.

(21) Appl. No.: 17/290,562

(22) PCT Filed: Oct. 30, 2019

(86) PCT No.: PCT/JP2019/042541
§ 371 (c)(1),
(2) Date: Apr. 30, 2021

(87) PCT Pub. No.: WO2020/090875
PCT Pub. Date: May 7, 2020

(65) Prior Publication Data

US 2021/0404716 A1 Dec. 30, 2021

(30) Foreign Application Priority Data

Oct. 30, 2018 (JP) ..... 2018-204177

(51) Int. Cl.
*F25B 41/20* (2021.01)

(52) U.S. Cl.
CPC ..... *F25B 41/20* (2021.01)

(58) Field of Classification Search
CPC ..... F25B 2313/0233; F25B 13/00; F25B 41/26; F25B 2600/2507; F25B 41/20; F24F 3/065; F24F 11/89; F24F 11/84
See application file for complete search history.

(56) References Cited

U.S. PATENT DOCUMENTS

2016/0356516 A1 12/2016 Eguchi et al.
2017/0089623 A1 3/2017 Kamitani et al.

FOREIGN PATENT DOCUMENTS

JP H04103540 U * 9/1992
JP 2001241696 A * 9/2001
JP 2004301424 A 10/2004
JP 2005265377 A 9/2005
(Continued)

OTHER PUBLICATIONS

Extended European Search Report issued in corresponding European Patent Application No. EP 19879502.3 dated Jun. 22, 2022 (6 pages).

(Continued)

*Primary Examiner* — Ana M Vazquez
(74) *Attorney, Agent, or Firm* — Osha Bergman Watanabe & Burton LLP

(57) ABSTRACT

A refrigerant flow path switching unit is disposed between a heat source unit and a utilization unit and switches a refrigerant flow in the utilization unit. The refrigerant flow path switching unit includes: a flow path switching valve; and a case that houses the flow path switching valve. The case has: a first maintenance opening on a first side surface; and a second maintenance opening on a second side surface.

9 Claims, 24 Drawing Sheets

(56) References Cited

FOREIGN PATENT DOCUMENTS

| | | | |
|---|---|---|---|
| JP | 2012013275 | A | 1/2012 |
| JP | 2013076519 | A | 4/2013 |
| JP | 2014047977 | A | 3/2014 |
| JP | 2015227741 | A | 12/2015 |
| JP | 2018138842 | A | 9/2018 |
| WO | 2015087756 | A1 | 6/2015 |
| WO | 2018092186 | A1 | 5/2018 |

OTHER PUBLICATIONS

International Search Report issued in corresponding International Application No. PCT/JP2019/042541, mailed Dec. 24, 2019, with translation (5 pages).
International Preliminary Report on Patentability issued for PCT/JP2019/042541, issued Apr. 27, 2021 (9 pages).

* cited by examiner

REFRIGERANT FLOW PATH SWITCHING UNIT AND AIR CONDITIONER PROVIDED WITH THE SAME

TECHNICAL FIELD

A refrigerant flow path switching unit provided between a heat source unit and a utilization unit and configured to switch a flow refrigerant in the utilization unit, and an air conditioner provided with the refrigerant flow path switching unit.

BACKGROUND ART

Conventionally, there have been a refrigerant flow path switching unit provided between a heat source unit and a utilization unit and configured to switch a refrigerant flow in the utilization unit, and an air conditioner provided with the refrigerant flow path switching unit. As such a refrigerant flow path switching unit, as shown in Patent Literature 1 (JP 2015-227741 A), there is a refrigerant flow path switching unit provided with a maintenance opening on one side surface of a case housing a flow path switching valve. In this refrigerant flow path switching unit, maintenance of the flow path switching valve is performed with the maintenance opening and an upper surface of the case open.

The refrigerant flow path switching unit is often provided in a living room in a building, a ceiling space of a passage, or the like, and a height dimension of such a space may be small. In such a case, a space above the case may be too narrow to open the upper surface of the case. Even if the upper surface of the case can be opened, the space above the case may be too narrow to use the upper surface of the case for inserting a hand into the case or visually recognizing an inside of the case.

It is therefore difficult to maintain the flow path switching valve when the conventional refrigerant flow path switching unit is installed in a space having a small height dimension.

SUMMARY

A refrigerant flow path switching unit according to one or more embodiments is a refrigerant flow path switching unit provided between a heat source unit and a utilization unit and configured to switch a refrigerant flow in the utilization unit, and has a flow path switching valve and a case housing the flow path switching valve. Here, a maintenance opening is provided on at least two side surfaces of the case.

Here, it is possible to insert the hand into the case while visually recognizing an inside of the case or insert both hands into the case by using the maintenance opening formed on the at least two side surfaces. Thus, maintenance of the flow path switching valve can be performed without opening an upper surface of the case.

As a result, here, even when the refrigerant flow path switching unit is installed in a space having a small height dimension, the maintenance of the flow path switching valve can be performed and workability can be improved.

In a refrigerant flow path switching unit according to one or more embodiments, the two side surfaces on which the maintenance opening is provided face each other.

Here, both hands can be inserted into the case from the two side surfaces facing each other, and the workability of maintenance of the flow path switching valve can be improved.

In a refrigerant flow path switching unit according to one or more embodiments, the two side surfaces on which the maintenance opening is provided face in a direction intersecting each other.

Here, both hands can be inserted into the case from the two side surfaces facing in the direction intersecting each other, or the hand can be inserted into the case while visually recognizing the inside of the case, thereby improving the workability of maintenance of the flow path switching valve.

In a refrigerant flow path switching unit according to one or more embodiments, of the side surfaces on which the maintenance opening is provided, two side surfaces face each other and one side surface faces in a direction intersecting both of the two side surfaces facing each other.

Here, both hands can be inserted into the case from the two side surfaces facing each other while visually recognizing the inside of the case from the side surface facing the direction intersecting both of the two side surfaces facing each other, and the workability of maintenance of the flow path switching valve can be improved.

In a refrigerant flow path switching unit according to one or more embodiments, an electric component box housing an electric component configured to control the flow path switching valve is attached to a side surface facing in the direction intersecting both of the two side surfaces facing each other, and a box opening is provided in a part of the electric component box facing the maintenance opening.

When the electric component box is attached to the side surface facing in the direction intersecting both of the two side surfaces facing each other, the electric component box is obstructive, and the inside of the case cannot be visually recognized or the hand cannot be inserted into the case during maintenance.

However, here, as described above, the box opening is provided in the part of the electric component box facing the maintenance opening, and thus the inside of the case is visually recognized and the hand can be inserted into the case even though the electric component box is attached.

In a refrigerant flow path switching unit according to one or more embodiments, the electric component is housed in the electric component box in a state where the inside of the case is accessible from the box opening through the maintenance opening.

When the box opening is formed in the part of the electric component box facing the maintenance opening, if the electric component covers most of the box opening, the electric component prevents visual recognition of the inside of the case or insertion of the hand into the case.

However, here, as described above, the electric component is housed in the electric component box in a state where the electric component is accessible from the box opening through the maintenance opening, and thus the electric component is unlikely to prevent visual recognition of the inside of the case or insertion of the hand into the case.

In a refrigerant flow path switching unit according to one or more embodiments, a plurality of the flow path switching valves is disposed along the two side surfaces facing each other on which the maintenance opening is provided.

This facilitates access to the flow path switching valves when both hands are inserted into the case from the two side surfaces facing each other and visual recognition of the flow path switching valves when the inside of the case is visually recognized from the side surface facing in the direction intersecting both of the two side surfaces facing each other.

In a refrigerant flow path switching unit according to one or more embodiments, a heat source-side connection nozzle is provided on at least one of the side surfaces on which the maintenance opening is provided, and the heat source-side connection nozzle is disposed on a side of the maintenance opening.

When the heat source-side connection nozzle is provided on the side surface on which the maintenance opening is formed, the heat source-side connection nozzle and a heat source-side connection pipe connected to the heat source-side connection nozzle may be obstructive, and the electric component may prevent visual recognition of the inside of the case or insertion of the hand into the case.

However, here, as described above, when the heat source-side connection nozzle is provided on the side surface on which the maintenance opening is formed, the heat source-side connection nozzle is disposed on a side of the maintenance opening. Thus, the heat source-side connection nozzle and the heat source-side connection pipe connected to the heat source-side connection nozzle are unlikely to be obstructive and reduce possibility of preventing visual recognition of the inside of the case or insertion of the hand into the case.

In a refrigerant flow path switching unit according to one or more embodiments, a utilization-side communication nozzle is provided on a side surface other than the side surface on which the heat source-side connection nozzle and the maintenance opening are provided, and the heat source-side connection nozzle is disposed closer to the side surface on which the utilization-side connection nozzle is provided than the maintenance opening.

When the heat source-side connection nozzle is provided on the side surface on which the maintenance opening is formed, if the heat source-side connection nozzle is disposed farther from the side surface on which the utilization-side connection nozzle is formed than the maintenance opening, the utilization-side connection nozzle and the utilization-side connection pipe connected to the utilization-side connection nozzle may be obstructive and prevent visual recognition of the inside of the case or insertion of the hand into the case.

However, here, as described above, when the heat source-side connection nozzle is provided on the side surface on which the maintenance opening is formed, the heat source-side connection nozzle is disposed closer to the side surface on which the utilization-side connection nozzle is formed than the maintenance opening. Thus, the utilization-side connection nozzle and the utilization-side connection pipe connected to the utilization-side connection nozzle are unlikely to be obstructive and reduce possibility of preventing visual recognition of the inside of the case or insertion of the hand into the case.

In a refrigerant flow path switching unit according to one or more embodiments, the maintenance opening is disposed at an upper part of the side surface of the case.

The flow path switching valve is disposed in such a manner that a coil part is located in an upper space in the case.

Thus, here, as described above, the maintenance opening is disposed at the upper part of the side surface of the case to facilitate access to the flow path switching valve (particularly, the coil part).

An air conditioner according to one or more embodiments includes a heat source unit, a utilization unit, and the refrigerant flow path switching unit according to one or more embodiments.

Here, it is possible to provide an air conditioner capable of improving the workability of maintenance of the refrigerant flow path switching unit.

DETAILED DESCRIPTION

Hereinafter, a refrigerant flow path switching unit and an air conditioner provided with the refrigerant flow path switching unit will be described with reference to the drawings.

(1) Refrigerant Circuit Configuration and Operation

Figure 1:
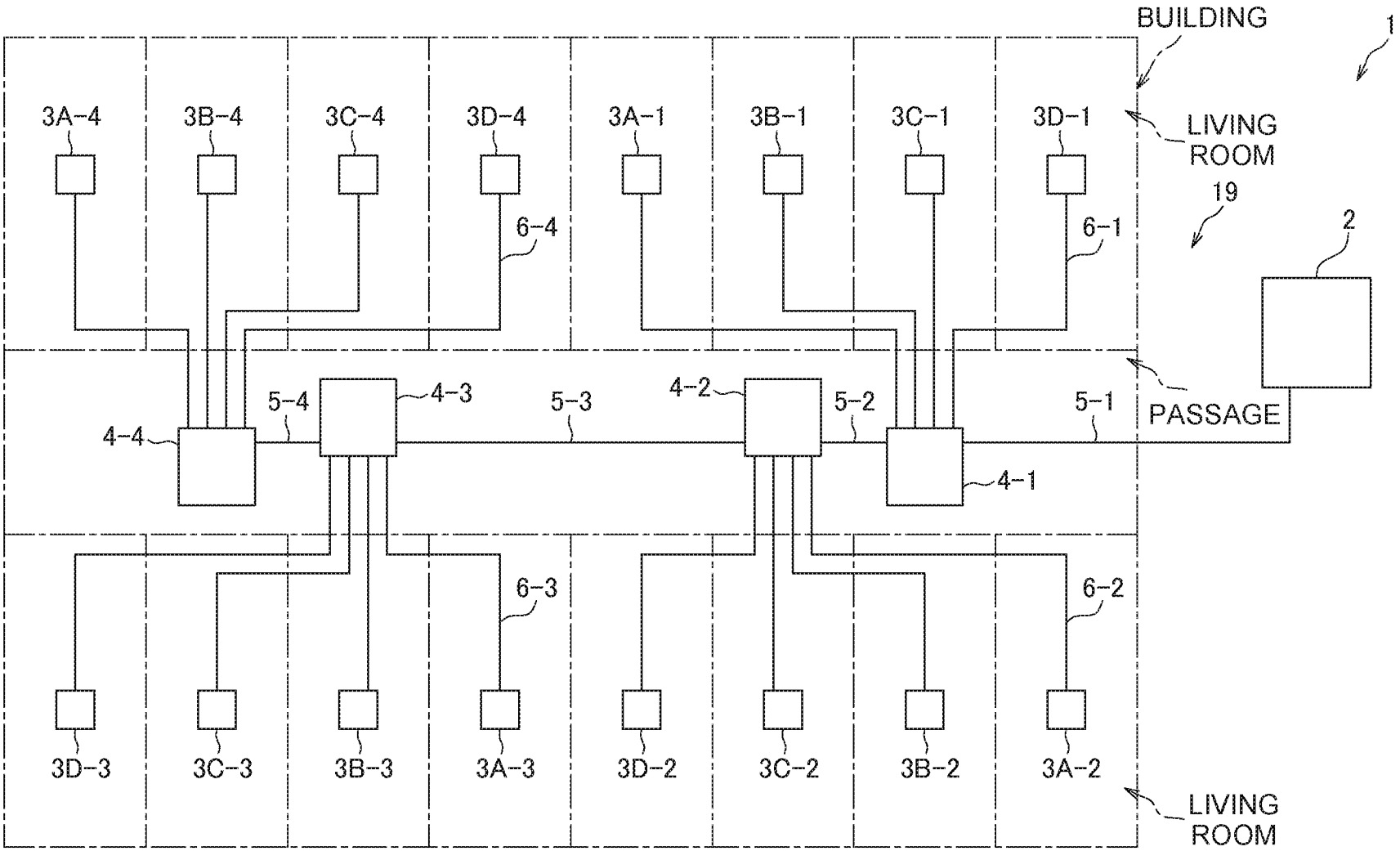
FIG. 1 is an overall configuration diagram of an air conditioner according to one or more embodiments of the present disclosure.
Figure 2:
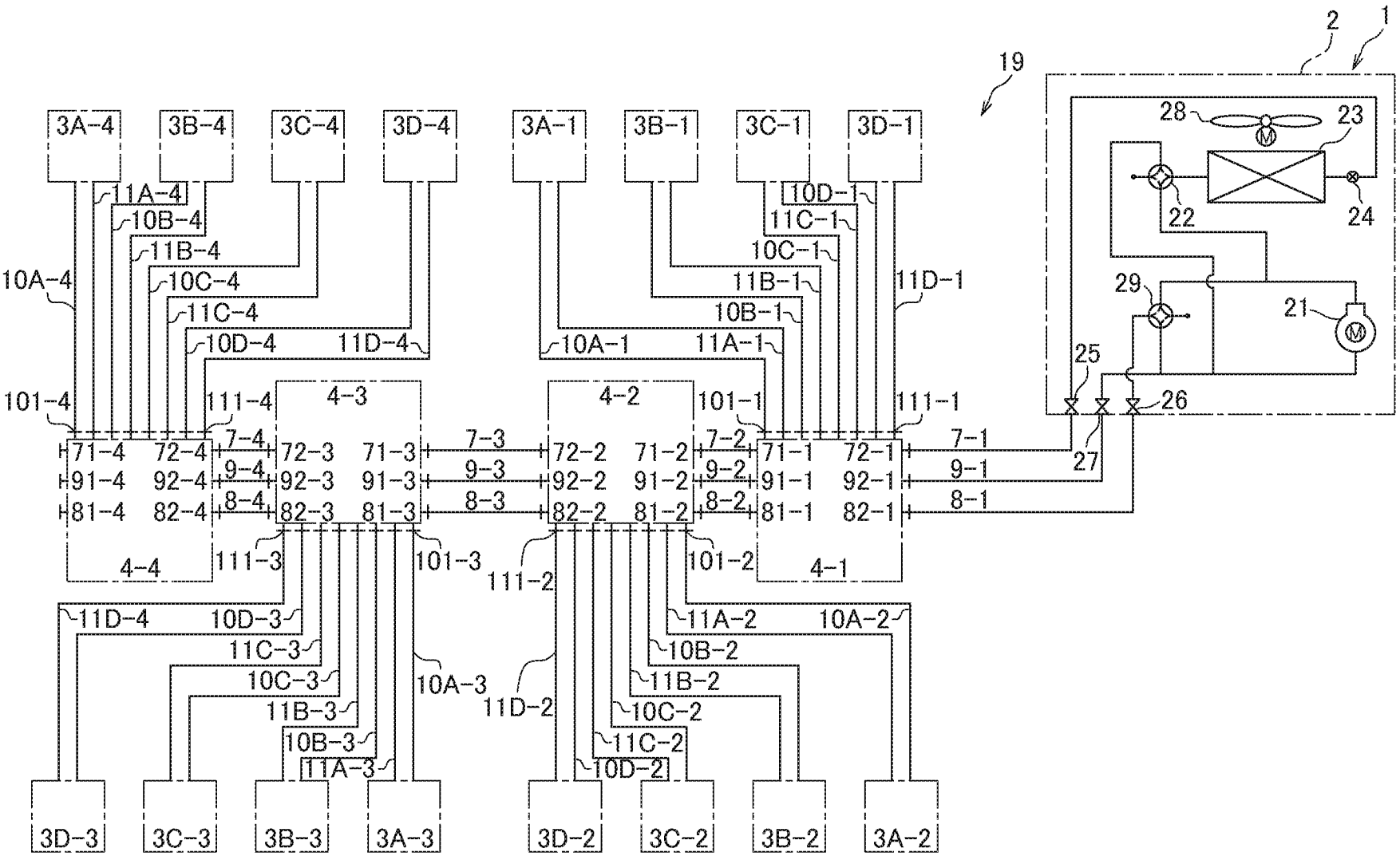
FIG. 2 is a refrigerant circuit diagram of the air conditioner (illustrating only a heat source unit in detail).
Figure 3:
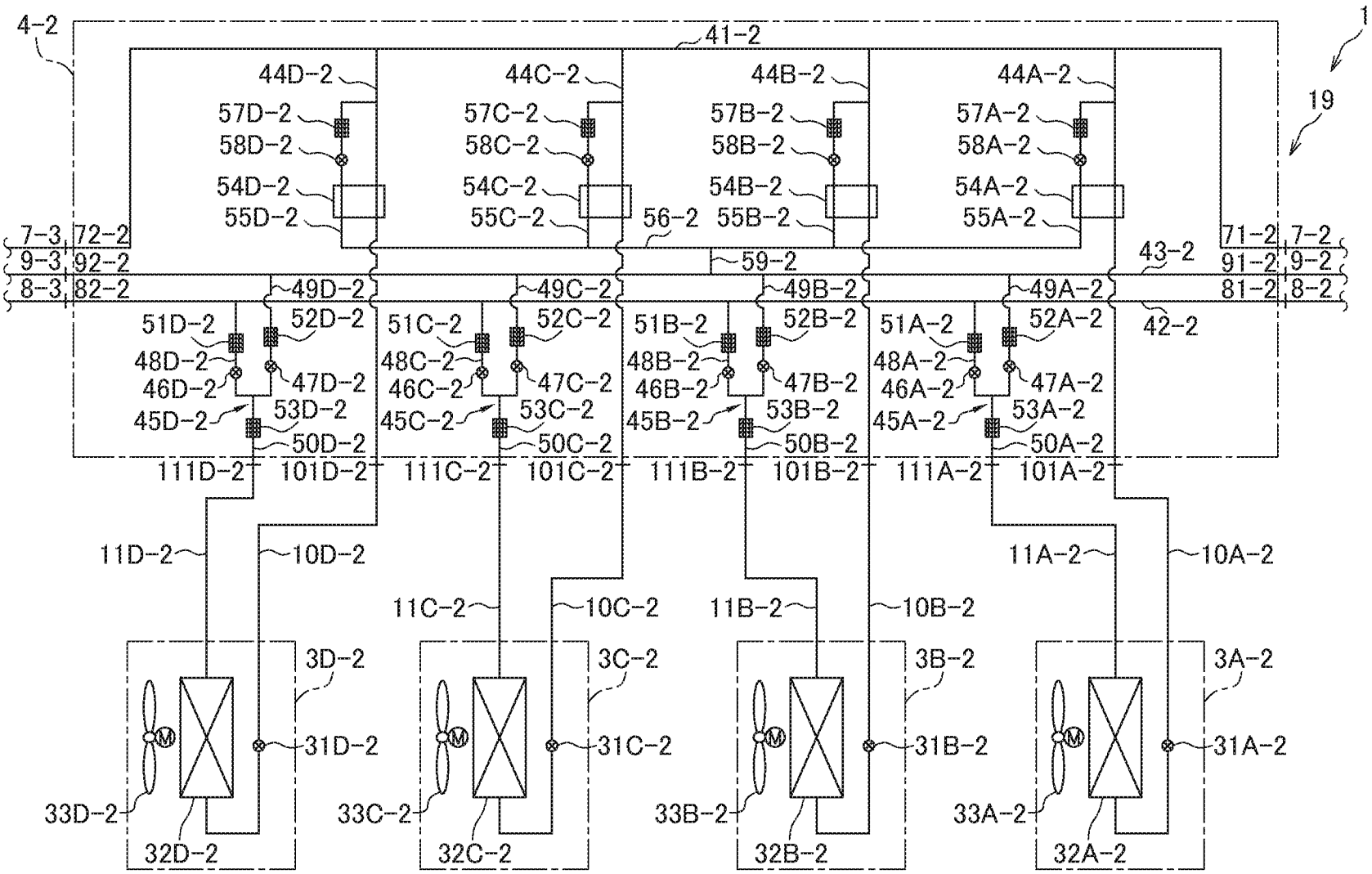
FIG. 3 is a refrigerant circuit diagram of the air conditioner (illustrating only one refrigerant flow path switching unit and utilization units connected to the refrigerant flow path switching unit in detail).

FIG. 1 is an overall configuration diagram of an air conditioner 1 according to one or more embodiments of the present disclosure. FIG. 2 is a refrigerant circuit diagram of the air conditioner 1 (illustrating only a heat source unit 2 in detail). FIG. 3 is a refrigerant circuit diagram of the air conditioner 1 (illustrating only a refrigerant flow path switching unit 4-2 and utilization units 3A-2 to 3D-2 connected to the refrigerant flow path switching unit 4-2 in detail).

<Overview>

The air conditioner 1 is an apparatus that cools and heats a room in a building or the like by a vapor compression refrigeration cycle. The air conditioner 1 mainly includes the heat source unit 2, a plurality of (here, 16) the utilization units 3, a plurality of (here, four) refrigerant flow path switching units 4 provided between the heat source unit 2 and the utilization units 3 and switching a refrigerant flow in the utilization units 3, a heat source-side connection pipe 5 extending from the heat source unit 2, and a utilization-side connection pipe 6 extending from the utilization units 4. Thus, a vapor compression refrigerant circuit 19 of the air conditioner 1 is configured by connecting the heat source unit 2, the utilization units 3, the refrigerant flow path switching units 4, and the connection pipes 5 and 6.

The heat source unit 2 is provided outdoors such as on a rooftop of a building. The utilization units 3 are provided in the building, and here, provided in a living room, in a ceiling space of the living room, or the like. The refrigerant flow path switching units 4 are provided in the building, and here, provided in a ceiling space of a passage.

The heat source unit 2 and the refrigerant flow path switching units 4 are connected by the heat source-side connection pipe 5, and refrigerant is exchanged between the heat source unit 2 and the refrigerant flow path switching units 4. Specifically, the heat source unit 2 is connected to a refrigerant flow path switching unit 4-1 by a heat source-side connection pipe 5-1. The refrigerant flow path switching unit 4-1 is connected to the refrigerant flow path switching unit 4-2 by a heat source-side connection pipe 5-2. The refrigerant flow path switching unit 4-2 is connected to a refrigerant flow path switching unit 4-3 by a heat source-side connection pipe 5-3. The refrigerant flow path switching unit 4-3 is connected to a refrigerant flow path switching unit 4-4 by a heat source-side connection pipe 5-4. In other words, one of the refrigerant flow path switching units 4 (here, the refrigerant flow path switching unit 4-1) is connected to the heat source unit 2, and the refrigerant flow path switching units 4 are connected to each other in series sequentially from the heat source unit 2.

The utilization units 3 and the refrigerant flow path switching units 4 are connected by the utilization-side connection pipe 6, and the refrigerant is exchanged between the utilization units 3 and the refrigerant flow path switching units 4. Specifically, the refrigerant flow path switching unit 4-1 is connected to a plurality of (here, four) utilization units 3A-1 to 3D-1 by a utilization-side connection pipe 6-1. The refrigerant flow path switching unit 4-2 is connected to a plurality of (here, four) utilization units 3A-2 to 3D-2 by a utilization-side connection pipe 6-2. The refrigerant flow path switching unit 4-3 is connected to a plurality of (here, four) utilization units 3A-3 to 3D-3 by a utilization-side connection pipe 6-3. The refrigerant flow path switching unit 4-4 is connected to a plurality of (here, four) utilization units 3A-4 to 3D-4 by a utilization-side connection pipe 6-4. In other words, the refrigerant flow path switching units 4 are connected to different utilization units 3 (here, a set of four utilization units 3), and the utilization units 3 are connected to each other in parallel via the refrigerant flow path switching units 4.

Then, in the air conditioner 1, the refrigerant flow in the utilization units 3 can be switched for each utilization unit 3 by the refrigerant flow path switching units 4. Therefore, the air conditioner 1 configures a so-called cooling and heating free type air conditioner capable of individually performing a cooling operation or a heating operation for each utilization unit 3.

<Heat Source Unit>

As described above, the heat source unit 2 is connected to the refrigerant flow path switching units 4 via the heat source-side connection pipe 5 and configures a part of the refrigerant circuit 19.

Here, the heat source-side connection pipe 5 has a first heat source-side connection pipe 7, a second heat source-side connection pipe 8, and a third heat source-side connection pipe 9. Thus, the heat source unit 2 and the refrigerant flow path switching units 4 are connected by a set of three types of heat source-side connection pipes 7, 8, and 9. Specifically, the heat source unit 2 is connected to the refrigerant flow path switching unit 4-1 by heat source-side connection pipes 7-1, 8-1, and 9-1. The refrigerant flow path switching unit 4-1 is connected to the refrigerant flow path switching unit 4-2 by heat source-side connection pipes 7-2, 8-2, and 9-2. The refrigerant flow path switching unit 4-2 is connected to the refrigerant flow path switching unit 4-3 by heat source-side connection pipes 7-3, 8-3, and 9-3. The refrigerant flow path switching unit 4-3 is connected to the refrigerant flow path switching unit 4-4 by heat source-side connection pipes 7-4, 8-4, and 9-4.

Next, a circuit configuration of the heat source unit 2 will be described below. The heat source unit 2 mainly includes a compressor 21, a first heat source-side switching valve 22, a heat source-side heat exchanger 23, a heat source-side expansion valve 24, and a plurality of (here, three) closing valves 25 to 27, and a second heat source-side switching valve 29.

The compressor 21 is a device for compressing the refrigerant and includes, for example, a hermetic compressor in which a compressor motor and a compression element are housed in a casing.

When the heat source-side heat exchanger 23 functions as a radiator of the refrigerant (hereinafter referred to as "heat source-side radiation state"), the first heat source-side switching valve 22 can connect a discharge side of the heat compressor 21 and a gas side of the heat source-side heat exchanger 23 (see a solid line of the first heat source-side switching valve 22 in FIG. 2). Further, when the heat source-side heat exchanger 23 functions as an evaporator of the refrigerant (hereinafter referred to as "heat source-side evaporation state"), the first heat source-side switching valve 22 can connect a suction side of the heat compressor 21 and the gas side of the heat source-side heat exchanger 23 (see a broken line of the first heat source-side switching valve 22 in FIG. 2). In this way, the first heat source-side switching valve 22 is a device capable of switching a flow direction of the refrigerant flowing through the heat source-side heat exchanger 23 (here, the heat source-side radiation state and the heat source-side evaporation state) and includes, for example, a four-way switching valve.

The heat source-side heat exchanger 23 is a heat exchanger exchanging heat between the refrigerant and outdoor air. The gas side of the heat source-side heat exchanger 23 is connected to the first heat source-side switching valve 22, and a liquid side of the heat source-side heat exchanger 23 is connected to the heat source-side expansion valve 24. Here, the heat source unit 2 has a heat source-side fan 28 generating a flow of the outdoor air passing through the heat source-side heat exchanger 23.

The heat source-side expansion valve 24 is a device for decompressing the refrigerant and includes, for example, an electric expansion valve whose opening degree is adjustable. A first end (one end) of the heat source-side expansion valve 24 is connected to the liquid side of the heat source-side heat exchanger 23, and a second end (another end) of the heat source-side expansion valve 24 is connected to the first closing valve 25.

When the second heat source-side switching valve 29 sends the refrigerant discharged from the compressor 21 to the second heat source-side connection pipe 8 (hereinafter referred to as "refrigerant outflow state"), the discharge side of the compressor 21 and the second closing valve 26 can be connected to each other (see a broken line of the second heat source-side switching valve 29 in FIG. 2). Further, when the second heat source-side switching valve 29 sends the refrigerant flowing through the second heat source-side connection pipe 8 to the suction side of the compressor 21 (hereinafter referred to as "refrigerant inflow state"), the second closing valve 26 and the suction side of the compressor 21 can be connected to each other (see a solid line of the second heat source-side switching valve 29 in FIG. 2). In this way, the second heat source-side switching valve 29 is a device capable of switching the flow direction of the refrigerant flowing through the second heat source-side connection pipe 8 (here, the refrigerant outflow state and the refrigerant inflow state) and includes a four-way switching valve, for example.

The closing valves 25 to 27 are manual valves that are opened and closed when the heat source unit 2 and the outside (here, the refrigerant flow path switching units 4) are connected or disconnected. A first end of the first closing valve 25 is connected to the heat source-side expansion valve 24, and a second end of the first closing valve 25 is connected to the first heat source-side connection pipe 7 (here, the first heat source-side connection pipe 7-1). A first end of the second closing valve 26 is connected to the second heat source-side switching valve 29, and a second end of the second closing valve 26 is connected to the second heat source-side connection pipe 8 (here, the second heat source-side connection pipe 8-1). A first end of the third closing valve 27 is connected to the suction side of the compressor 21, and a second end of the third closing valve 27 is connected to the third heat source-side connection pipe 9 (here, the third heat source-side connection pipe 9-1).

<Utilization Unit>

As described above, the utilization units 3 are connected to the refrigerant flow path switching units 4 via the utilization-side connection pipe 6, and configure a part of the refrigerant circuit 19.

Here, the utilization-side connection pipe 6 has a first utilization-side connection pipe 10 and a second utilization-side connection pipe 11. Thus, the utilization units 3 and the refrigerant flow path switching units 4 are connected by a set of two types of utilization-side connection pipes 10 and 11. Specifically, the refrigerant flow path switching unit 4-1 is connected to the utilization units 3A-1 to 3D-1 by four sets of utilization-side connection pipes 10-1 and 11-1 (10A-1 and 11A-1, 10B-1 and 11B-1, 10C-1 and 11C-1, and 10D-1 and 11D-1). The refrigerant flow path switching unit 4-2 is connected to the utilization units 3A-2 to 3D-2 by four sets of utilization-side connection pipes 10-2 and 11-2 (10A-2 and 11A-2, 10B-2 and 11B-2, 10C-2 and 11C-2, and 10D-2 and 11D-2). The refrigerant flow path switching unit 4-3 is connected to the utilization units 3A-3 to 3D-3 by four sets of utilization-side connection pipes 10-3 and 11-3 (10A-3 and 11A-3, 10B-3 and 11B-3, 10C-3 and 11C-3, and 10D-3 and 11D-3). The refrigerant flow path switching unit 4-4 is connected to the utilization units 3A-4 to 3D-4 by four sets of utilization-side connection pipes 10-4 and 11-4 (10A-4 and 11A-4, 10B-4 and 11B-4, 10C-4 and 11C-4, and 10D-4 and 11D-4).

Next, a circuit configuration of the utilization units 3 will be described. The utilization units 3A-1 to 3D-1, 3A-2 to 3D-2, 3A-3 to 3D-3, and 3A-4 to 3D-4 all have the same configuration, and thus the description here will be made by omitting subscripts "A", "B", "C", "D", "-1", "-2", "-3", and "-4" for distinguishing the utilization units 3. The utilization unit 3 mainly includes a utilization-side expansion valve 31 and a utilization-side heat exchanger 32.

The utilization-side expansion valve 31 is a device for decompressing the refrigerant and includes, for example, an electric expansion valve whose opening degree is adjustable. A first end of the utilization-side expansion valve 31 is connected to the first utilization-side connection pipe 10, and a second end of the utilization-side expansion valve 31 is connected to a liquid side of the utilization-side heat exchanger 32.

The utilization-side heat exchanger 32 is a heat exchanger exchanging heat between the refrigerant and indoor air. The liquid side of the utilization-side heat exchanger 32 is connected to the utilization-side expansion valve 31, and a gas side of the utilization-side heat exchanger 32 is connected to the second utilization-side connection pipe 11. Here, the utilization unit 3 has a utilization-side fan 33 generating a flow of the indoor air passing through the utilization-side heat exchanger 31.

<Refrigerant Flow Path Switching Unit>

As described above, the refrigerant flow path switching units 4 are provided between the heat source unit 2 and the utilization units 3, are connected to the refrigerant flow path switching units 4 via the heat source-side connection pipe 5, are connected to the refrigerant flow path switching units 4 via the utilization-side connection pipe 6, and configure a part of the refrigerant circuit 19.

Next, a circuit configuration of the refrigerant flow path switching units 4 will be described. The refrigerant flow path switching units 4-1 to 4-4 all have the same configuration, and thus, the description here will be made by omitting subscripts "-1", "-2", "-3", and "-4" for distinguishing the refrigerant flow path switching units 4 as much as possible. The refrigerant flow path switching unit 4 mainly includes a first internal connection pipe 41, a second internal connection pipe 42, a third internal connection pipe 43, fourth internal connection pipes 44A to 44D, fifth internal connection pipes 45A to 45D, first flow path switching valves 46A to 46D, and second flow path switching valves 47A to 47D.

A first end and/or a second end of the first internal connection pipe 41 are connected to the first heat source-side connection pipe 7. Here, a first heat source-side small nozzle 71 to be connected to the first heat source-side connection pipe 7 is formed at the first end of the first internal connection pipe 41, and a second heat source-side small nozzle 72 to be connected to the first heat source-side connection pipe 7 is formed at the second end of the first internal connection pipe 41. In other words, the first internal connection pipe 41 connects the first heat source-side small nozzle 71 and the second heat source-side small nozzle 72. Specifically, a first end (first heat source-side small nozzle 71-1) of a first internal connection pipe 41-1 of the refrigerant flow path switching unit 4-1 is connected to the first heat source-side connection pipe 7-2, and a second end (second heat source-side small nozzle 72-1) of the first internal connection pipe 41-1 is connected to the first heat source-side connection pipe 7-1. A first end (first heat source-side small nozzle 71-2) of a first internal connection pipe 41-2 of the refrigerant flow path switching unit 4-2 is connected to the first heat source-side connection pipe 7-2, and a second end (second heat source-side small nozzle 72-2) of the first internal connection pipe 41-2 is connected to the first heat source-side connection pipe 7-3. A first end (first heat source-side small nozzle 71-3) of a first internal connection pipe 41-3 of the refrigerant flow path switching unit 4-3 is connected to the first heat source-side connection pipe 7-3, and a second end (second heat source-side small nozzle 72-3) of the first internal connection pipe 41-3 is connected to the first heat source-side connection pipe 7-4. A first end (first heat source-side small nozzle 71-4) of a first internal connection pipe 41-4 of the refrigerant flow path switching unit 4-4 is not connected to the first heat source-side connection pipe, and a second end (second heat source-side small nozzle 72-4) of the first internal connection pipe 41-4 is connected to the first heat source-side connection pipe 7-4.

A first end and/or a second end of the second internal connection pipe 42 are connected to the second heat source-side connection pipe 8. Here, a first heat source-side medium nozzle 81 to be connected to the second heat source-side connection pipe 8 is formed at the first end of the second internal connection pipe 42, and a second heat source-side medium nozzle 82 to be connected to the second heat source-side connection pipe 8 is formed at the second end of the second internal connection pipe 42. In other words, the second internal connection pipe 42 connects the first heat source-side medium nozzle 81 and the second heat source-side medium nozzle 82. Specifically, a first end (first heat source-side medium nozzle 81-1) of a second internal connection pipe 42-1 of the refrigerant flow path switching unit 4-1 is connected to the second heat source-side connection pipe 8-2, and a second end (second heat source-side medium nozzle 82-1) of the second internal connection pipe 42-1 is connected to the second heat source-side connection pipe 8-1. A first end (first heat source-side medium nozzle 81-2) of a second internal connection pipe 42-2 of the refrigerant flow path switching unit 4-2 is connected to the second heat source-side connection pipe 8-2, and a second end (second heat source-side medium nozzle 82-2) of the second internal connection pipe 42-2 is connected to the second heat source-side connection pipe 8-3. A first end (first heat source-side medium nozzle 81-3) of a second internal connection pipe 42-3 of the refrigerant flow path switching unit 4-3 is connected to the second heat source-side connection pipe 8-3, and a second end (second heat source-side medium nozzle 82-3) of the second internal connection pipe 42-3 is connected to the second heat source-side connection pipe 8-4. A first end (first heat source-side medium nozzle 81-4) of a second internal connection pipe 42-4 of the refrigerant flow path switching unit 4-4 is not connected to the second heat source-side connection pipe, and a second end (second heat source-side medium nozzle 82-4) of the second internal connection pipe 42-4 is connected to the second heat source-side connection pipe 8-4.

A first end and/or a second end of the third internal connection pipe 43 are connected to the third heat source-side connection pipe 9. Here, a first heat source-side large nozzle 91 to be connected to the third heat source-side connection pipe 9 is formed at the first end of the third internal connection pipe 43, and a second heat source-side large nozzle 92 to be connected to the third heat source-side connection pipe 9 is formed at the second end of the third internal connection pipe 43. In other words, the third internal connection pipe 43 connects the first heat source-side large nozzle 91 and the second heat source-side large nozzle 92. Specifically, a first end (first heat source-side large nozzle 91-1) of a third internal connection pipe 43-1 of the refrigerant flow path switching unit 4-1 is connected to the third heat source-side connection pipe 9-2, and a second end (second heat source-side large nozzle 92-1) of the third internal connection pipe 43-1 is connected to the third heat source-side connection pipe 9-1. A first end (first heat source-side large nozzle 91-2) of a third internal connection pipe 43-2 of the refrigerant flow path switching unit 4-2 is connected to the third heat source-side connection pipe 9-2, and a second end (second heat source-side large nozzle 92-2) of the third internal connection pipe 43-2 is connected to the third heat source-side connection pipe 9-3. A first end (first heat source-side large nozzle 91-3) of a third internal connection pipe 43-3 of the refrigerant flow path switching unit 4-3 is connected to the third heat source-side connection pipe 9-3, and a second end (second heat source-side large nozzle 92-3) of the third internal connection pipe 43-3 is connected to the third heat source-side connection pipe 9-4. A first end (first heat source-side large nozzle 91-4) of a third internal connection pipe 43-4 of the refrigerant flow path switching unit 4-4 is not connected to the third heat source-side connection pipe, and a second end (second heat source-side large nozzle 92-4) of the third internal connection pipe 43-4 is connected to the third heat source-side connection pipe 9-4.

In this way, the refrigerant flow path switching unit 4 is provided with two sets of heat source-side connection nozzles including a set of the first heat source-side small nozzle 71, the first heat source-side medium nozzle 81, and the first heat source-side large nozzle 91 connected to the three types of heat source-side connection pipes 7, 8, and 9 (first heat source-side connection nozzles), and a set of the second heat source-side small nozzle 72, the second heat source-side medium nozzle 82, and the second heat source-side large nozzle 92 connected to the three types of heat source-side connection pipes 7, 8, and 9 (second heat source-side connection nozzles).

A plurality of (here, four) fourth internal connection pipes 44A to 44D is connected to the first internal connection pipe 41. First ends of the fourth internal connection pipes 44A to 44D are connected so as to be branched from a middle of the first internal connection pipe 41. Further, second ends of the fourth internal connection pipes 44A to 44D are connected to the first utilization-side connection pipes 10A to 10D, respectively. Here, utilization-side small nozzles 101A to 101D connected to the first utilization-side connection pipes 10A to 10D are formed at the second ends of the fourth internal connection pipes 44A to 44D, respectively. In other words, the fourth internal connection pipes 44A to 44D connect the first internal connection pipe 41 and the utilization-side small nozzles 101A to 101D.

A plurality of (here, four) fifth internal connection pipes 45A to 45D has sixth internal connection pipes 48A to 48D branched from the second internal connection pipe 42, seventh internal connection pipes 49A to 49D branched from the third internal connection pipe 43, and eighth internal connection pipes 50A to 50D joining the sixth internal connection pipes 48A to 48D and the seventh internal connection pipes 49A to 49D. First ends of the sixth internal connection pipes 48A to 48D are connected to a middle of the second internal connection pipe 42, and second ends of the sixth internal connection pipes 48A to 48D are connected to first ends of the eighth internal connection pipes 50A to 50D, respectively. Further, first ends of the seventh internal connection pipes 49A to 49D are connected to a middle of the third internal connection pipe 43, and second ends of the seventh internal connection pipes 49A to 49D are connected to the first ends of the eighth internal connection pipes 50A to 50D, respectively. Second ends of the eighth internal connection pipes 50A to 50D are connected to second utilization-side connection pipes 11A to 11D, respectively. Here, utilization-side large nozzles 111A to 111D connected to the second utilization-side connection pipes 11A to 11D are formed at the second ends of the eighth internal connection pipes 50A to 50D, respectively. In other words, the fifth internal connection pipes 45A to 45D connect the second internal connection pipe 42 and the third internal connection pipe 43 with the utilization-side large nozzles 111A to 111D.

A plurality of (here, four) first flow path switching valves 46A to 46D is provided in the sixth internal connection pipes 48A to 48D, respectively. Further, a plurality of (here, four) second flow path switching valves 47A to 47D is provided in the seventh internal connection pipes 49A to 49D, respectively. The first flow path switching valves 46A to 46D and the second flow path switching valves 47A to 47D include, for example, an electric expansion valve or an electromagnetic valve. Then, the first flow path switching valves 46A to 46D are closed when the corresponding utilization units 3A to 3D perform the cooling operation, and are opened when the corresponding utilization units 3A to 3D perform the heating operation. However, if there is no utilization unit that performs the heating operation in the refrigerant circuit 19 as a whole (in other words, if there is only a utilization unit that performs the cooling operation in the refrigerant circuit 19 as a whole), the first flow path switching valves 46A to 46D are also opened when the corresponding utilization units 3A to 3D perform the cooling operation. Further, the second flow path switching valves 47A to 47D are opened when the corresponding utilization units 3A to 3D perform the cooling operation, and are closed when the corresponding utilization units 3A to 3D perform the heating operation. In this way, the first flow path switching valves 46A to 46D and the second flow path switching valves 47A to 47D can switch the flow direction of the refrigerant (here, the cooling operation and heating operation) in the utilization units 3A to 3D.

Further, the sixth internal connection pipes 48A to 48D are provided with first filters 51A to 51D, respectively. The first filters 51A to 51D are devices for capturing foreign matter accompanying the refrigerant flowing through the sixth internal connection pipes 48A to 48D. The first filters 51A to 51D are provided between a part of the sixth internal connection pipes 48A to 48D branched from the second internal connection pipe 42 and the first flow path switching valves 46A to 46D. The seventh internal connection pipes 49A to 49D are provided with second filters 52A to 52D, respectively. The second filters 52A to 52D are devices for capturing foreign matter accompanying the refrigerant flowing through the seventh internal connection pipes 49A to 49D. The second filters 52A to 52D are provided between a part of the seventh internal connection pipes 49A to 49D branched from the third internal connection pipe 43 and the second flow path switching valves 47A to 47D. The eighth internal connection pipes 50A to 50D are provided with third filters 53A to 53D, respectively. The third filters 53A to 53D are devices for capturing foreign matter accompanying the refrigerant flowing through the eighth internal connection pipes 50A to 50D.

Further, the fourth internal connection pipes 44A to 44D are provided with supercooling heat exchangers 54A to 54D, respectively, and ninth internal connection pipes 55A to 55D are connected to the fourth internal connection pipes 44A to 44D, respectively.

The supercooling heat exchangers 54A to 54D are devices for cooling the refrigerant flowing through the fourth internal connection pipes 44A to 44D by the refrigerant flowing through the ninth internal connection pipes 55A to 55D, and include, for example, double-pipe heat exchangers. The supercooling heat exchangers 54A to 54D have a flow path for flowing the refrigerant flowing through the fourth internal connection pipes 44A to 44D and a flow path for flowing the refrigerant flowing through the ninth internal connection pipes 55A to 55D, respectively.

First ends of the ninth internal connection pipes 55A to 55D are connected so as to be branched from a middle of the fourth internal connection pipes 44A to 44D, and second ends of the ninth internal connection pipes 55A to 55D are connected so as to merge into a middle of a tenth internal connection pipe 56. Supercooling heat exchangers 54A to 54D (flow paths for flowing the refrigerant flowing through the ninth internal connection pipes 55A to 55D) are provided in a middle of the ninth internal connection pipes 55A to 55D. Further, the ninth internal connection pipes 55A to 55D are provided with fourth filters 57A to 57D and supercooling expansion valves 58A to 58D, respectively. The fourth filters 57A to 57D are devices for capturing foreign matter accompanying the refrigerant flowing through the ninth internal connection pipes 55A to 55D. The supercooling expansion valves 58A to 58D are devices for decompressing the refrigerant and include, for example, electric expansion valves whose opening degree is adjustable. The fourth filters 57A to 57D are provided between a part of the ninth internal connection pipes 55A to 55D branched from the fourth internal connection pipes 44A to 44D and the supercooling heat exchangers 54A to 54D (flow paths for flowing the refrigerant flowing through the ninth internal connection pipes 55A to 55D). The supercooling expansion valves 58A to 58D are provided at a part of the ninth internal connection pipes 55A to 55D between the fourth filters 57A to 57D and the supercooling heat exchanger 54A to 54D (flow paths for flowing the refrigerant flowing through the ninth internal connection pipes 55A to 55D). Further, an eleventh internal connection pipe 59 is connected to the tenth internal connection pipe 56. The eleventh internal connection pipe 59 is connected to the third internal connection pipe 43. Therefore, the tenth internal connection pipe 56 is connected to the third internal connection pipe 43 via the eleventh internal connection pipe 59.

<Refrigerant Circuit Operation>

Next, a refrigerant circuit operation of the air conditioner 1 will be described. The air conditioner 1 having the above circuit configuration can perform a cooling only operation, a heating only operation, a cooling dominant operation, and a heating dominant operation. Here, the cooling only operation is an operation in which only the utilization units 3 performing the cooling operation exist. The heating only operation is an operation in which only the utilization units 3 performing the heating operation exist. In the cooling dominant operation, both the utilization units 3 performing the cooling operation and the utilization units 3 performing the heating operation coexist, and the heat source unit 2 is in a heat source-side radiation state (see the solid line of the first heat source-side switching valve 22 in FIG. 2). In the heating dominant operation, both the utilization units 3 performing the cooling operation and the utilization units 3 performing the heating operation coexist, and the heat source unit 2 is in a heat source-side evaporation state (see the broken line of the first heat source-side switching valve 22 in FIG. 2). The refrigerant flow path switching units 4-1 to 4-4 all have the same configuration, and thus the description here will be made by omitting subscripts "-1", "-2", "-3", and "-4" for distinguishing the refrigerant flow path switching units 4 and subscripts "A", "B", "C", and "D" for distinguishing components of the refrigerant flow path switching units 4.

—Cooling Only Operation—

During the cooling only operation, for example, when all the utilization units 3 perform the cooling operation, the first heat source-side switching valve 22 is switched to the heat source-side radiation state and the second heat source-side switching valve 29 is switched to the refrigerant inflow state to drive the compressor 21, the heat source-side fan 28, and the utilization-side fan 33. Further, the first flow path switching valve 46 and the second flow path switching valve 47 are opened.

Then, the refrigerant discharged from the compressor 21 in the heat source unit 2 is sent to the heat source-side heat exchanger 23 through the first heat source-side switching valve 22, and radiates heat by exchanging heat with the outdoor air in the heat source-side heat exchanger 23. The refrigerant having radiated heat in the heat source-side heat exchanger 23 flows out from the heat source unit 2 through the heat source-side expansion valve 24 and the first closing valve 25.

The refrigerant flowing out from the heat source unit 2 through the heat source-side expansion valve 24 and the first closing valve 25 is sent in order to the first heat source-side connection pipe 7-1, the first internal connection pipe 41-1 of the refrigerant flow path switching unit 4-1, the first heat source-side connection pipe 7-2, the first internal connection pipe 41-2 of the refrigerant flow path switching unit 4-2, the first heat source-side connection pipe 7-3, the first internal connection pipe 41-3 of the refrigerant flow path switching unit 4-3, the first heat source-side connection pipe 7-4, and the first internal connection pipe 41-4 of the refrigerant flow path switching unit 4-4. At this time, the refrigerant flowing through the first internal connection pipe 41 in the refrigerant flow path switching unit 4 is sequentially branched to the fourth internal connection pipe 44. Then, a part of the refrigerant branched to the fourth internal connection pipe 44 is branched to the ninth internal connection pipe 55, and the rest of the refrigerant is sent to the supercooling heat exchanger 54. The refrigerant branched to the ninth internal connection pipe 55 is also decompressed by the supercooling expansion valve 58 and then sent to the supercooling heat exchanger 54. The refrigerant flowing through the fourth internal connection pipe 44 is cooled by exchanging heat with the refrigerant flowing through the ninth internal connection pipe 55 in the supercooling heat exchanger 54, and then flows out from the refrigerant flow path switching unit 4. On the other hand, the refrigerant flowing through the ninth internal connection pipe 55 is heated by exchanging heat with the refrigerant flowing through the fourth internal connection pipe 44 in the supercooling heat exchanger 54, and then is sent to the third internal connection pipe 43 through the tenth internal connection pipe 56 and the eleventh internal connection pipe 59.

The refrigerant flowing out from the refrigerant flow path switching unit 4 is sent to the utilization unit 3 through the first utilization-side connection pipe 10. The refrigerant sent to the utilization unit 3 is decompressed by the utilization-side expansion valve 31 and then sent to the utilization-side heat exchanger 32. The refrigerant sent to the utilization-side heat exchanger 32 exchanges heat with the indoor air, evaporates, and flows out from the utilization unit 3.

The refrigerant flowing out from the utilization unit 3 is sent to the refrigerant flow path switching unit 4 through the second utilization-side connection pipe 11.

The refrigerant sent to the refrigerant flow path switching unit 4 is sent to the eighth internal connection pipe 50, and then is branched and sent to the sixth internal connection pipe 48 and the seventh internal connection pipe 49. The refrigerant sent to the sixth internal connection pipe 48 is sent to the second internal connection pipe 42 through the first flow path switching valve 46. Further, the refrigerant sent to the seventh internal connection pipe 49 is sent to the third internal connection pipe 43 through the second flow path switching valve 47, and merges into the refrigerant flowing through the ninth internal connection pipe 55.

The refrigerant flowing through the second internal connection pipe 42-4 of the refrigerant flow path switching unit 4-4 flows out from the refrigerant flow path switching unit 4-4, and is sent in order to the second heat source-side connection pipe 8-4, the second internal connection pipe 42-3 of the refrigerant flow path switching unit 4-3, the second heat source-side connection pipe 8-3, the second internal connection pipe 42-2 of the refrigerant flow path switching unit 4-2, the second heat source-side connection pipe 8-2, the second internal connection pipe 42-1 of the refrigerant flow path switching unit 4-1, and the second heat source-side connection pipe 8-1. At this time, the refrigerant flowing through the second internal connection pipe 42 in the refrigerant flow path switching unit 4 sequentially merges. Then, the refrigerant flowing through the second heat source-side connection pipe 8-1 after all the refrigerant flowing through the second internal connection pipe 42 has merged is sent to the heat source unit 2. Further, the refrigerant flowing through the third internal connection pipe 43-4 of the refrigerant flow path switching unit 4-4 flows out from the refrigerant flow path switching unit 4-4, and is sent in order to the third heat source-side connection pipe 9-4, the third internal connection pipe 43-3 of the refrigerant flow path switching unit 4-3, the third heat source-side connection pipe 9-3, the third internal connection pipe 43-2 of the refrigerant flow path switching unit 4-2, the third heat source-side connection pipe 9-2, the third internal connection pipe 43-1 of the refrigerant flow path switching unit 4-1, and the third heat source-side connection pipe 9-1. At this time, the refrigerant flowing through the third internal connection pipe 43 in the refrigerant flow path switching unit 4 sequentially merges. Then, the refrigerant flowing through the third heat source-side connection pipe 9-1 after all the refrigerant flowing through the third internal connection pipe 43 has merged is sent to the heat source unit 2.

The refrigerant sent to the heat source unit 2 is sucked into the compressor 21 through the second closing valve 26 and the second heat source-side switching valve 29 and through the third closing valve 27, and is compressed again.

—Heating Only Operation—

During the heating only operation, for example, when all the utilization units 3 perform the heating operation, the first heat source-side switching valve 22 is switched to the heat source-side evaporation state and the second heat source-side switching valve 29 is switched to the refrigerant outflow state to drive the compressor 21, the heat source-side fan 28, and the utilization-side fan 33. Further, the first flow path switching valve 46 is opened and the second flow path switching valve 47 is closed.

Then, the refrigerant discharged from the compressor 21 in the heat source unit 2 flows out from the heat source unit 2 through the second heat source-side switching valve 29 and the second closing valve 26.

The refrigerant flowing out from the heat source unit 2 through the second closing valve 26 is sent in order to the second heat source-side connection pipe 8-1, the second internal connection pipe 42-1 of the refrigerant flow path switching unit 4-1, the second heat source-side connection pipe 8-2, the second internal connection pipe 42-2 of the refrigerant flow path switching unit 4-2, the second heat source-side connection pipe 8-3, the second internal connection pipe 42-3 of the refrigerant flow path switching unit 4-3, the second heat source-side connection pipe 8-4, and the second internal connection pipe 42-4 of the refrigerant flow path switching unit 4-4. At this time, the refrigerant flowing through the second internal connection pipe 42 in the refrigerant flow path switching unit 4 is sequentially branched to the sixth internal connection pipe 48. Then, the refrigerant branched to the sixth internal connection pipe 48 flows out from the refrigerant flow path switching unit 4 through the first flow path switching valve 46 and the eighth internal connection pipe 50.

The refrigerant flowing out from the refrigerant flow path switching unit 4 is sent to the utilization unit 3 through the second utilization-side connection pipe 11. The refrigerant sent to the utilization unit 3 is sent to the utilization-side heat exchanger 32. The refrigerant sent to the utilization-side heat exchanger 32 exchanges heat with the indoor air to radiate heat. The refrigerant having radiated heat in the utilization-side heat exchanger 32 is decompressed by the utilization-side expansion valve 31 and then flows out from the utilization unit 3.

The refrigerant flowing out from the utilization unit 3 is sent to the refrigerant flow path switching unit 4 through the first utilization-side connection pipe 10.

The refrigerant sent to the refrigerant flow path switching unit 4 is sent to the first internal connection pipe 41 through the fourth internal connection pipe 44.

The refrigerant flowing through the first internal connection pipe 41-4 of the refrigerant flow path switching unit 4-4 flows out from the refrigerant flow path switching unit 4-4, and is sent in order to the first heat source-side connection pipe 7-4, the first internal connection pipe 41-3 of the refrigerant flow path switching unit 4-3, the first heat source-side connection pipe 7-3, the first internal connection pipe 41-2 of the refrigerant flow path switching unit 4-2, the first heat source-side connection pipe 7-2, the first internal connection pipe 41-1 of the refrigerant flow path switching unit 4-1, and the first heat source-side connection pipe 7-1. At this time, the refrigerant flowing through the first internal connection pipe 41 in the refrigerant flow path switching unit 4 sequentially merges. Then, the refrigerant flowing through the first heat source-side connection pipe 7-1 after all the refrigerant flowing through the first internal connection pipe 41 has merged is sent to the heat source unit 2.

The refrigerant sent to the heat source unit 2 is sent to the heat source-side expansion valve 24 through the first closing valve 25. The refrigerant sent to the heat source-side expansion valve 24 is decompressed by the heat source-side expansion valve 24 and then is sent to the heat source-side heat exchanger 23. The refrigerant sent to the heat source-side heat exchanger 23 exchanges heat with the outdoor air and evaporates. The refrigerant having evaporated in the heat source-side heat exchanger 23 is sucked into the compressor 21 through the first heat source-side switching valve 22 and is compressed again.

—Cooling Dominant Operation—

During the cooling dominant operation, for example, when the utilization unit 3-4 connected to the refrigerant flow path switching unit 4-4 performs the heating operation and the utilization units 3-1, 3-2, and 3-3 connected to the other refrigerant flow path switching units 4-1 to 4-3 perform the cooling operation, the first heat source-side switching valve 22 is switched to the heat source-side radiation state and the second heat source-side switching valve 29 is switched to the refrigerant outflow state to drive the compressor 21, the heat source-side fan 28, and the utilization-side fan 33. Further, a first flow path switching valve 46-4 of the refrigerant flow path switching unit 4-4 is opened, a second flow path switching valve 47-4 of the refrigerant flow path switching unit 4-4 is closed, first flow path switching valves 46-1, 46-2, and 46-3 of the refrigerant flow path switching units 4-1 to 4-3 are closed, and second flow path switching valves 47-1, 47-2, and 47-3 of the refrigerant flow path switching units 4-1 to 4-3 are opened.

Then, a part of the refrigerant discharged from the compressor 21 in the heat source unit 2 is sent to the heat source-side heat exchanger 23 through the first heat source-side switching valve 22, and the rest of the refrigerant flows out from the heat source unit 2 through the second heat source-side switching valve 29 and the second closing valve 26. The refrigerant sent to the heat source-side heat exchanger 23 exchanges heat with the outdoor air in the heat source-side heat exchanger 23 to radiate heat. The refrigerant having radiated heat in the heat source-side heat exchanger 23 flows out from the heat source unit 2 through the heat source-side expansion valve 24 and the first closing valve 25.

The refrigerant flowing out from the heat source unit 2 through the second closing valve 26 is sent in order to the second heat source-side connection pipe 8-1, the second internal connection pipe 42-1 of the refrigerant flow path switching unit 4-1, the second heat source-side connection pipe 8-2, the second internal connection pipe 42-2 of the refrigerant flow path switching unit 4-2, the second heat source-side connection pipe 8-3, the second internal connection pipe 42-3 of the refrigerant flow path switching unit 4-3, the second heat source-side connection pipe 7-4, and the second internal connection pipe 42-4 of the refrigerant flow path switching unit 4-4. At this time, the refrigerant flowing through the second internal connection pipe 42-4 of the refrigerant flow path switching unit 4-4 is sequentially branched to a sixth internal connection pipe 48-4. Then, the refrigerant branched to the sixth internal connection pipe 48-4 flows out from the refrigerant flow path switching unit 4-4 through the first flow path switching valve 46-4 and an eighth internal connection pipe 50-4.

The refrigerant flowing out from the refrigerant flow path switching unit 4-4 is sent to the utilization unit 3-4 through the second utilization-side connection pipe 11-4. The refrigerant sent to the utilization unit 3-4 is sent to a utilization-side heat exchanger 32-4. The refrigerant sent to the utilization-side heat exchanger 32-4 exchanges heat with the indoor air to radiate heat. The refrigerant having radiated heat in the utilization-side heat exchanger 32-4 is decompressed by a utilization-side expansion valve 31-4 and then flows out from the utilization unit 3-4.

The refrigerant flowing out from the utilization unit 3-4 is sent to the refrigerant flow path switching unit 4-4 through the first utilization-side connection pipe 10-4.

The refrigerant sent to the refrigerant flow path switching unit 4-4 is sent to the first internal connection pipe 41-4 through a fourth internal connection pipe 44-4.

The refrigerant flowing out from the heat source unit 2 through the heat source-side expansion valve 24 and the first closing valve 25 is sent in order to the first heat source-side connection pipe 7-1, the first internal connection pipe 41-1 of the refrigerant flow path switching unit 4-1, the first heat source-side connection pipe 7-2, the first internal connection pipe 41-2 of the refrigerant flow path switching unit 4-2, the first heat source-side connection pipe 7-3, the first internal connection pipe 41-3 of the refrigerant flow path switching unit 4-3. Furthermore, the refrigerant flowing through the first internal connection pipe 41-4 of the refrigerant flow path switching unit 4-4 merges into this refrigerant through the first heat source-side connection pipe 7-4. At this time, the refrigerant flowing through the first internal connection pipes 41-1, 41-2, and 41-3 in the refrigerant flow path switching units 4-1, 4-2, and 4-3 is sequentially branched to fourth internal connection pipes 44-1, 44-2, and 44-3. Then, a part of the refrigerant branched to the fourth internal connection pipes 44-1, 44-2, and 44-3 is branched to ninth internal connection pipes 55-1, 55-2, and 55-3, and the rest of the refrigerant is sent to supercooling heat exchangers 54-1, 54-2, and 54-3. The refrigerant branched to the ninth internal connection pipes 55-1, 55-2, and 55-3 is also decompressed by supercooling expansion valves 58-1, 58-2, and 58-3, and then is sent to the supercooling heat exchangers 54-1, 54-2, and 54-3. The refrigerant flowing through the fourth internal connection pipes 44-1, 44-2, and 44-3 is cooled by exchanging heat with the refrigerant flowing through the ninth internal connection pipes 55-1, 55-2, and 55-3 in the supercooling heat exchangers 54-1, 54-2, and 54-3, and then flows out from the refrigerant flow path switching units 4-1, 4-2, and 4-3. On the other hand, the refrigerant flowing through the ninth internal connection pipes 55-1, 55-2, and 55-3 is heated by exchanging heat with the refrigerant flowing through the fourth internal connection pipes 44-1, 44-2, and 44-3 in the supercooling heat exchangers 54-1, 54-2, and 54-3, and then is sent to third internal connection pipes 43-1, 43-2, and 43-3 through tenth internal connection pipes 56-1, 56-2, and 56-3 and eleventh internal connection pipes 59-1, 59-2, and 59-3.

The refrigerant flowing out from the refrigerant flow path switching units 4-1, 4-2, and 4-3 is sent to the utilization units 3-1, 3-2, and 3-3 through the first utilization-side connection pipes 10-1, 10-2, and 10-3. The refrigerant sent to the utilization units 3-1, 3-2, and 3-3 is decompressed by utilization-side expansion valves 31-1, 31-2, and 31-3, and then is sent to utilization-side heat exchangers 32-1, 32-2, and 32-3. The refrigerant sent to the utilization-side heat exchangers 32-1, 32-2, and 32-3 exchanges heat with the indoor air, evaporates, and flows out from the utilization units 3-1, 3-2, and 3-3.

The refrigerant flowing out from the utilization units 3-1, 3-2, and 3-3 is sent to the refrigerant flow path switching units 4-1, 4-2, and 4-3 through the second utilization-side connection pipes 11-1, 11-2, and 11-3.

The refrigerant sent to the refrigerant flow path switching units 4-1, 4-2, and 4-3 is sent to the third internal connection pipe 43-1, 43-2, and 43-3 through eighth internal connection pipes 50-1, 50-2, and 50-3 and seventh internal connection pipes 49-1, 49-2, and 49-3 including the second flow path switching valves 47-1, 47-2, and 47-3, and merges into the refrigerant flowing through the ninth internal connection pipes 55-1, 55-2, and 55-3.

The refrigerant flowing through the third internal connection pipe 43-3 of the refrigerant flow path switching unit 4-3 flows out from the refrigerant flow path switching unit 4-3, and is sent in order to the third heat source-side connection pipe 9-3, the third internal connection pipe 43-2 of the refrigerant flow path switching unit 4-2, the third heat source-side connection pipe 9-2, the third internal connection pipe 43-1 of the refrigerant flow path switching unit 4-1, and the third heat source-side connection pipe 9-1. At this time, the refrigerant flowing through the third internal connection pipes 43-1, 43-2, and 43-3 in the refrigerant flow path switching units 4-1, 4-2, and 4-3 sequentially merges. Then, the refrigerant flowing through the third heat source-side connection pipe 9-1 after all the refrigerant flowing through the third internal connection pipes 43-1, 43-2, and 43-3 has merged is sent to the heat source unit 2.

The refrigerant sent to the heat source unit 2 is sucked into the compressor 21 through the third closing valve 27 and is compressed again.

—Heating Dominant Operation—

During the heating dominant operation, for example, when the utilization unit 3-4 connected to the refrigerant flow path switching unit 4-4 performs the cooling operation and the utilization units 3-1, 3-2, and 3-3 connected to the other refrigerant flow path switching units 4-1 to 4-3 perform the heating operation, the first heat source-side switching valve 22 is switched to the heat source-side evaporation state and the second heat source-side switching valve 29 is switched to the refrigerant outflow state to drive the compressor 21, the heat source-side fan 28, and the utilization-side fan 33. Further, the first flow path switching valve 46-4 of the refrigerant flow path switching unit 4-4 is closed, the second flow path switching valve 47-4 of the refrigerant flow path switching unit 4-4 is opened, the first flow path switching valves 46-1, 46-2, and 46-3 of the refrigerant flow path switching units 4-1 to 4-3 are opened, and the second flow path switching valves 47-1, 47-2, and 47-3 of the refrigerant flow path switching units 4-1 to 4-3 are closed.

Then, the refrigerant discharged from the compressor 21 in the heat source unit 2 flows out from the heat source unit 2 through the second heat source-side switching valve 29 and the second closing valve 26.

The refrigerant flowing out from the heat source unit 2 through the second closing valve 26 is sent in order to the second heat source-side connection pipe 8-1, the second internal connection pipe 42-1 of the refrigerant flow path switching unit 4-1, the second heat source-side connection pipe 8-2, the second internal connection pipe 42-2 of the refrigerant flow path switching unit 4-2, the second heat source-side connection pipe 8-3, and the second internal connection pipe 42-3 of the refrigerant flow path switching unit 4-3. At this time, the refrigerant flowing through the second internal connection pipes 42-1, 42-2, and 42-3 in the refrigerant flow path switching units 4-1, 4-2, and 4-3 is sequentially branched to sixth internal connection pipes 48-1, 48-2, and 48-3. Then, the refrigerant branched to the sixth internal connection pipes 48-1, 48-2, and 48-3 flows out from the refrigerant flow path switching units 4-1, 4-2, and 4-3 through the first flow path switching valves 46-1, 46-2, and 46-3 and the eighth internal connection pipes 50-1, 50-2, and 50-3.

The refrigerant flowing out from the refrigerant flow path switching units 4-1, 4-2, and 4-3 is sent to the utilization units 3-1, 3-2, and 3-3 through the second utilization-side connection pipes 11-1, 11-2, and 11-3. The refrigerant sent to the utilization units 3-1, 3-2, and 3-3 is sent to the utilization-side heat exchangers 32-1, 32-2, and 32-3. The refrigerant sent to the utilization-side heat exchangers 32-1, 32-2, and 32-3 exchanges heat with the indoor air to radiate heat. The refrigerant having radiated heat in the utilization-side heat exchangers 32-1, 32-2, and 32-3 is decompressed by the utilization-side expansion valves 31-1, 31-2, and 31-3, and then flows out from the utilization units 3-1, 3-2, and 3-3.

The refrigerant flowing out from the utilization units 3-1, 3-2, and 3-3 is sent to the refrigerant flow path switching units 4-1, 4-2, and 4-3 through the first utilization-side connection pipes 10-1, 10-2, and 10-3.

The refrigerant sent to the refrigerant flow path switching units 4-1, 4-2, and 4-3 is sent to the first internal connection pipes 41-1, 44-2, and 44-3 through the fourth internal connection pipes 44-1, 44-2, and 44-3.

The refrigerant flowing through the first internal connection pipe 41-3 of the refrigerant flow path switching unit 4-3 flows out from the refrigerant flow path switching unit 4-3, and is sent in order to the first heat source-side connection pipe 7-3, the first internal connection pipe 41-2 of the refrigerant flow path switching unit 4-2, the first heat source-side connection pipe 7-2, the first internal connection pipe 41-1 of the refrigerant flow path switching unit 4-1, and the first heat source-side connection pipe 7-1. At this time, the refrigerant flowing through the first internal connection pipes 41-1, 41-2, and 41-3 in the refrigerant flow path switching units 4-1, 4-2, and 4-3 sequentially merges. Furthermore, a part of this refrigerant is sent to the refrigerant flow path switching unit 4-4 through the first heat source-side connection pipe 7-4. Then, the refrigerant flowing through the first heat source-side connection pipe 7-1 after all the refrigerant flowing through the first internal connection pipes 41-1, 41-2, and 41-3 except for the refrigerant sent to the refrigerant flow path switching unit 4-4 has merged is sent to the heat source unit 2.

The refrigerant sent to the refrigerant flow path switching unit 4-4 is sequentially branched from the first internal connection pipe 41-4 to the fourth internal connection pipe 44-4. Then, a part of the refrigerant branched to the fourth internal connection pipe 44-4 is branched to a ninth internal connection pipe 55-4, and the rest of the refrigerant is sent to a supercooling heat exchanger 54-4. The refrigerant branched to the ninth internal connection pipe 55-4 is also decompressed by the supercooling expansion valve 58-4 and then is sent to the supercooling heat exchanger 54-4. The refrigerant flowing through the fourth internal connection pipe 44-4 is cooled by exchanging heat with the refrigerant flowing through the ninth internal connection pipe 55-4 in the supercooling heat exchanger 54-4, and then flows out from the refrigerant flow path switching unit 4-4. On the other hand, the refrigerant flowing through the ninth internal connection pipe 55-4 is heated by exchanging heat with the refrigerant flowing through the fourth internal connection pipe 44-4 in the supercooling heat exchanger 54-4, and then is sent to the third internal connection pipe 43-4 through a tenth internal connection pipe 56-4 and an eleventh internal connection pipe 59-4.

The refrigerant flowing out from the refrigerant flow path switching unit 4-4 is sent to the utilization unit 3-4 through the first utilization-side connection pipe 10-4. The refrigerant sent to the utilization unit 3-4 is decompressed by the utilization-side expansion valve 31-4 and then is sent to the utilization-side heat exchanger 32-4. The refrigerant sent to the utilization-side heat exchanger 32-4 exchanges heat with the indoor air, evaporates, and flows out from the utilization unit 3-4.

The refrigerant flowing out from the utilization unit 3-4 is sent to the refrigerant flow path switching unit 4-4 through the second utilization-side connection pipe 11-4.

The refrigerant sent to the refrigerant flow path switching unit 4-4 is sent to the third internal connection pipe 43-4 through the eighth internal connection pipe 50-4 and the seventh internal connection pipe 49-4 including the second flow path switching valve 47-4, and merges into the refrigerant flowing through the ninth internal connection pipe 55-4.

The refrigerant flowing through the third internal connection pipe 43-4 of the refrigerant flow path switching unit 4-4 flows out from the refrigerant flow path switching unit 4-4, and is sent in order to the third heat source-side connection pipe 9-3, the third internal connection pipe 43-2 of the refrigerant flow path switching unit 4-2, the third heat source-side connection pipe 9-2, the third internal connection pipe 43-1 of the refrigerant flow path switching unit 4-1, and the third heat source-side connection pipe 9-1. The refrigerant flowing through the third heat source-side connection pipe 9-1 is sent to the heat source unit 2.

The refrigerant sent to the heat source unit 2 through the first heat source-side connection pipe 7-1 is sent to the heat source-side expansion valve 24 through the first closing valve 25. The refrigerant sent to the heat source-side expansion valve 24 is decompressed by the heat source-side expansion valve 24 and then is sent to the heat source-side heat exchanger 23. The refrigerant sent to the heat source-side heat exchanger 23 exchanges heat with the outdoor air and evaporates. The refrigerant having evaporated in the heat source-side heat exchanger 23 is sent to the suction side of the compressor 21 through the first heat source-side switching valve 22. Then, this refrigerant is sucked into the compressor 21 together with the refrigerant sent to the heat source unit 2 through the third heat source-side connection pipe 9-1, and is compressed again.

(2) Detailed Configuration of Refrigerant Flow Path Switching Unit

Figure 4:
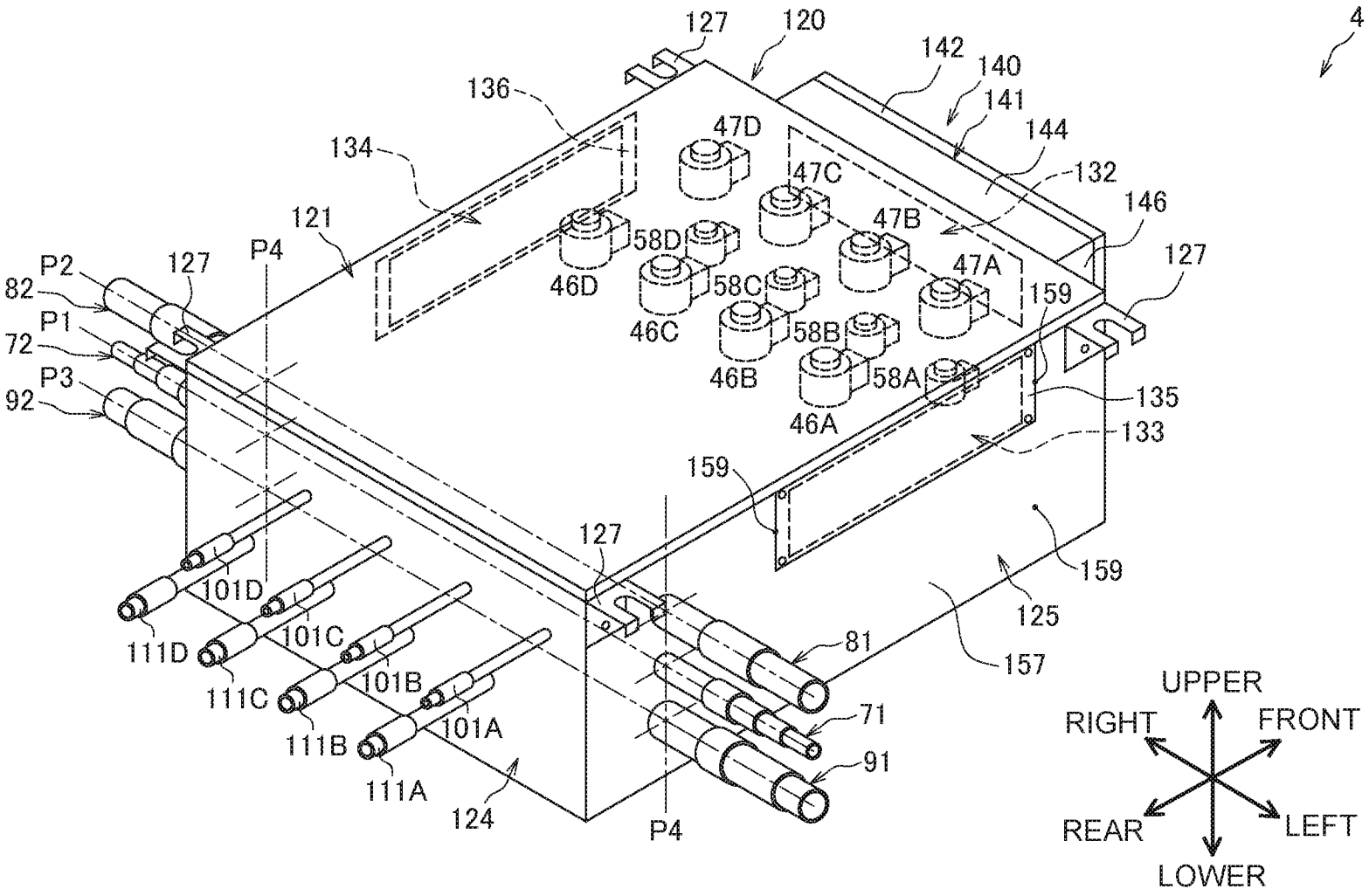
FIG. 4 is a perspective view of an appearance of the refrigerant flow path switching unit (in which an electric component box is attached to a front surface plate).
Figure 5:
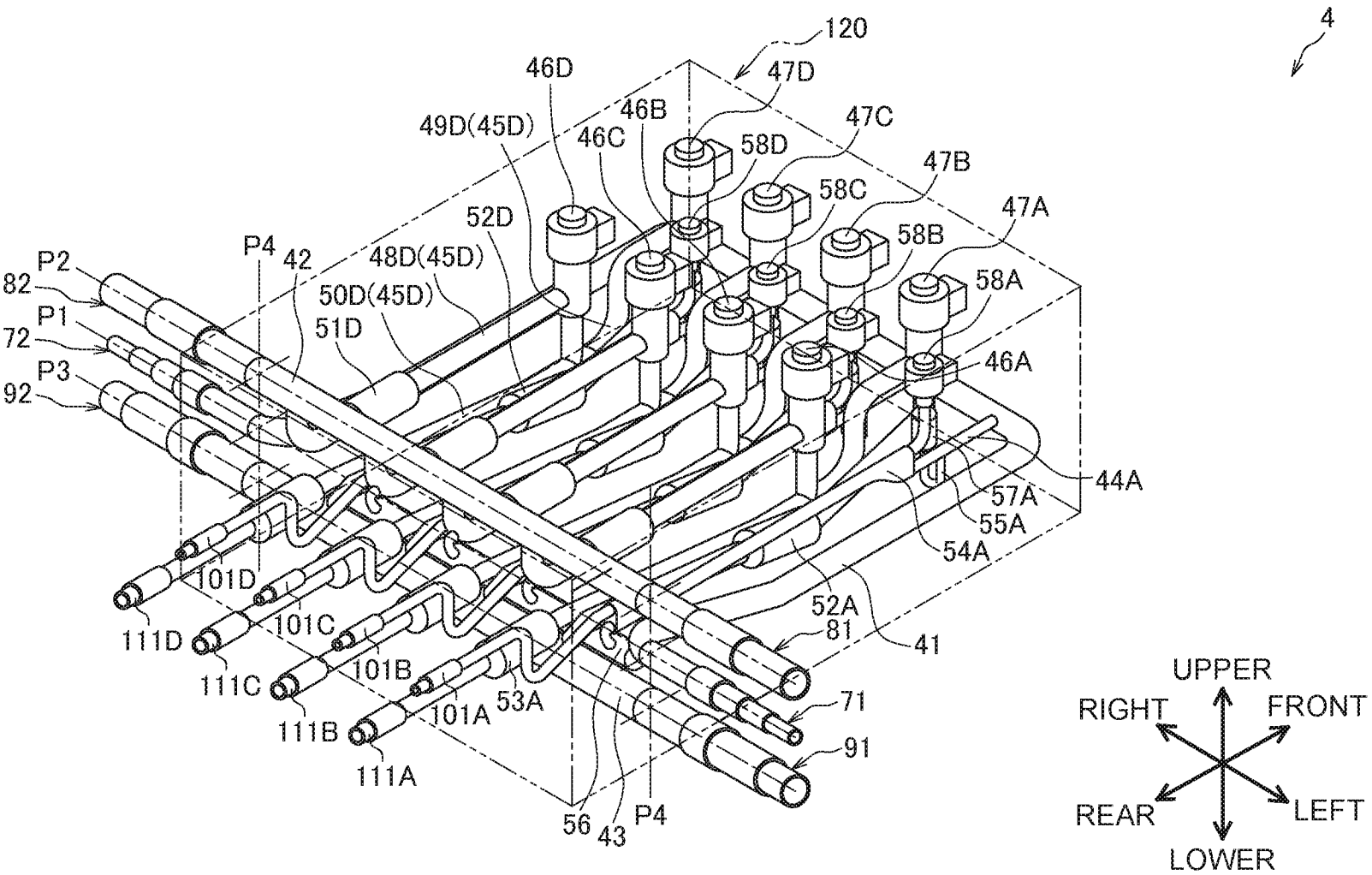
FIG. 5 is a perspective view of a circuit configuration of the refrigerant flow path switching unit.
Figure 6:
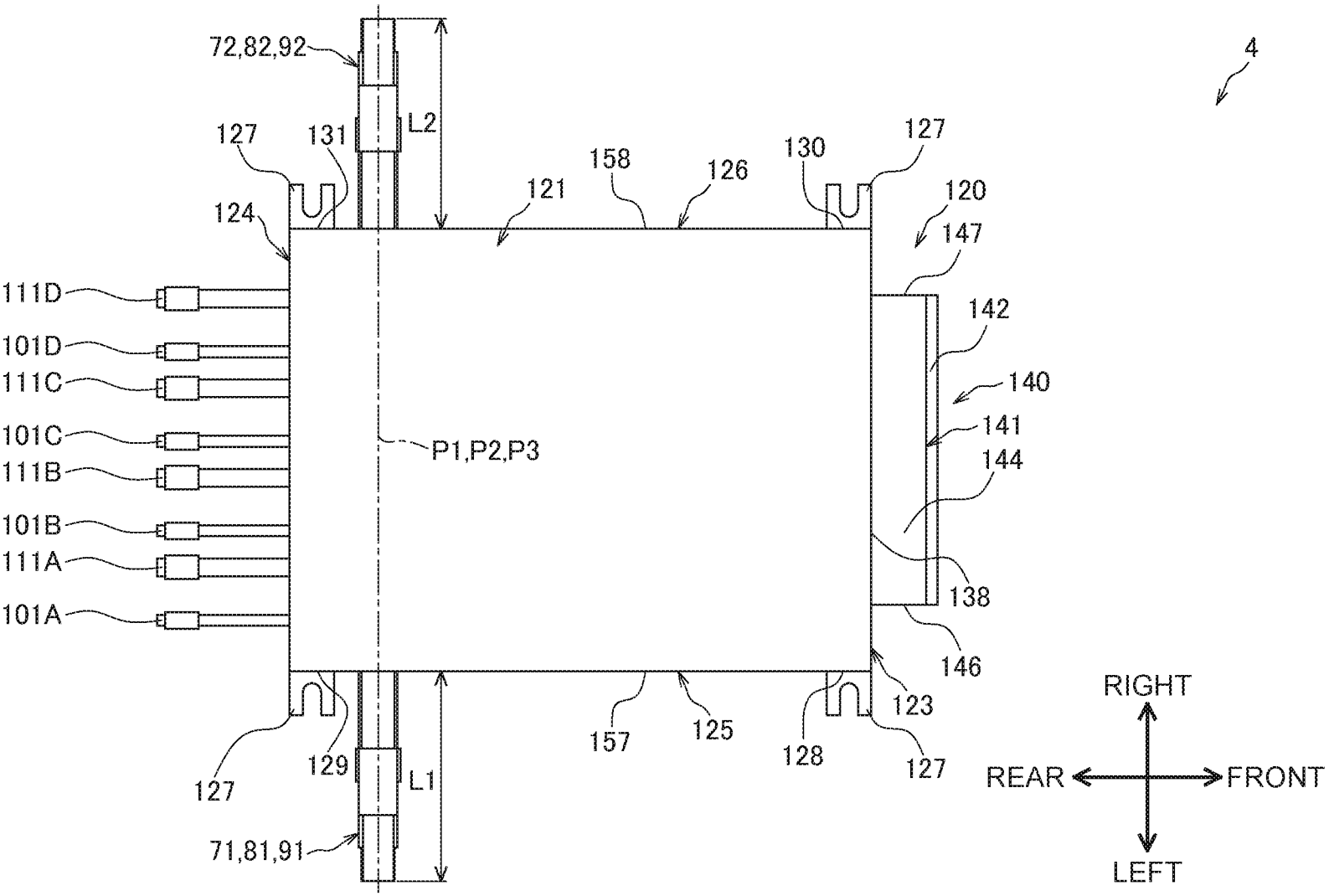
FIG. 6 is a top view of the appearance of the refrigerant flow path switching unit (in which the electric component box is attached to the front surface plate).
Figure 7:
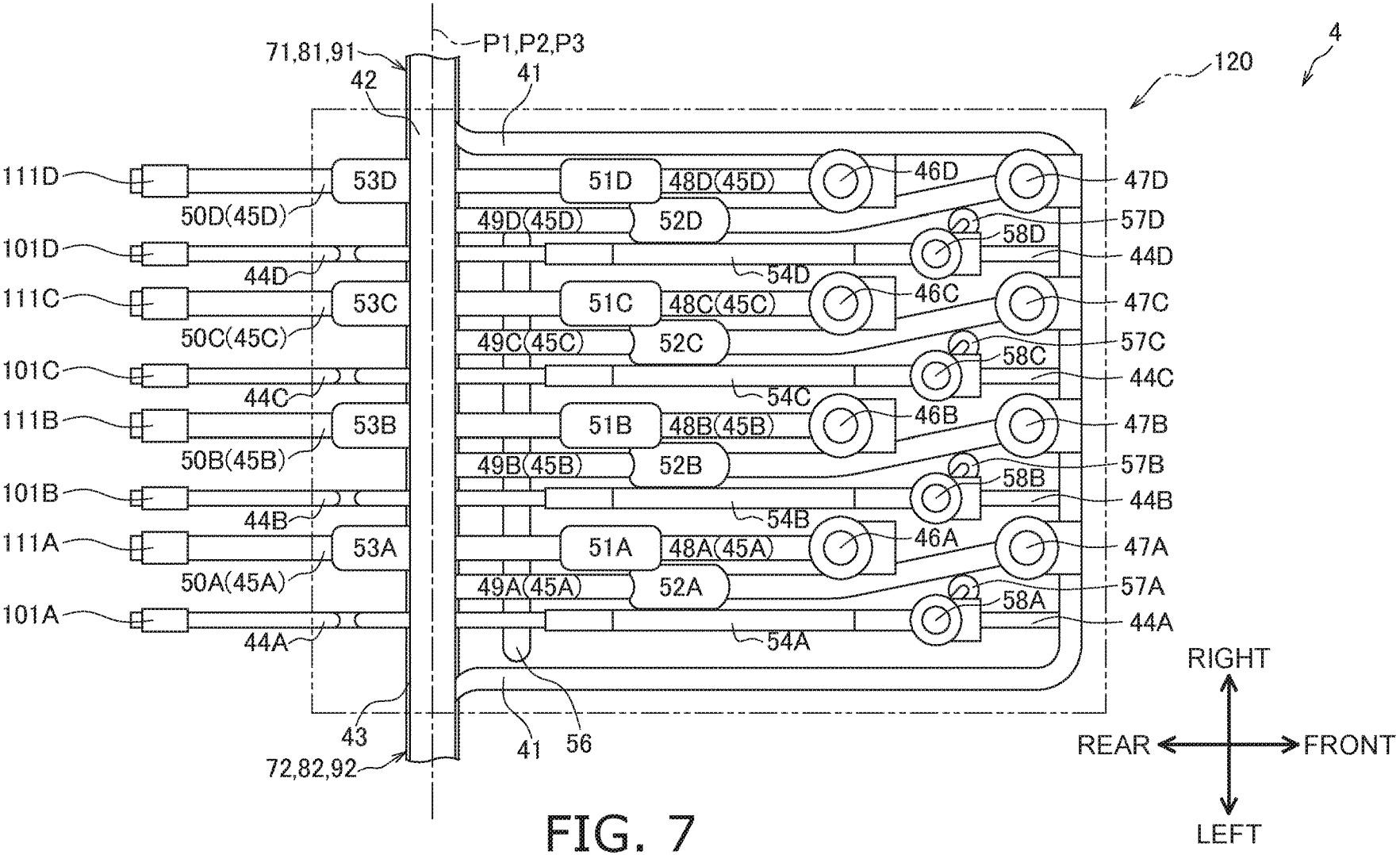
FIG. 7 is a top view of a circuit configuration of the refrigerant flow path switching unit.
Figure 8:
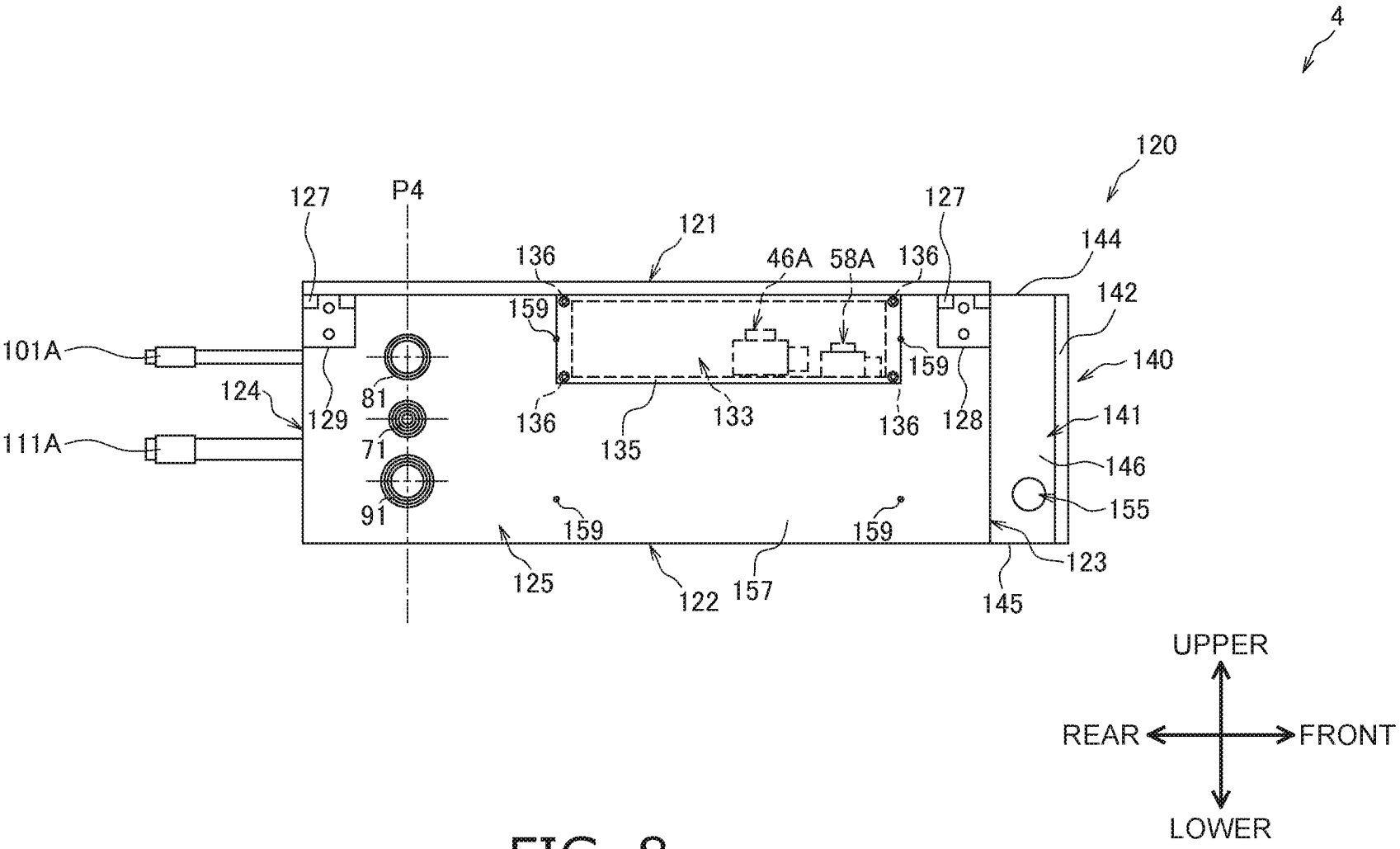
FIG. 8 is a left side view of the appearance of the refrigerant flow path switching unit (in which the electric component box is attached to the front surface plate).
Figure 9:
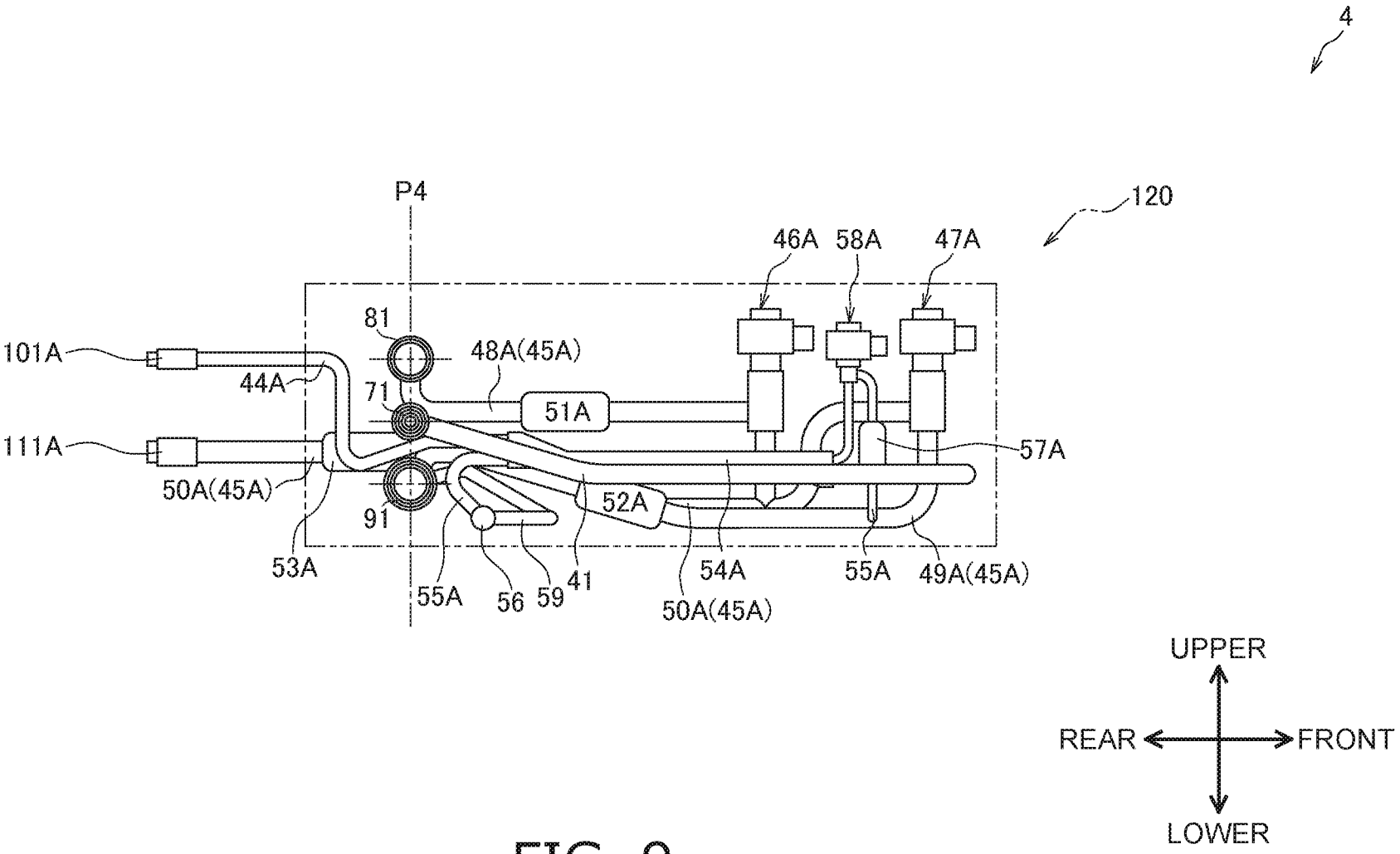
FIG. 9 is a left side view of a circuit configuration of the refrigerant flow path switching unit.
Figure 10:
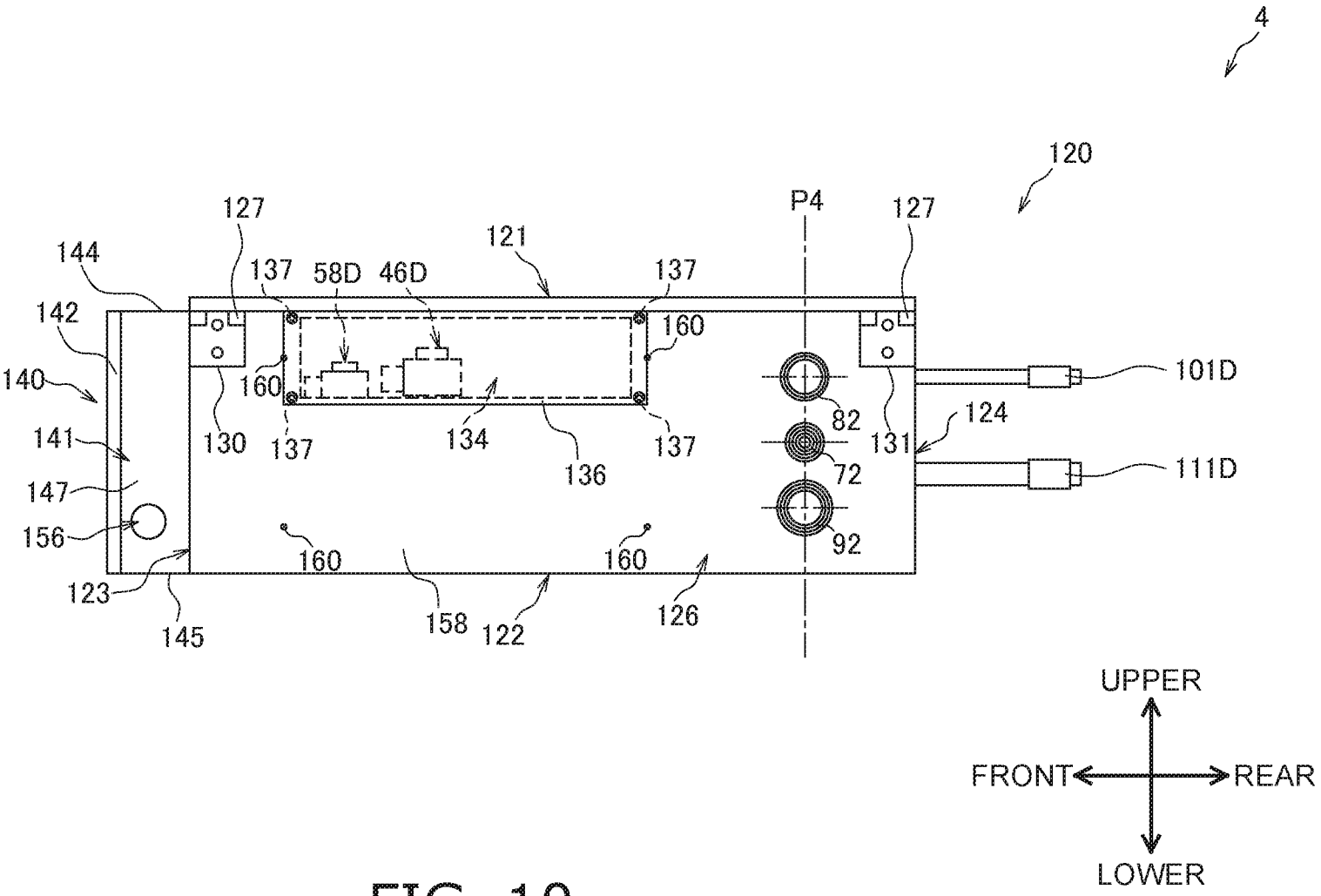
FIG. 10 is a right side view of the appearance of the refrigerant flow path switching unit (in which the electric component box is attached to the front surface plate).
Figure 11:
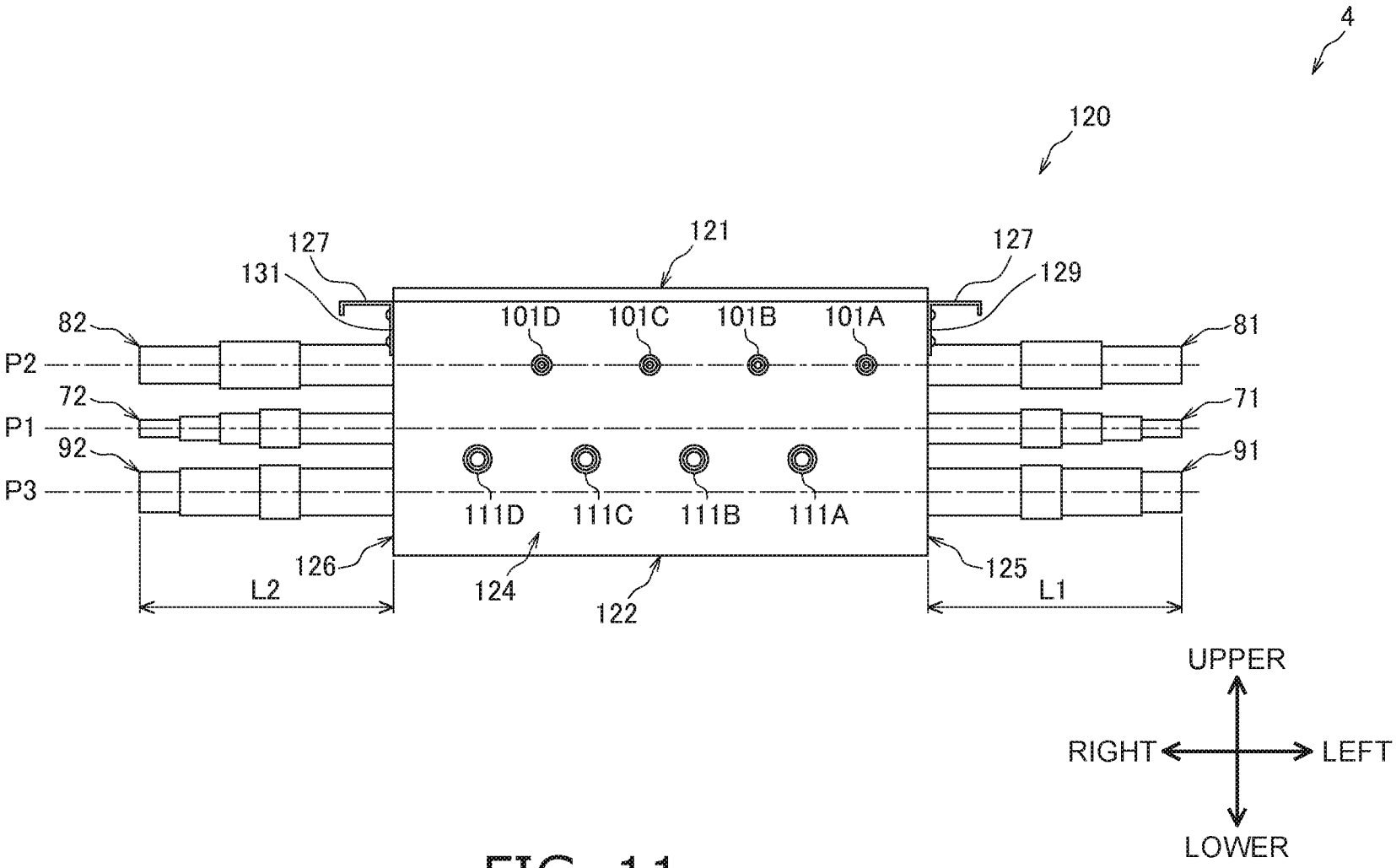
FIG. 11 is a rear view of the appearance of the refrigerant flow path switching unit.
Figure 12:
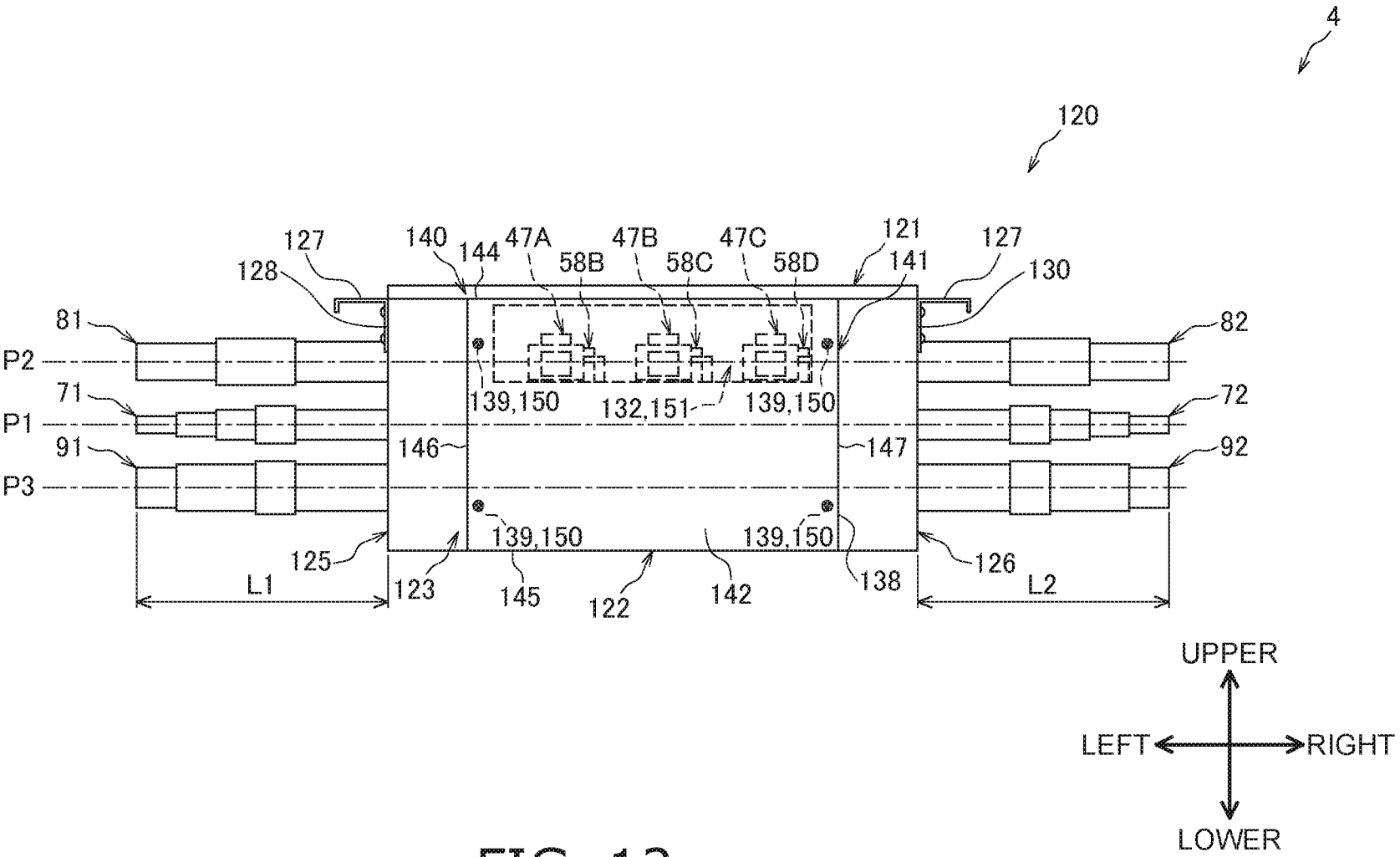
FIG. 12 is a front view of the appearance of the refrigerant flow path switching unit (in which the electric component box is attached to the front surface plate).
Figure 13:
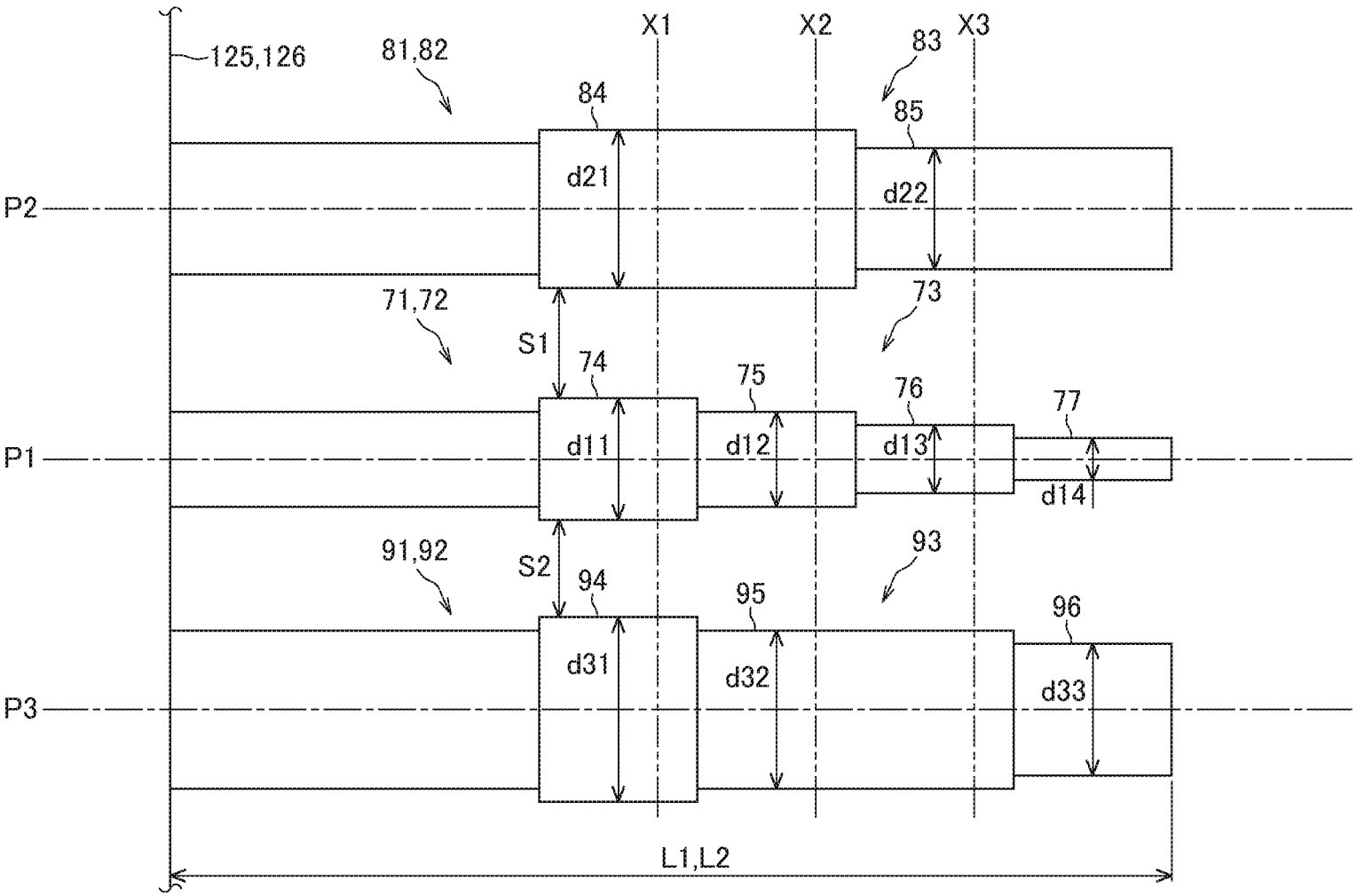
FIG. 13 is a diagram showing details of heat source-side connection nozzles (a heat source-side small nozzle, a heat source-side medium nozzle, and a heat source-side large nozzle).
Figure 14:
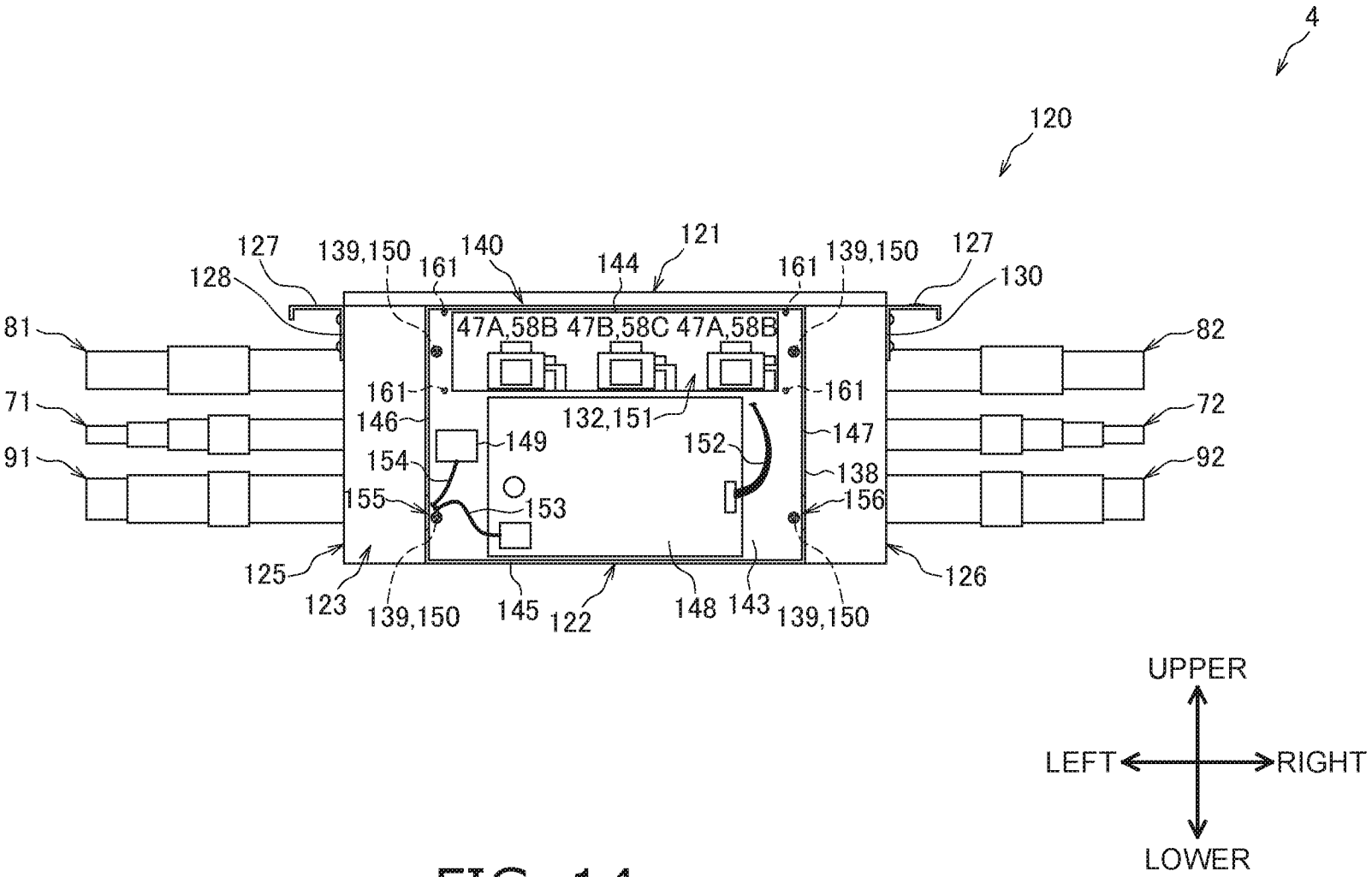
FIG. 14 is a front view of the appearance of the refrigerant flow path switching unit (in which a box lid of the electric component box attached to the front surface plate is removed).
Figure 15:
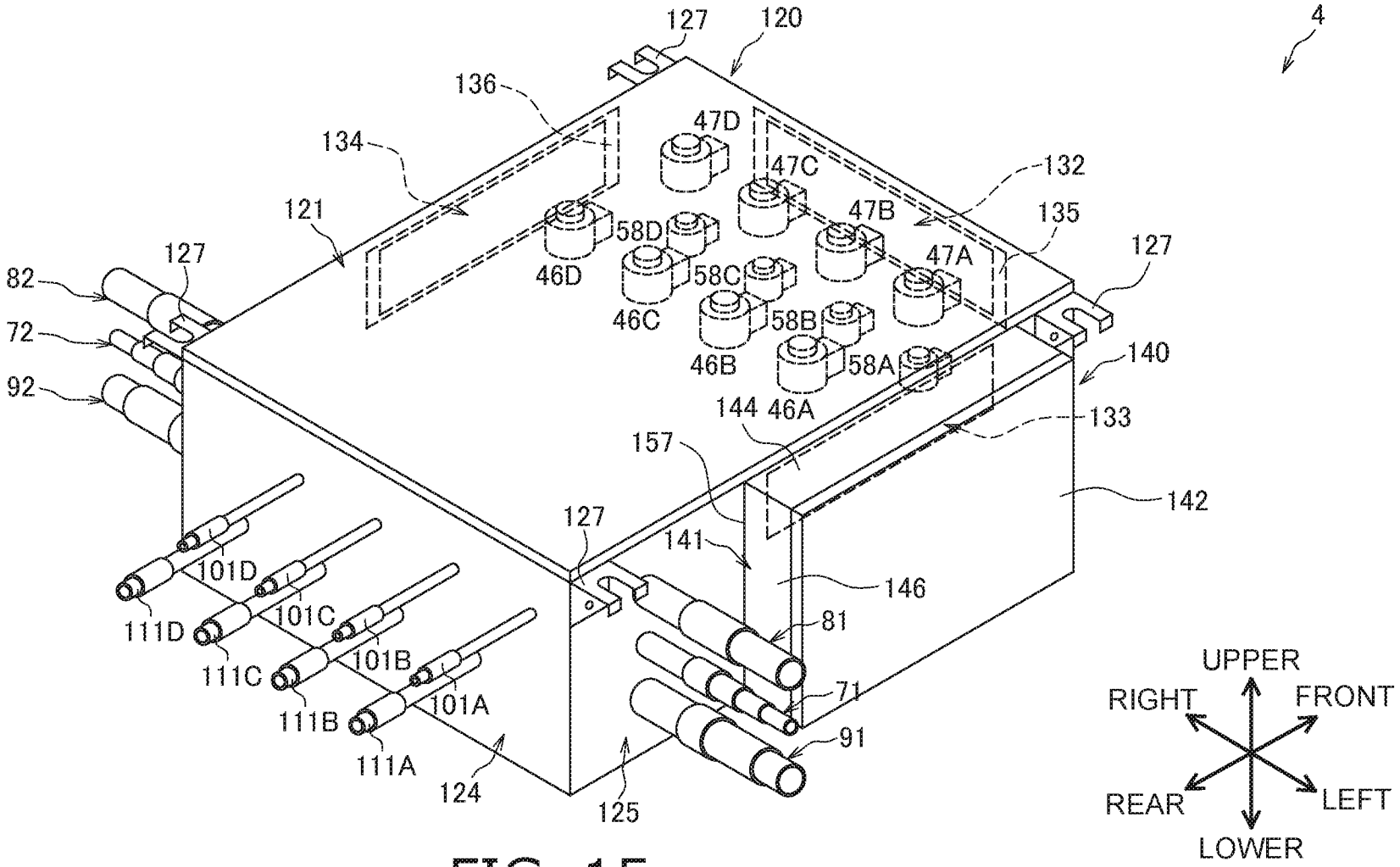
FIG. 15 is a perspective view of the appearance of the refrigerant flow path switching unit (in which the electric component box is attached to a left surface plate).
Figure 16:
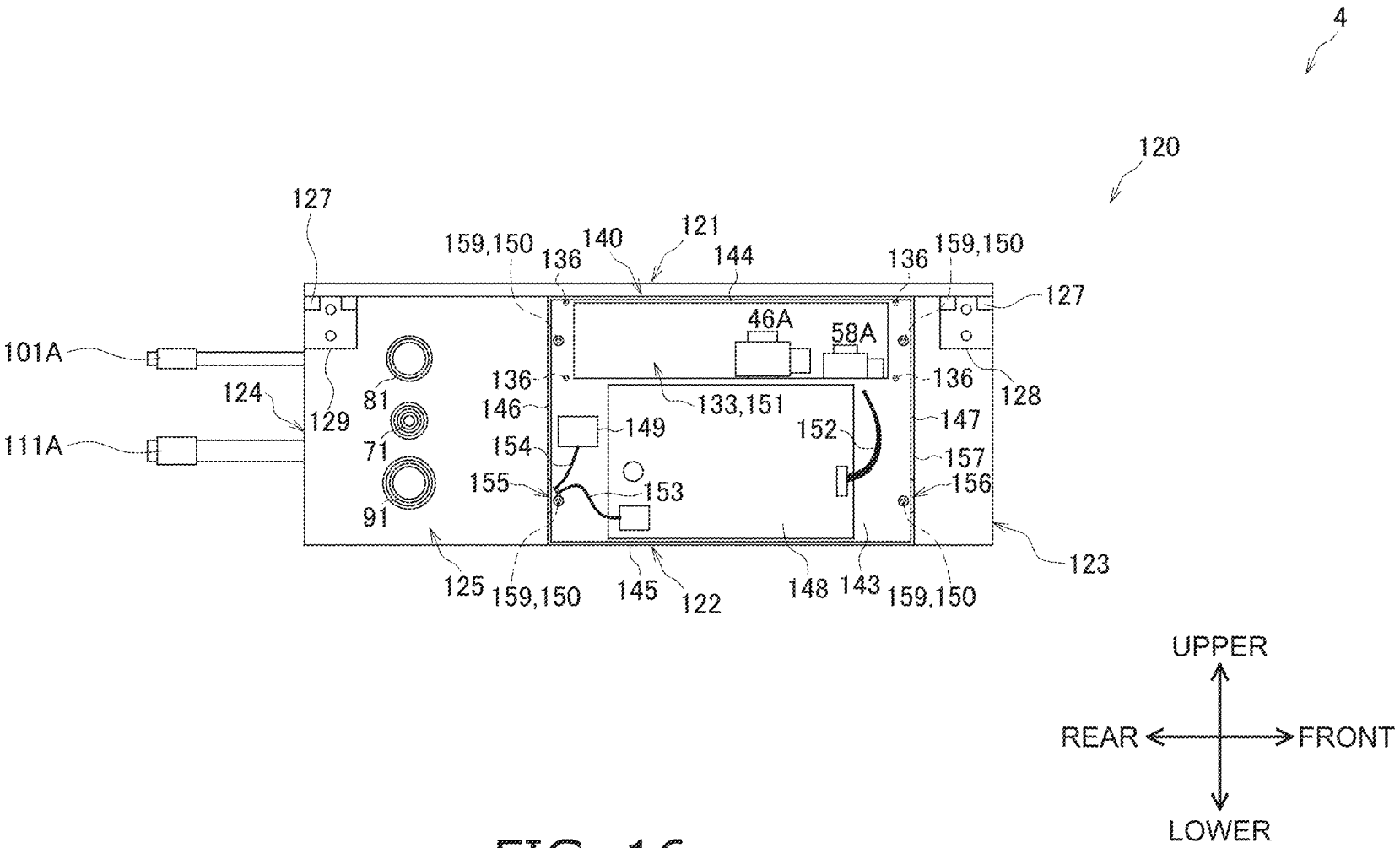
FIG. 16 is a left side view of the appearance of the refrigerant flow path switching unit (in which the box lid of the electric component box attached to the left surface plate is removed).
Figure 17:
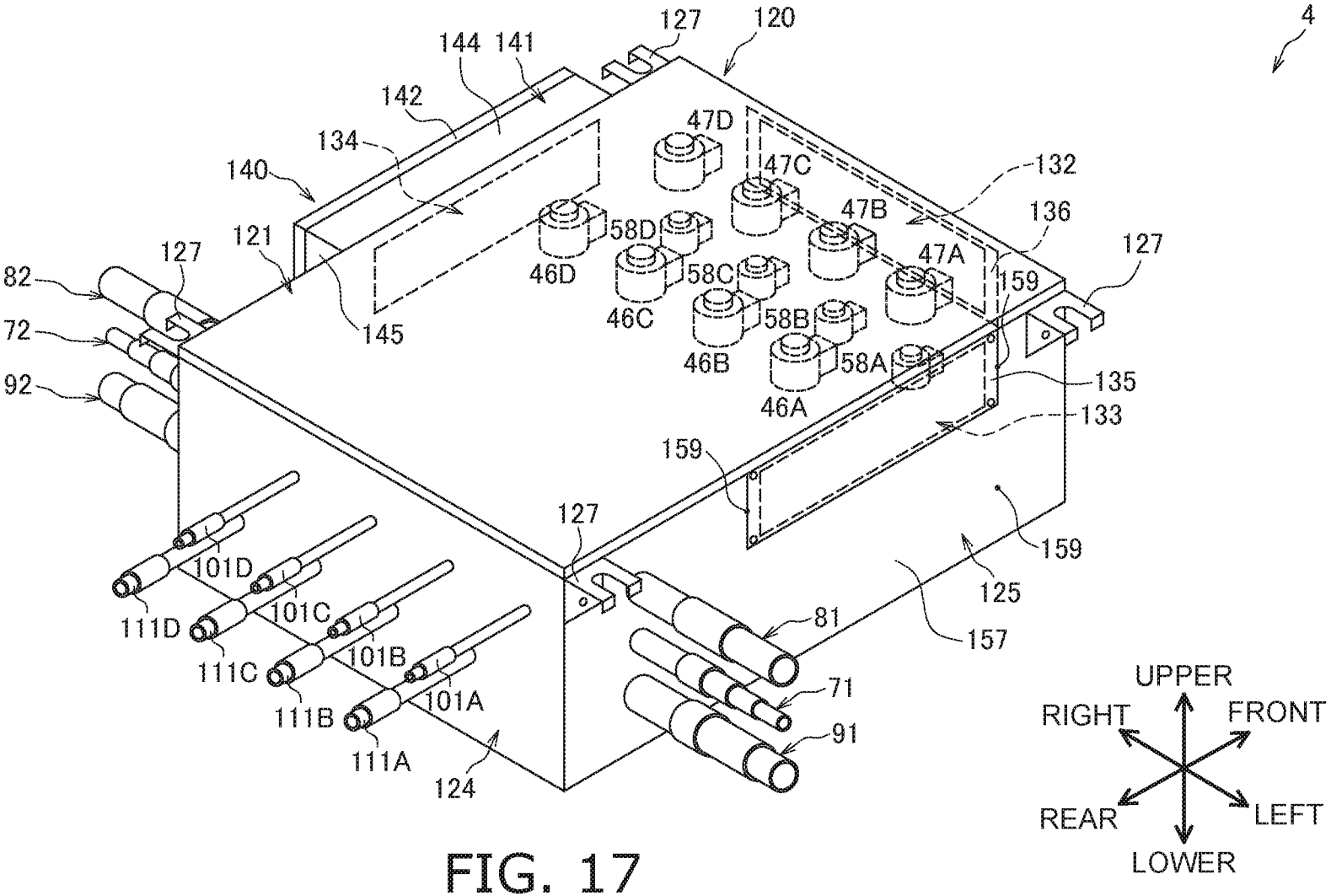
FIG. 17 is a perspective view of the appearance of the refrigerant flow path switching unit (in which the electric component box is attached to a right surface plate).
Figure 18:
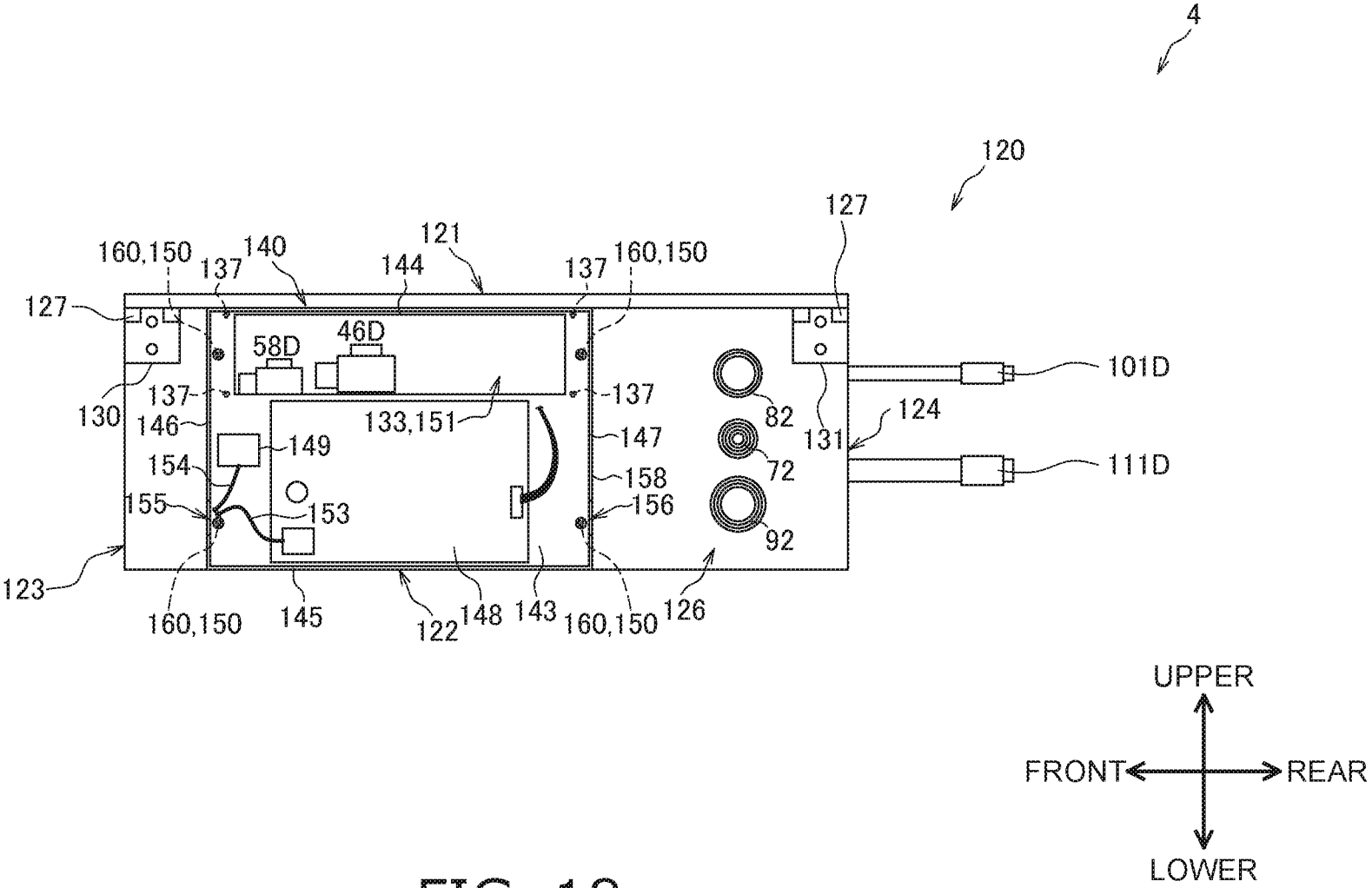
FIG. 18 is a right side view of the appearance of the refrigerant flow path switching unit (in which the box lid of the electric component box attached to the right surface plate is removed).
Figure 19:
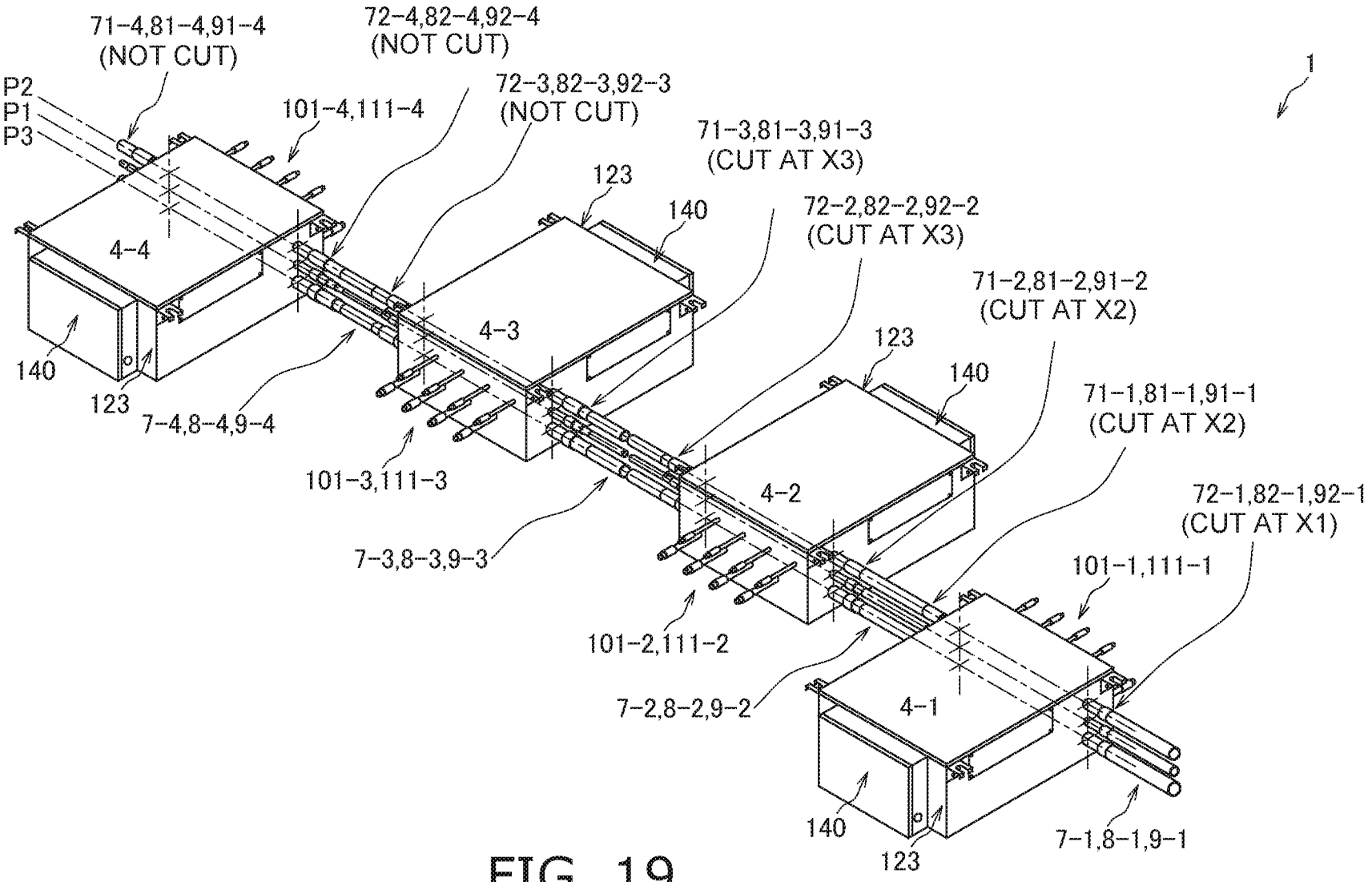
FIG. 19 is a perspective view of a configuration of the connections between the refrigerant flow path switching units (in which the electric component boxes are attached to the front surface plates).
Figure 20:
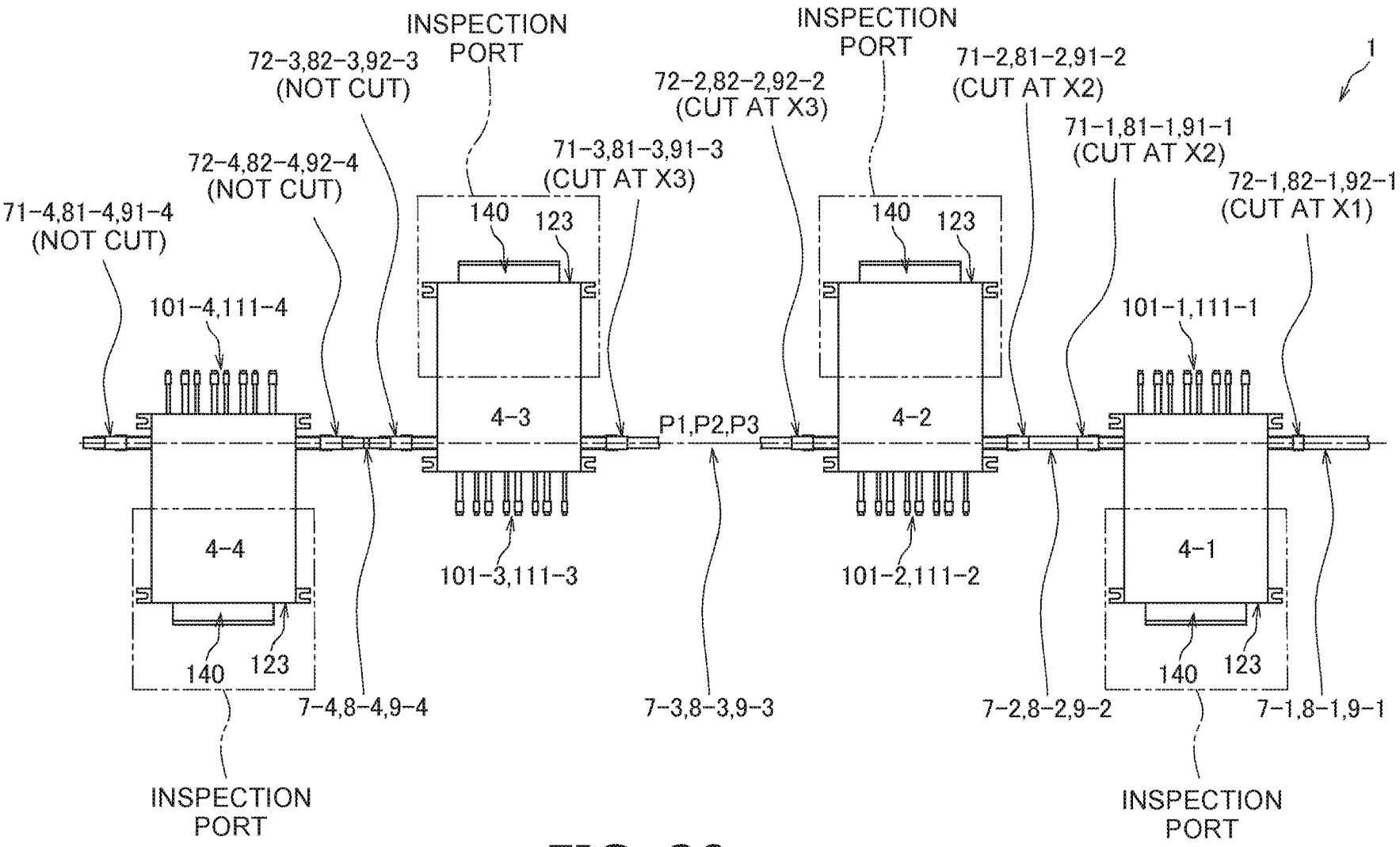
FIG. 20 is a top view of the configuration of the connections between the refrigerant flow path switching units (in which the electric component boxes are attached to the front surface plates).
Figure 21:
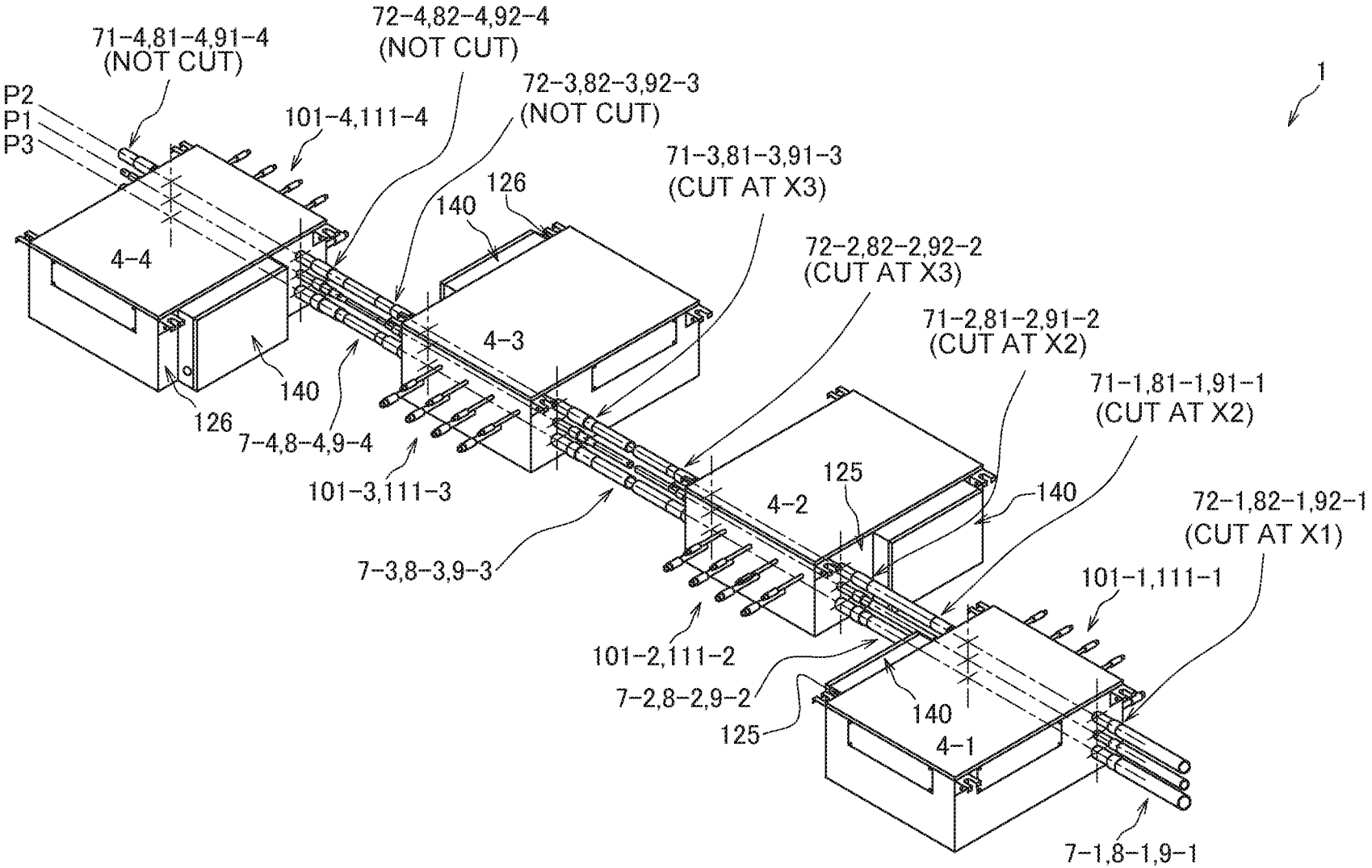
FIG. 21 is a perspective view of the configuration of the connections between the refrigerant flow path switching units (in which the electric component boxes are attached to the left surface plates or the right surface plates).
Figure 22:
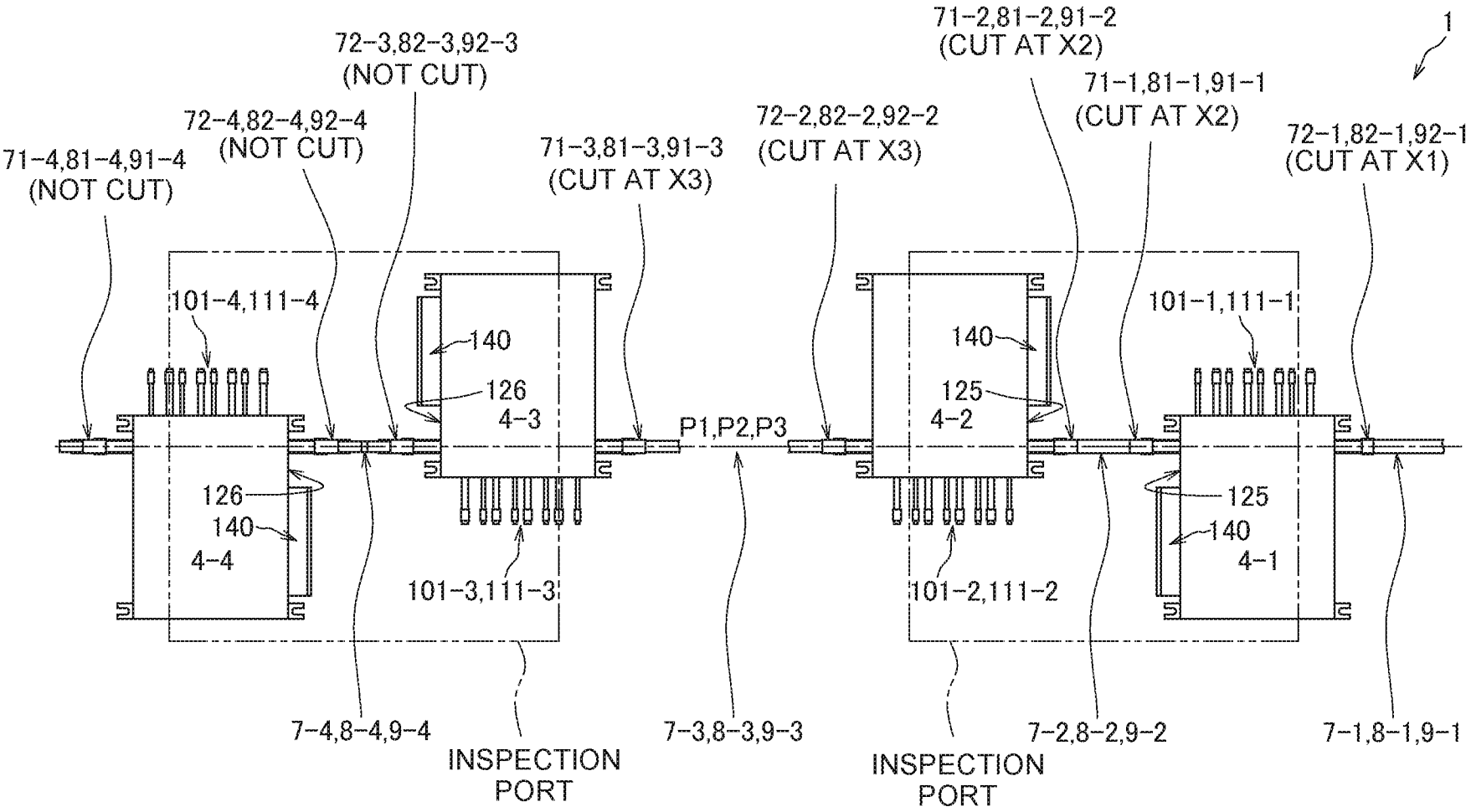
FIG. 22 is a top view of the configuration of the connections between refrigerant flow path switching units (in which the electric component boxes are attached to the left surface plates or the right surface plates).

FIG. 4 is a perspective view of an appearance of the refrigerant flow path switching unit 4 (in which an electric component box 140 is attached to a front surface plate 123). FIG. 5 is a perspective view of a circuit configuration of the refrigerant flow path switching unit 4. FIG. 6 is a top view of the appearance of the refrigerant flow path switching unit 4 (in which the electric component box 140 is attached to the front surface plate 123). FIG. 7 is a top view of a circuit configuration of the refrigerant flow path switching unit 4. FIG. 8 is a left side view of the appearance of the refrigerant flow path switching unit 4 (in which the electric component box 140 is attached to the front surface plate 123). FIG. 9 is a left side view of a circuit configuration of the refrigerant flow path switching unit 4. FIG. 10 is a right side view of the appearance of the refrigerant flow path switching unit 4 (in which the electric component box 140 is attached to the front surface plate 123). FIG. 11 is a rear view of the appearance of the refrigerant flow path switching unit 4. FIG. 12 is a front view of the appearance of the refrigerant flow path switching unit 4 (in which the electric component box 140 is attached to the front surface plate 123). FIG. 13 is a diagram showing details of heat source-side connection nozzles (heat source-side small nozzles 71 and 72, heat source-side medium nozzles 81 and 82, and heat source-side large nozzles 91 and 92). FIG. 14 is a front view of the appearance of the refrigerant flow path switching unit 4 (in which a box lid 142 of the electric component box 140 attached to the front surface plate 123 is removed). FIG. 15 is a perspective view of the appearance of the refrigerant flow path switching unit 4 (in which the electric component box 140 is attached to a left surface plate 125). FIG. 16 is a left side view of the appearance of the refrigerant flow path switching unit 4 (in which the box lid 142 of the electric component box 140 attached to the left surface plate 125 is removed). FIG. 17 is a perspective view of the appearance of the refrigerant flow path switching unit 4 (in which the electric component box 140 is attached to a right surface plate 126). FIG. 18 is a right side view of the appearance of the refrigerant flow path switching unit 4 (in which the box lid 142 of the electric component box 140 attached to the right surface plate 126 is removed). FIG. 19 is a perspective view of a configuration of connections between the refrigerant flow path switching units 4-1, 4-2, 4-3, and 4-4 (in which the electric component boxes 140 are attached to the front surface plates 123). FIG. 20 is a top view of the configuration of the connections between the refrigerant flow path switching units 4-1, 4-2, 4-3, and 4-4 (in which the electric component boxes 140 are attached to the front surface plates 123). FIG. 21 is a perspective view of the configuration of the connections between the refrigerant flow path switching units 4-1, 4-2, 4-3, and 4-4 (in which the electric component boxes 140 are attached to the left surface plates 125 or the right surface plates 126). FIG. 22 is a top view of the configuration of the connections between the refrigerant flow path switching units 4-1, 4-2, 4-3, and 4-4 (in which the electric component boxes 140 are attached to the left surface plates 125 or the right surface plates 126).

<Unit Configuration>

Next, a unit configuration of the refrigerant flow path switching units 4 will be described. The refrigerant flow path switching units 4-1 to 4-4 all have the same configuration, and thus, the description here will be also made by omitting subscripts "-1", "-2", "-3", and "-4" for distinguishing the refrigerant flow path switching units 4 as much as possible. Further, in the following description, the directions such as "upper", "lower", "left", "right", "front", and "rear" mean the directions shown in FIGS. 4 to 18. The refrigerant flow path switching unit 4 mainly includes a case 120 and the electric component box 140. The case 120 houses the above-described circuit configuration (the internal connection pipes, the flow path switching valves, and the like). The electric component box 140 houses electric components that control devices (the flow path switching valves, the supercooling expansion valves, and the like) in the case 120.

—Overview—

The case 120 is a box having a substantially rectangular parallelepiped shape, and mainly includes an upper surface plate 121 configuring an upper surface of the case 120, a lower surface plate 122 configuring a lower surface of the case 120, and side surface plates 123, 124, 125, and 126 configuring side surfaces of the case 120. Here, the front surface plate 123 configures a front surface of the side surfaces of the case 120. The rear surface plate 124 configures a rear surface facing the front surface (the front surface plate 123) of the side surfaces of the case 120. The left surface plate 125 configures a left surface of the side surfaces of the case 120 facing in a direction intersecting the front surface (the front surface plate 123) and the rear surface (the rear surface plate 124). The right surface plate 126 configures a right surface of the side surfaces of the case 120 facing the left surface (the left surface plate 125).

Here, the refrigerant flow path switching unit 4 is a suspension unit. The case 120 is provided with a plurality of (here, four) fixed jigs 127 to be fixed to installation locations via fixing jigs such as hanging bolts extending from above to below. Specifically, fixed jig attachment parts 128 and 129 are formed at an end near the front surface and an end near the rear surface of the left surface plate 125, and the fixed jig 127 is fixed to the fixed jig attachment parts 128 and 129 by screwing or the like. Further, fixed jig attachment parts 130 and 131 are formed at an end of the right surface plate 126 near the front surface and an end of the right surface plate 126 near the rear surface, and the fixed jig 127 is fixed to the fixed jig attachment parts 130 and 131 by screwing or the like. Here, the fixed jig attachment part 130 is disposed at a position being at the end near the front surface of the right surface plate 126 and facing the fixed jig attachment part 128 formed at the end near the front surface of the left surface plate 125. The fixed jig attachment part 131 is disposed at a position being at the end near the rear surface of the right surface plate 126 and facing the fixed jig attachment part 131 formed at the end near the rear surface of the left surface plate 125.

—Heat Source-Side Connection Nozzles and Utilization-Side Connection Nozzles—

The left surface plate 125 is provided with the first heat source-side small nozzle 71, the first heat source-side medium nozzle 81, and the first heat source-side large nozzle 91 as the first heat source-side connection nozzles connected to the heat source-side connection pipes 7, 8, and 9. Further, the right surface plate 126 is provided with the second heat source-side small nozzle 72, the second heat source-side medium nozzle 82, and the second heat source-side large nozzle 92 as the second heat source-side connection nozzles connected to the heat source-side connection pipes 7, 8, and 9. Thus, the refrigerant flow path switching unit 4 is provided with two sets of heat source-side connection nozzles (here, heat source-side small nozzles, heat source-side medium nozzles, and heat source-side large nozzles). Further, the rear surface plate 124 is provided with a plurality (here, four sets) of utilization-side small nozzles 101A to 101D and utilization-side large nozzles 111A to 111D as utilization-side connection nozzles connected to the utilization-side connection pipes 10 and 11. Here, heat insulating materials are attached around the heat source-side connection nozzles 71, 72, 81, 82, 91, and 92 and the utilization-side connection nozzles 101A to 101D and 111A to 111D, but are not shown in the drawings.

The first heat source-side small nozzle 71 is a tubular part protruding to the left from the left surface plate 125. The first heat source-side small nozzle 71 is disposed at the left surface plate 125 closer to the rear surface plate 123 (at least closer to the rear than a center in the front-rear direction). Specifically, the first heat source-side small nozzle 71 is disposed at a part of the left surface plate 125, close to the rear surface plate 123, in front of the fixed jig attachment part 129, and near a center in an up-down direction. The first heat source-side small nozzle 71 passes through the left surface plate 125 and is connected to the first end of the first internal connection pipe 41 in the case 120.

The second heat source-side small nozzle 72 is a tubular part protruding to the right from the right surface plate 126. The second heat source-side small nozzle 72 has the same diameter as the first heat source-side small nozzle 71. The second heat source-side small nozzle 72 is disposed at the right surface plate 126 closer to the rear surface plate 123 (at least closer to the rear than the center in the front-rear direction). Specifically, the second heat source-side small nozzle 72 is disposed at a part of the right surface plate 126, close to the rear surface plate 123, in front of the fixed jig attachment part 131, and near the center in the up-down direction. The second heat source-side small nozzle 72 is disposed at a position where the first heat source-side small nozzle 71 abuts on the right surface plate 126 when the first heat source-side small nozzle 71 virtually extends toward the right surface plate 126 along an axial direction of the left surface plate 125 (see a nozzle extension line P1). Here, the nozzle extension line P1 is a line passing through a pipe center (axis center) of the first heat source-side small nozzle 71 and the first heat source-side small nozzle 72. The second heat source-side small nozzle 72 passes through the right surface plate 126 and is connected to the second end of the first internal connection pipe 41 in the case 120.

The first heat source-side medium nozzle 81 is a tubular part protruding to the left from the left surface plate 125. The first heat source-side medium nozzle 81 has a larger diameter than the first heat source-side small nozzle 71. The first heat source-side medium nozzle 81 is disposed at the left surface plate 125 closer to the rear surface plate 123 (at least closer to the rear than the center in the front-rear direction). Specifically, the first heat source-side medium nozzle 81 is disposed at a part of the left surface plate 125, close to the rear surface plate 123, in front of the fixed jig attachment part 129, and above the first heat source-side small nozzle 71. The first heat source-side small nozzle 71 and the first heat source-side medium nozzle 81 are disposed in a row along the up-down direction of the left surface plate 125 (see an arrangement direction line P4). Here, the arrangement direction line P4 is a line connecting pipe centers of the first heat source-side small nozzle 71 and the first heat source-side medium nozzle 81 (in other words, a line orthogonal to the nozzle extension lines P1 and P2 on the left surface plate 125). The first heat source-side medium nozzle 81 passes through the left surface plate 125 and is connected to the first end of the second internal connection pipe 42 in the case 120.

The second heat source-side medium nozzle 82 is a tubular part protruding to the right from the right surface plate 126. The second heat source-side medium nozzle 82 has a larger diameter than the first heat source-side medium nozzle 72. Further, the second heat source-side medium nozzle 82 has the same diameter as the first heat source-side medium nozzle 81. The second heat source-side medium nozzle 82 is disposed at the right surface plate 126 closer to the rear surface plate 123 (at least closer to the rear than the center in the front-rear direction). Specifically, the second heat source-side medium nozzle 82 is disposed at a part of the right surface plate 126, close to the rear surface plate 123, in front of the fixed jig attachment part 131, and above the second heat source-side small nozzle 72. Further, the second heat source-side medium nozzle 82 is disposed at a position where the first heat source-side medium nozzle 81 abuts on the right surface plate 126 when the first heat source-side medium nozzle 81 virtually extends toward the right surface plate 126 along the axial direction of the left surface plate 125 (see the nozzle extension line P2). Here, the nozzle extension line P2 is a line passing through a pipe center (axis center) of the first heat source-side medium nozzle 81 and the second heat source-side medium nozzle 82. The second heat source-side small nozzle 72 and the second heat source-side medium nozzle 82 are disposed in a row along the up-down direction of the right surface plate 126 (see the arrangement direction line P4). Here, the arrangement direction line P4 is a line connecting the pipe centers of the second heat source-side small nozzle 72 and the second heat source-side medium nozzle 82 (in other words, a line orthogonal to the nozzle extension lines P1 and P2 on the right surface plate 126). The second heat source-side medium nozzle 82 passes through the right surface plate 126 and is connected to the second end of the second internal connection pipe 42 in the case 120.

The first heat source-side large nozzle 91 is a tubular part protruding to the left from the left surface plate 125. The first heat source-side large nozzle 91 has a larger diameter than the first heat source-side small nozzle 71 and the first heat source-side medium nozzle 81. The first heat source-side large nozzle 91 is disposed at the left surface plate 125 closer to the rear surface plate 123 (at least closer to the rear than the center in the front-rear direction). Specifically, the first heat source-side large nozzle 91 is disposed at a part of the left surface plate 125, close to the rear surface plate 123, in front of the fixed jig attachment part 129, and below the first heat source-side small nozzle 71. In other words, the first heat source-side small nozzle 71 is disposed between the first heat source-side medium nozzle 81 and the first heat source-side large nozzle 91. Further, the first heat source-side small nozzle 71, the first heat source-side medium nozzle 81, and the first heat source-side large nozzle 91 are disposed in a row along the up-down direction of the left surface plate 125 (see the arrangement direction line P4). Here, the arrangement direction line P4 is a line connecting the pipe centers of the first heat source-side small nozzle 71, the first heat source-side medium nozzle 81, and the first heat source-side large nozzle 91 (in other words, a line orthogonal to the nozzle extension lines P1, P2, and P3 on the left surface plate 125). The first heat source-side large nozzle 91 passes through the left surface plate 125 and is connected to the first end of the third internal connection pipe 43 in the case 120.

The second heat source-side large nozzle 92 is a tubular part protruding to the right from the right surface plate 126. The second heat source-side large nozzle 92 has a larger diameter than the second heat source-side small nozzle 72 and the second heat source-side medium nozzle 82. Further, the second heat source-side large nozzle 92 has the same diameter as the first heat source-side large nozzle 91. The second heat source-side large nozzle 92 is disposed at the right surface plate 126 closer to the rear surface plate 123 (at least closer to the rear than the center in the front-rear direction). Specifically, the second heat source-side large nozzle 92 is disposed at a part of the right surface plate 126, close to the rear surface plate 123, in front of the fixed jig attachment part 131, and below the second heat source-side small nozzle 72. In other words, the second heat source-side small nozzle 72 is disposed between the second heat source-side medium nozzle 82 and the second heat source-side large nozzle 92. Further, the second heat source-side large nozzle 92 is disposed at a position where the first heat source-side large nozzle 91 abuts on the right surface plate 126 when the first heat source-side large nozzle 91 virtually extends toward the right surface plate 126 along the axial direction of the left surface plate 125 (see the nozzle extension line P3). Here, the nozzle extension line P3 is a line passing through a pipe center (axis center) of the first heat source-side large nozzle 91 and the second heat source-side large nozzle 92. Further, the second heat source-side small nozzle 72, the second heat source-side medium nozzle 82, and the second heat source-side large nozzle 92 are disposed in a row along the up-down direction of the right surface plate 126 (see the arrangement direction line P4). The arrangement direction line P4 is a line connecting the pipe centers of the second heat source-side small nozzle 72, the second heat source-side medium nozzle 82, and the second heat source-side large nozzle 92 (in other words, a line orthogonal to the nozzle extension lines P1, P2, and P3 on the right surface plate 126). The second heat source-side large nozzle 92 passes through the right surface plate 126 and is connected to the second end of the third internal connection pipe 43 in the case 120.

A length L1 of the first heat source-side connection nozzles (the first heat source-side small nozzle 71, the first heat source-side medium nozzle 81, and the first heat source-side large nozzle 91) is 100 mm or more from the left surface plate 125. The first heat source-side small nozzle 71, the first heat source-side medium nozzle 81, and the first heat source-side large nozzle 91 have the same length. A length L2 of the second heat source-side connection nozzles (the second heat source-side small nozzle 72, the second heat source-side medium nozzle 82, and the second heat source-side large nozzle 92) is 100 mm or more from the right surface plate 126. The second heat source-side small nozzle 72, the second heat source-side medium nozzle 82, and the second heat source-side large nozzle 92 have the same length.

The first heat source-side connection nozzles (the first heat source-side small nozzle 71, the first heat source-side medium nozzle 81, and the first heat source-side large nozzle 91) and the second heat source-side connection nozzles (the second heat source-side small nozzle 72, the second heat source-side medium nozzle 82, and the second heat source-side large nozzle 92) are provided with different diameter parts having at least two different diameters. Here, one of the diameters of the different diameter parts may be the same as the diameter of the part other than the different diameter parts of each connection nozzle (a part between a root and the different diameter part of each connection nozzle). Here, each of the first heat source-side connection nozzles and the second heat source-side connection nozzles is provided with the different diameter part having a shape in which the diameter changes gradually toward a distal end.

Specifically, the first heat source-side small nozzle 71 and the second heat source-side small nozzle 72 are provided with a different diameter part 73 whose diameter changes to be small in four steps toward a distal end. The different diameter part 73 has, sequentially toward the distal end, a first part 74 having a largest diameter (diameter d11), a second part 75 having a smaller diameter (diameter d12) than the first part 74, a third part 76 having a smaller diameter (diameter d13) than the second part 75, and a fourth part 77 having a smaller diameter (diameter d14) than the third part 76. Then, the diameters of the first heat source-side small nozzle 71 and the second heat source-side small nozzle 72 can be changed to any of d11, d12, d13, or d14 by cutting the different diameter part 73 at any position of the first part 74 (a cutting line X1), the second part 75 (a cutting line X2), or the third part 76 (a cutting line X3) or by not cutting the different diameter part 73 at any position. The different diameter part 73 is not limited to a different diameter part whose diameter changes in four steps, and the diameter may change in two steps or three steps, or may change in five or more steps.

Further, the first heat source-side medium nozzle 81 and the second heat source-side medium nozzle 82 are provided with a different diameter part 83 whose diameter changes to be small in two steps toward a distal end. The different diameter part 83 has, sequentially toward the distal end, a first part 84 having a largest diameter (diameter d21) and a second part 85 having a smaller diameter (diameter d22) than the first part 84. Here, the first part 84 of the different diameter part 83 has the same length as a total length of the first part 74 and the second part 75 of the different diameter part 73. The second part 85 of the different diameter part 83 has the same length as a total length of the third part 76 and the fourth part 77 of the different diameter part 73. The diameter d21 of the first part 84 of the different diameter part 83 is larger than the diameters d11 and d12 of the first part 74 and the second part 75 of the different diameter part 73. The diameter d22 of the second part 85 of the different diameter part 83 is larger than the diameters d13 and d14 of the third part 76 and the fourth part 77 of the different diameter part 73. Then, the diameters of the first heat source-side medium nozzle 81 and the second heat source-side medium nozzle 82 can be changed to any of d21 or d22 by cutting the different diameter part 83 at any position of the first part 84 (the cutting line X1 or the cutting line X2) or the second part 85 (the cutting line X3) or by not cutting the different diameter part 83 at any position. The different diameter part 83 is not limited to a different diameter part whose diameter changes in two steps, and the diameter may change in three or more steps.

Further, the first heat source-side large nozzle 91 and the second heat source-side large nozzle 92 are provided with a different diameter part 93 whose diameter changes to be small in three steps toward a distal end. The different diameter part 93 has, sequentially toward the distal end, a first part 94 having a largest diameter (diameter d31), a second part 95 having a smaller diameter (diameter d32) than the second part 94, and a third part 96 having a smaller diameter (diameter d33) than the second part 95. Here, the first part 84 of the different diameter part 93 has the same length as the first part 74 of the different diameter part 73. The second part 95 of the different diameter part 93 has the same length as a total length of the first part 75 and the third part 76 of the different diameter part 73. The third part 96 of the different diameter part 93 has the same length as the fourth part 77 of the different diameter part 73. The diameter d31 of the first part 94 of the different diameter part 93 is larger than the diameter d11 of the first part 74 of the different diameter part 73 and the diameter d21 of the first part 84 of the different diameter part 83. The diameter d32 of the second part 95 of the different diameter part 93 is larger than the diameters d13 and d14 of the second part 75 and the third part 76 of the different diameter part 73, the diameter d21 of the first part 84, and the diameter d22 of the second part 85 of the different diameter part 83. The diameter d33 of the third part 96 of the different diameter part 93 is larger than the diameter d22 of the fourth part 77 of the different diameter part 73 and the diameter d22 of the second part 85 of the different diameter part 83. Then, the diameters of the first heat source-side large nozzle 91 and the second heat source-side large nozzle 92 can be changed to any of d31, d32, or d33 by cutting the different diameter part 93 at any position of the first part 94 (the cutting line X1) or the second part 95 (the cutting line X2 or X3) or by not cutting the different diameter part 93 at any position. The different diameter part 93 is not limited to a different diameter part whose diameter changes in three steps, and the diameter may change in two steps, or may change in four or more steps.

A distance between the first heat source-side connection nozzles and a distance between the second heat source-side connection nozzles are 40 mm or more. Specifically, between the first heat source-side small nozzle 71 and the first heat source-side medium nozzle 81 adjacent to each other and between the second heat source-side small nozzle 72 and the second heat source-side medium nozzle 82 adjacent to each other, a distance 51 between the first part 74 and the first part 84, which is a shortest distance between the nozzles, is 40 mm or more. Further, between the first heat source-side small nozzle 71 and the first heat source-side large nozzle 91 adjacent to each other and between the second heat source-side small nozzle 72 and the second heat source-side large nozzle 92 adjacent to each other, a distance S2 between the first part 74 and the first part 94, which is a shortest distance between the nozzles, is 40 mm or more.

The utilization-side small nozzles 101A to 101D are tubular parts protruding rearward from the rear surface plate 124. The utilization-side small nozzles 101A to 101D are disposed side by side in a left-right direction. Further, the utilization-side small nozzles 101A to 101D are disposed at the rear surface plate 124 closer to the upper surface plate 121 (at least above the center in the up-down direction). The utilization-side small nozzles 101A to 101D pass through the rear surface plate 124 and are connected to the second ends of the fourth internal connection pipes 44A to 44D in the case 120.

The utilization-side large nozzle 111 is a tubular part protruding rearward from the rear surface plate 124. The utilization-side large nozzle 111 has a larger diameter than the utilization-side small nozzle 101. The utilization-side large nozzles 111A to 111D are disposed side by side in the left-right direction. Further, the utilization-side large nozzles 111A to 111D are disposed below the utilization-side small nozzles 101A to 101D at the rear surface plate 124. The utilization-side large nozzles 111A to 111D pass through the rear surface plate 124 and are connected to the second ends of the fifth internal connection pipes 45A to 45D (the eighth internal connection pipes 50A to 50D) in the case 120.

—Internal Connection Pipes—

The first internal connection pipe 41 extends from an end near the first heat source-side small nozzle 71 to an end near the second heat source-side small nozzle 72 in the case 120 so as to be disposed in order along the left surface plate 125, the front surface plate 123, and the right surface plate 126. It can be said that the heat source-side small nozzles 71 and 72 are a part of the first internal connection pipe 41, but here, for convenience of explanation, a part inside the case 120 is referred to as the first internal connection pipe 41, and a part outside the case 120 is referred to as the heat source-side small nozzles 71 and 72.

The second internal connection pipe 42 extends straight from an end near the first heat source-side medium nozzle 81 to an end near the second heat source-side medium nozzle 82 through the nozzle extension line P2 in the case 120. It can be said that the heat source-side medium nozzles 81 and 82 are a part of the second internal connection pipe 42, but here, for convenience of explanation, a part inside the case 120 is referred to as the second internal connection pipe 42, and a part outside the case 120 is referred to as the heat source-side medium nozzles 81 and 82.

The third internal connection pipe 43 extends straight from an end near the first heat source-side large nozzle 91 to an end near the second heat source-side large nozzle 92 through the nozzle extension line P3 in the case 120. It can be said that the heat source-side large nozzles 91 and 92 are a part of the third internal connection pipe 43, but here, for convenience of explanation, a part inside the case 120 is referred to as the third internal connection pipe 43, and a part outside the case 120 is referred to as the heat source-side large nozzles 91 and 92.

The tenth internal connection pipe 56 extends straight in the left-right direction in the case 120 at a position slightly ahead of and below the third internal connection pipe 43.

The eleventh internal connection pipe 59 connects a middle of the third internal connection pipe 43 and a middle of the third internal connection pipe 43 in the case 120.

The fourth internal connection pipes 44A to 44D are branched from a part of the first internal connection pipe 41 along the front surface plate 123 in the case 120, and extend rearward. Further, the fourth internal connection pipes 44A to 44D are disposed side by side in the left-right direction. The fourth internal connection pipes 44A to 44D cross between the second internal connection pipe 42 and the third internal connection pipe 43 on the way to the rear, and extend toward the rear surface plate 124, in other words, to the utilization-side small nozzles 101A to 101D. The ninth internal connection pipes 55A to 55D are branched from a middle of the fourth internal connection pipes 44A to 44D, respectively. Further, the supercooling heat exchangers 54A to 54D are provided at positions behind a part of the fourth internal connection pipes 44A to 44D where the ninth internal connection pipes 55A to 55D are branched. Thus, the fourth internal connection pipes 44A to 44D each pass through the supercooling heat exchangers 54A to 54D in the front-rear direction and extend rearward. It can be said that the utilization-side small nozzles 101A to 101D are a part of the fourth internal connection pipes 44A to 44D, but here, for convenience of explanation, a part inside the case 120 is referred to as the fourth internal connection pipes 44A to 44D, and a part outside the case 120 is referred to as the utilization-side small nozzles 101A to 101D.

Further, the ninth internal connection pipes 55A to 55D also pass through the supercooling heat exchangers 54A to 54D in the front-rear direction and extend rearward, and are connected to the tenth internal connection pipe 56. The fourth filters 57A to 57D and the supercooling expansion valves 58A to 58D are provided in a middle of the ninth internal connection pipes 55A to 55D, respectively. The supercooling expansion valves 58A to 58D are disposed side by side in the left-right direction at a position ahead of the center in the front-rear direction in a space inside the case 120. In other words, the supercooling expansion valves 58A to 58D are disposed along the left surface and the right surface (two side surfaces facing each other) of the case 120. Further, the supercooling expansion valves 58A to 58D are disposed in such a manner that coil parts are located in an upper space in the case 120.

The sixth internal connection pipes 48A to 48D configuring the fifth internal connection pipes 45A to 45D are branched from a middle of the second internal connection pipe 42 in the case 120, extend rearward, and are connected to the eighth internal connection pipes 50A to 50D configuring the fifth internal connection pipes 45A to 45D, respectively. The first filters 51A to 51D and the first flow path switching valves 46A to 46D are provided in a middle of the sixth internal connection pipes 48A to 48D, respectively. The first flow path switching valves 46A to 46D are disposed side by side in the left-right direction ahead of the center in the front-rear direction and behind the supercooling expansion valves 58A to 58D in the space inside the case 120. In other words, the first flow path switching valves 46A to 46D are disposed along the left surface and the right surface (two side surfaces facing each other) of the case 120. Further, the first flow path switching valves 46A to 46D are disposed in such a manner that coil parts are located in the upper space in the case 120.

The seventh internal connection pipes 49A to 49D configuring the fifth internal connection pipes 45A to 45D are branched from a middle of the third internal connection pipe 43 in the case 120, extend rearward, and are connected to the eighth internal connection pipes 50A to 50D configuring the fifth internal connection pipes 45A to 45D, respectively. The second filters 52A to 52D and the second flow path switching valves 47A to 47D are provided in a middle of the seventh internal connection pipes 49A to 49D, respectively. The second flow path switching valves 47A to 47D are disposed side by side in the left-right direction ahead of the center in the front-rear direction and ahead of the supercooling expansion valves 58A to 58D in the space inside the case 120. In other words, the second flow path switching valves 47A to 47D are disposed along the left surface and the right surface (two side surfaces facing each other) of the case 120. Further, the second flow path switching valves 47A to 47D are disposed in such a manner that coil parts are located in the upper space in the case 120.

The eighth internal connection pipes 50A to 50D configuring the fifth internal connection pipes 45A to 45D extend rearward from a merging position with the sixth internal connection pipes 48A to 48D and the seventh internal connection pipes 49A to 49D. Further, the eighth internal connection pipes 50A to 50D are disposed side by side in the left-right direction. The eighth internal connection pipes 50A to 50D cross between the second internal connection pipe 42 and the third internal connection pipe 43 on the way to the rear, and extend toward the rear surface plate 124, in other words, to the utilization-side large nozzles 111A to 111D. The third filters 53A to 53D are provided at a middle of the eighth internal connection pipes 50A to 50D, respectively. It can be said that the utilization-side large nozzles 111A to 111D are a part of the eighth internal connection pipes 50A to 50D, but here, for convenience of explanation, a part inside the case 120 is referred to as the eighth internal connection pipes 50A to 50D, and a part outside the case 120 is referred to as the utilization-side large nozzles 111A to 111D.

—Case Opening, Electric Component Box, and Attachment Part for Electric Component Box—

Case openings 132, 133, and 134 are formed on the front surface (front surface plate 123), the left surface (left surface plate 125), and the right surface (right surface plate 126), respectively, of the side surfaces of the case 120. Thus, here, the case openings 132, 133, and 134 are formed on the two side surfaces facing each other (left surface and right surface) and the side surface (front surface) facing in a direction intersecting both the left surface and the right surface, of the side surfaces of the case 120. Here, the left surface plate 125 and the right surface plate 126 are provided with the heat source-side connection nozzles (the heat source-side small nozzles 71 and 72, the heat source-side medium nozzles 81 and 82, and the heat source-side large nozzles 91 and 92). Thus, of the side surfaces of the case 120, the case openings (here, the case openings 133 and 134) are provided on the side surfaces (here, the left surface and the right surface) on which the heat source-side connection nozzles are provided. Further, the rear surface plate 124 provided with the utilization-side connection nozzles (the utilization-side small nozzles 101A to 101D and the utilization-side large nozzles 111A to 111D) is not provided with a case opening. Therefore, the utilization-side connection nozzles are provided on the side surface other than the side surface where the case openings (here, the case openings 132, 133, and 134) and the heat source-side connection nozzles are provided (here, the rear surface).

The case opening 133 is disposed at an upper part of the left surface plate 125. Here, the upper part is a part at least above the center in the up-down direction. Here, the case opening 133 is disposed at substantially the same height as the coil parts of the flow path switching valves 46A to 46D and 47A to 47B and the supercooling expansion valves 58A to 58D disposed in the case 120 (upper space in the case 120). Further, the case opening 133 is a horizontally long substantially rectangular opening large enough for a human hand to be inserted into. Further, the case opening 133 is disposed on a side of (here, in front of) the first heat source-side connection nozzles (the first heat source-side small nozzle 71, the first heat source-side medium nozzle 81, and the first heat source-side large nozzle 91) on the left surface plate 125. In other words, the first heat source-side connection nozzles are disposed closer to the side surface on which the utilization-side connection nozzles (the utilization-side small nozzles 101A to 101D and the utilization-side large nozzles 111A to 111D) are provided (the rear surface) than the case opening 133. Specifically, the case opening 133 is disposed slightly ahead of the center in the left-right direction, which is substantially the same position in the front-rear direction as the coil parts of the flow path switching valves 46A to 46D and 47A to 47B and the supercooling expansion valves 58A to 58D. Further, the case 120 has a case lid 135 that covers the case opening 133. Here, a screw hole 136 is formed around the case opening 133 (here, near a corner of the case opening 133) in the left surface plate 125, and the case lid 135 can be fixed by screwing. A fixing structure of the case lid 135 is not limited to screwing, and may be another fixing structure such as hook fixing, fitting fixing, and the like.

The case opening 134 is disposed at an upper part of the right surface plate 126. Here, the upper part is a part at least above the center in the up-down direction. Here, the case opening 134 is disposed at substantially the same height as the coil parts of the flow path switching valves 46A to 46D and 47A to 47B and the supercooling expansion valves 58A to 58D disposed in the case 120 (upper space in the case 120). Further, the case opening 134 is a horizontally long substantially rectangular opening large enough for a human hand to be inserted into. Here, the case opening 134 is as large as the case opening 133. Further, the case opening 134 is disposed on a side of (here, in front of) the second heat source-side connection nozzles (the second heat source-side small nozzle 72, the second heat source-side medium nozzle 82, and the second heat source-side large nozzle 92) on the right surface plate 126. In other words, the second heat source-side connection nozzles are disposed closer to the side surface on which the utilization-side connection nozzles (the utilization-side small nozzles 101A to 101D and the utilization-side large nozzles 111A to 111D) are provided (the rear surface) than the case opening 134. Specifically, the case opening 134 is disposed slightly ahead of the center in the left-right direction, which is substantially the same position in the front-rear direction as the coil parts of the flow path switching valves 46A to 46D and 47A to 47B and the supercooling expansion valves 58A to 58D. Here, the case opening 134 is disposed at a position facing the case opening 133. Further, the case 120 has a case lid 136 that covers the case opening 134. Here, a screw hole 137 is formed around the case opening 134 (here, near a corner of the case opening 134) in the right surface plate 126, and the case lid 136 can be fixed by screwing. A fixing structure of the case lid 136 is not limited to screwing, and may be another fixing structure such as hook fixing, fitting fixing, and the like.

The case opening 132 is disposed at an upper part of the front surface plate 123. Here, the upper part is a part at least above the center in the up-down direction. Here, the case opening 132 is disposed at substantially the same height as the coil parts of the flow path switching valves 46A to 46D and 47A to 47B and the supercooling expansion valves 58A to 58D disposed in the case 120 (upper space in the case 120). Further, the case opening 132 is a horizontally long substantially rectangular opening large enough for a human hand to be inserted into. Here, the case opening 134 is as large as the case openings 133 and 134. Further, the case opening 132 is disposed near the center in the left-right direction in the front surface plate 123. Further, the front surface plate 123 is provided with a box attachment part 138 to which the electric component box 140 is attached. The box attachment part 138 is a substantially rectangular part of the front surface plate 123 near the center in the left-right direction including the case opening 132. The box attachment part 138 is provided with a screw hole 139 for screwing the electric component box 140.

The electric component box 140 is a substantially rectangular parallelepiped box smaller than the case 120, and mainly includes a box-shaped box body 141 having one open surface and the rectangular box lid 142 covering the open surface of the box body 141. The box body 141 mainly has a substantially rectangular attachment surface part 143 and substantially rectangular peripheral surface parts 144 to 147 extending in a direction intersecting from four sides of the attachment surface part 143. The box lid 142 faces the attachment surface part 143, is substantially as large as the attachment surface part 143, and is fixed to the peripheral surface parts 144 to 147 by screwing or the like. A fixing structure of the box lid 142 is not limited to screwing, and may be another fixing structure such as hook fixing, fitting fixing, and the like. A control board 148 and a terminal block 149 are provided on the attachment surface part 143 as electric components controlling the flow path switching valves 46A to 46D and 47A to 47D and the supercooling expansion valves 58A to 58D. Further, the attachment surface part 143 is provided with a screw hole 150 through which a screw for attaching the electric component box 140 to the box attachment part 138 passes. Further, the attachment surface part 143 is provided with a box opening 151. The box opening 151 is formed in a part of the attachment surface part 143 facing the case opening 132 (upper part of the attachment surface part 143) in a state where the electric component box 140 is attached to the box attachment part 138. Further, the box opening 151 is a substantially rectangular opening large enough for a human hand to be inserted into. Here, the box opening 151 is as large as the case opening 132. The electric components such as the control board 148 and the terminal block 149 are disposed so as to avoid the box opening 151. Here, in a state where the electric component box 140 is attached to the box attachment part 138, the electric components such as the control board 148 and the terminal block 149 are disposed below the box opening 151. In other words, the electric components are housed in the electric component box 140 in a state where the inside of the case 120 is accessible from the box opening 151 through the case opening 132 (i.e., the box opening 151 overlaps the case opening 132). An electric wire 152 (internal wire) is connected between the control board 148 and the flow path switching valves 46A to 46D and 47A to 47D, and the supercooling expansion valves 58A to 58D. The internal wire 152 is drawn into the case 120 through the box opening 151 and the case opening 132 in a state where the electric component box 140 is attached to the box attachment part 138. Further, a communication line 153 and a power source line 154 (external wires) connected to devices (power source and other units 2 and 3, and the like) outside the case 120 are connected to the control board 148 and the terminal block 149. The electric component box 140 is provided with external wire openings 155 and 156 through which the external wires 153 and 154 are drawn outside. Here, the external wire opening 155 is formed in the peripheral surface part 146, and the external wire opening 156 is formed in the peripheral surface part 147. The surfaces in which the external wire openings are formed are not limited to the two surfaces of the peripheral surface parts 146 and 147, and the external wire openings may be formed in two or more surfaces including the peripheral surface part 145 and the like.

Further, here, the left surface plate 125 and the right surface plate 126 are also provided with box attachment parts 157 and 158 similar to the box attachment part 138 on the front surface plate 132.

The box attachment part 157 is a substantially rectangular part of the left surface plate 125 near a position slightly ahead of the center in the left-right direction including the case opening 133. Further, the box attachment part 157 is disposed on a side of (here, in front of) the first heat source-side connection nozzles (the first heat source-side small nozzle 71, the first heat source-side medium nozzle 81, and the first heat source-side large nozzle 91) on the left surface plate 125. In other words, the first heat source-side connection nozzles are disposed closer to the side surface (rear surface) on which the utilization-side connection nozzles (the utilization-side small nozzles 101A to 101D and the utilization-side large nozzles 111A to 111D) are provided than the box attachment part 157. The box attachment part 157 is provided with a screw hole 159 for screwing the electric component box 140, similarly to the box attachment part 138.

The box attachment part 158 is a substantially rectangular part of the right surface plate 126 near a position slightly ahead of the center in the left-right direction including the case opening 134. Further, the box attachment part 158 is disposed on a side of (here, in front of) the second heat source-side connection nozzles (the second heat source-side small nozzle 72, the second heat source-side medium nozzle 82, and the second heat source-side large nozzle 92) on the right surface plate 126. In other words, the second heat source-side connection nozzles are disposed closer to the side surface on which the utilization-side connection nozzles (the utilization-side small nozzles 101A to 101D and the utilization-side large nozzles 111A to 111D) are provided (the rear surface) than the case opening 134. The box attachment part 158 is provided with a screw hole 160 for screwing the electric component box 140, similarly to the box attachment part 138.

Further, here, similarly to the left surface plate 125 and the right surface plate 126, a screw hole 161 is formed around the case opening 132 (here, near a corner of the case opening 132) in the front surface plate 123. When the electric component box 140 is attached to the left surface plate 125 or the right surface plate 126, the case lid 135 or the case lid 136 can be fixed to the case opening 132 by screwing.

<Configuration of Connections Between Units>

Next, a configuration of connections between the refrigerant flow path switching units 4 (here, the refrigerant flow path switching units 4-1, 4-2, 4-3, and 4-4) will be described.

Here, as shown in FIG. 1, a plurality of living rooms is disposed on both sides of the passage, and thus the refrigerant flow path switching units 4-1, 4-2, 4-3, and 4-4 are disposed along a longitudinal direction of the ceiling space of the passage. Here, the refrigerant flow path switching units 4-1 and 4-4 are disposed such that distal ends of utilization-side connection nozzles 101-1, 111-1, 101-4, and 111-4 are directed toward one side of the passage (upward in FIG. 1). The refrigerant flow path switching units 4-2 and 4-3 are disposed such that distal ends of utilization-side connection nozzles 101-2, 111-2, 101-3, and 111-3 are directed toward one side of the passage (downward in FIG. 1). In other words, the refrigerant flow path switching units 4-2 and 4-3 are disposed by being rotated 180 degrees with respect to the refrigerant flow path switching units 4-1 and 4-4. Further, here, the refrigerant flow path switching unit 4-1 and the refrigerant flow path switching unit 4-2 are disposed as close as possible to each other, and the refrigerant flow path switching unit 4-3 and the refrigerant flow path switching unit 4-4 are disposed as close as possible to each other.

The refrigerant flow path switching unit 4-1 and the refrigerant flow path switching unit 4-2 are disposed such that the respective nozzle extension lines P1, P2, and P3 are each aligned straight. In other words, pipe centers of the first heat source-side connection nozzles 71-1, 81-1, and 91-1 of the refrigerant flow path switching unit 4-1 and pipe centers of the first heat source-side connection nozzles 71-2, 81-2, and 91-2 of the refrigerant flow path switching unit 4-2 face each other. Further, the refrigerant flow path switching unit 4-2 and the refrigerant flow path switching unit 4-3 are disposed such that the respective nozzle extension lines P1, P2, and P3 are each aligned straight. In other words, pipe centers of the second heat source-side connection nozzles 72-2, 82-2, and 92-2 of the refrigerant flow path switching unit 4-2 and pipe centers of the first heat source-side connection nozzles 71-3, 81-3, and 91-3 of the refrigerant flow path switching unit 4-3 face each other. Further, the refrigerant flow path switching unit 4-3 and the refrigerant flow path switching unit 4-4 are disposed such that the respective nozzle extension lines P1, P2, and P3 are each aligned straight. In other words, pipe centers of the second heat source-side connection nozzle 72-3, 82-3, and 92-3 of the refrigerant flow path switching unit 4-3 and pipe centers of the second heat source-side connection nozzles 72-4, 82-4, and 92-4 of the refrigerant flow path switching unit 4-4 face each other. In this way, all the heat source-side connection nozzles of the refrigerant flow path switching units 4-1, 4-2, 4-3, and 4-4 are disposed such that the respective nozzle extension lines P1, P2, and P3 are aligned straight.

The heat source unit 2 and the second heat source-side connection nozzles 72-1, 82-1, and 92-1 of the refrigerant flow path switching unit 4-1 are connected to the heat source-side connection pipes 7-1, 8-1, and 9-1 extending from the heat source unit 2, respectively. Here, the second heat source-side connection nozzles 72-1, 82-1, and 92-1 are connected in a state where the different diameter parts 73, 83, and 93 are cut at the position of the cutting line X1 (in other words, changed to the first part 74, the first part 84, and the first part 94). Further, the first heat source-side connection nozzles 71-1, 81-1, and 91-1 of the refrigerant flow path switching unit 4-1 and the first heat source-side connection nozzles 71-2, 81-2, and 91-2 of the refrigerant flow path switching unit 4-2 are connected to each other by the heat source-side connection pipes 7-2, 8-2, and 9-2, respectively, which are straight pipes. Here, the first heat source-side connection nozzles 71-1, 81-1, and 91-1 and the first heat source-side connection nozzles 71-2, 81-2, and 91-2 are connected in a state where the different diameter parts 73, 83, and 93 are cut at the position of the cutting line X2 (changed to the second part 75, the first part 84, and the second part 95). Thus, the first heat source-side connection nozzles 71-1, 81-1, and 91-1 and the first heat source-side connection nozzles 71-2, 81-2, and 91-2 are connected to each other by pipes without using a different diameter joint. Further, the second heat source-side connection nozzles 72-2, 82-2, and 92-2 of the refrigerant flow path switching unit 4-2 and the first heat source-side connection nozzles 71-3, 81-3, and 91-3 of the refrigerant flow path switching unit 4-3 are connected to each other by the heat source-side connection pipes 7-3, 8-3, and 9-3, respectively, which are straight pipes. Here, the second heat source-side connection nozzles 72-2, 82-2, and 92-2 and the first heat source-side connection nozzles 71-3, 81-3, and 91-3 are connected in a state where the different diameter parts 73, 83, and 93 are cut at the position of the cutting line X3 (changed to the third part 76, the second part 85, and the second part 95). Thus, the second heat source-side connection nozzles 72-2, 82-2, and 92-2 and the first heat source-side connection nozzles 71-3, 81-3, and 91-3 are connected to each other by pipes without using a different diameter joint. Further, the second heat source-side connection nozzles 72-3, 82-3, and 92-3 of the refrigerant flow path switching unit 4-3 and the second heat source-side connection nozzles 72-4, 82-4, and 92-4 of the refrigerant flow path switching unit 4-4 are connected to each other by the heat source-side connection pipes 7-4, 8-4, and 9-4, respectively, which are straight pipes. Here, the second heat source-side connection nozzles 72-3, 82-3, and 92-3 and the second heat source-side connection nozzles 72-4, 82-4, and 92-4 are connected in a state where the different diameter parts 73, 83, and 93 are not cut (as the fourth part 77, the second part 85, and the third part 96, respectively). Thus, the second heat source-side connection nozzles 72-3, 82-3, and 92-3 and the second heat source-side connection nozzles 72-4, 82-4, and 92-4 are connected to each other by pipes without using a different diameter joint. Further, the heat source-side connection pipes are not connected to the first heat source-side connection nozzles 71-4, 81-4, and 91-4 of the refrigerant flow path switching unit 4-4, and distal ends of the first heat source-side connection nozzles 71-4, 81-4, and 91-4 are sealed by crushing or the like.

Here, in the refrigerant flow path switching unit 4, the electric component box 140 can be attached to either the front surface (the front surface plate 123), the left surface (the left surface plate 125), or the right surface (the right surface plate 126) of the case 120.

For example, as shown in FIGS. 19 and 20, in all the refrigerant flow path switching units 4, the electric component box 140 can be attached to the box attachment part 138 on the front surface (the front surface plate 123) of the case 120.

Further, as shown in FIGS. 21 and 22, in the refrigerant flow path switching unit 4-1, the electric component box 140 can be attached to the box attachment part 157 on the left surface (the left surface plate 125) of the case 120. Further, also in the refrigerant flow path switching unit 4-2, the electric component box 140 can be attached to the box attachment part 157 on the left surface (the left surface plate 125) of the case 120. In this case, the electric component box 140 of the refrigerant flow path switching unit 4-1 is attached to the box attachment part 157 (here, the left surface of the case 120) closer to the refrigerant flow path switching unit 4-2 among the box attachment parts 138, 157, and 158 of the refrigerant flow path switching unit 4-1. Further, in the refrigerant flow path switching unit 4-3, the electric component box 140 can be attached to the box attachment part 158 on the right surface (the right surface plate 126) of the case 120. Further, also in the refrigerant flow path switching unit 4-4, the electric component box 140 can be attached to the box attachment part 158 on the right surface (the right surface plate 126) of the case 120. In this case, the electric component box 140 of the refrigerant flow path switching unit 4-3 is also attached to the box attachment part 158 (here, the right surface of the case 120) closer to the refrigerant flow path switching unit 4-4 among the box attachment parts 138, 157, and 158 of the refrigerant flow path switching unit 4-3.

(3) Characteristics

Next, characteristics of the refrigerant flow path switching unit 4 and the air conditioner 1 provided with the refrigerant flow path switching unit 4 will be described.

<A>

Here, as described above, in the refrigerant flow path switching unit 4, the case openings 132, 133, and 134 (maintenance openings) are formed on three surfaces (here, the front surface, left surface, and right surface) of the side surfaces (the front surface, rear surface, left surface, and right surface) of the case 120 (see FIGS. 4, 8, 10, 12, and 14 to 18).

Here, it is therefore possible to insert the hand into the case 120 while visually recognizing the inside of the case 120 or insert both hands into the case 120 by using the case openings 132, 133, and 134 formed on the three side surfaces (the front surface plate 123, left surface plate 125, and right surface plate 126) of the case 120. Thus, maintenance of the flow path switching valves 46A to 46D and 47A to 47D and the supercooling expansion valves 58A to 58D can be performed without opening the upper surface (upper surface plate 121) of the case 120.

In particular, here, as described above, of the side surfaces provided with the case openings (maintenance openings), two side surfaces (here, the left surface and right surface) face each other, and one side surface (here, the front surface) faces in a direction intersecting both of the two side surfaces facing each other (see FIGS. 4, 15, and 17).

Thus, here, maintenance of the flow path switching valves 46A to 46D and 47A to 47D and the supercooling expansion valves 58A to 58D can be performed by inserting both hands into the case 120 from the two side surfaces facing each other (here, the left surface and right surface) while visually recognizing the inside of the case 120 from the side surface (here, the front surface) facing in the direction intersecting both of the two side surfaces facing each other. Such a method of accessing the inside of the case 120 is effective, for example, when the electric component box 140 is attached to the front surface of the case 120 (see FIG. 4), and an inspection port is provided for access from the front surface of the case 120 (see FIG. 20). Specifically, an operator opens the case opening 132 on the front surface of the case 120 by removing the box lid 142 of the electric component box 140 (see FIG. 14), and opens the case openings 133 and 134 on the left and right surfaces of the case 120 by removing the case lids 135 and 136 on the left and right surfaces of the case 120. Then, in this state, the operator can perform maintenance of the flow path switching valves 46A to 46D and 47A to 47D and the supercooling expansion valves 58A to 58D by inserting both hands into the case 120 from the case openings 133 and 134 while visually recognizing the inside of the case 120 from the case opening 132.

Also, the operator can perform maintenance of the flow path switching valves 46A to 46D and 47A to 47D and the supercooling expansion valves 58A to 58D by inserting one hand into the case 120 from the side surface (here, the front surface) facing the direction intersecting the two side surfaces facing each other while visually recognizing the inside of the case 120 from one of the two side surfaces facing each other (the left surface and right surface). Such a method of accessing the inside of the case 120 is effective, for example, when the electric component box 140 is attached to the left surface or the right surface of the case 120 (see FIG. 15 or 17), and an inspection port is provided for access from the left surface or the right surface of the case 120 (see FIG. 22). Specifically, the operator opens the case opening 133 on the left surface of the case 120 or the case opening 134 on the right surface by removing the box lid 142 of the electric component box 140 (see FIG. 16 or 18), and opens the case opening 132 on the front surface of the case 120 by removing the case lid 135 or 136 on the front surface of the case 120. Then, in this state, the operator can perform maintenance of the flow path switching valves 46A to 46D and 47A to 47D and the supercooling expansion valves 58A to 58D by inserting one hand into the case 120 from the case opening 132 while visually recognizing the inside of the case 120 from the case opening 133 or 134.

As described above, here, even when the refrigerant flow path switching unit is installed in a space having a small height dimension, maintenance of the flow path switching valve can be performed without opening the upper surface of the case, and the workability can be improved.

When the electric component box 140 is attached to the side surface (here, the front surface) facing the direction intersecting both of the two side surfaces facing each other (here, the left surface and right surface) (see FIG. 4), the electric component box 140 is obstructive during the maintenance, and under this condition, the operator cannot visually recognize the inside of the case 120 or insert the hand into the case 120 through the case opening 132. When the electric component box 140 is attached to the left surface or the right surface (see FIGS. 15 and 17), the electric component box 140 is obstructive during the maintenance, and under this condition, the operator cannot visually recognize the inside of the case 120 or insert the hand into the case 120 through the case openings 133 and 134. However, here, as described above, the box opening 151 is formed in a part of the electric component box 140 facing the case openings 132, 133, and 134 (see FIGS. 14, 16, and 18), and thus the operator can visually recognize the inside of the case 120 and insert the hand into the case 120 although the electric component box 140 is attached.

At this time, when the box opening 151 is formed in the part of the electric component box 140 facing the case openings 132, 133, and 134, if the electric components 148 and 149 cover most of the box opening 151, the electric component parts 148 and 149 prevent the operator from visually recognizing the inside of the case 120 or inserting the hand into the case 120.

However, here, as described above, the electric components 148 and 149 are housed in the electric component box 140 in a state where the operator can access the inside of the case 120 from the box opening 151 through the case openings 132, 133, and 134 (see FIGS. 14, 16, and 18). Thus, here, the electric components 148 and 149 are unlikely to prevent the operator from visually recognizing the inside of the case 120 or inserting the hand into the case 120.

Here, the electric components 148 and 149 are disposed below the box opening 151 so as not to cover the box opening 151 entirely, but the present disclosure is not limited to this. The electric components 148 and 149 may partially cover the box opening 151 as long as a state can be maintained such that the operator can insert one hand into the case 120 through the box opening 151 and the case openings 132, 133, and 134.

<B>

Further, here, as described above, a plurality of (here, four in the left-right direction for each side surface) the flow path switching valves 46A to 46D and 47A to 47D and the supercooling expansion valves 58A to 58D are disposed along the two side surfaces facing each other on which the case openings 133 and 134 (maintenance openings) are formed (here, the left surface and the right surface) (see FIGS. 4, 8, 10, 12, and 14 to 18).

Here, the operator easily accesses the flow path switching valves 46A to 46A to 46D and 47A to 47D and the supercooling expansion valves 58A to 58D when inserting both hands into the case 120 from the two side surfaces facing each other (left surface and right surface). In addition, the operator easily visually recognizes the flow path switching valves 46A to 46A to 46D and 47A to 47D and the supercooling expansion valves 58A to 58D when visually recognizing the inside of the case 120 from the side surface (front surface) facing the direction intersecting both of the two side surfaces facing each other.

<C>

Further, when the heat source-side connection nozzles (the first heat source-side connection nozzles 71, 81, and 91 and the second heat source-side connection nozzles 72, 82, and 92) are formed on the side surfaces (here, the left surface and the right surface) on which the case openings 133 and 134 (maintenance openings) are formed, the heat source-side connection nozzles and the heat source-side connection pipes 7, 8, and 9 connected to the heat source-side connection nozzles may be obstructive and prevent the operator from visually recognizing the inside of the case 120 or inserting the hand into the case 120.

However, here, as described above, when the heat source-side connection nozzles are provided on the side surfaces (left surface and right surface) on which the case openings 133 and 134 are formed, the heat source-side connection nozzles are disposed on the side of the case openings 133 and 134 (see FIGS. 4, 8, 10 and 15 to 18).

As a result, here, the heat source-side connection nozzles and the heat source-side connection pipes connected to the heat source-side connection nozzles are less likely to be obstructive, thereby reducing possibility of preventing the operator from visually recognizing the inside of the case or inserting the hand into the case.

Further, when the heat source-side connection nozzles are provided on the side surfaces (the left surface and the right surface) on which the case openings 133 and 134 are formed, if the heat source-side connection nozzles are disposed farther from the side surface on which the utilization-side connection nozzles 101 and 111 are formed (here, the rear surface) than the case openings 133 and 134, the utilization-side connection nozzles 101 and 111 and the utilization-side connection pipes 10 and 11 connected to the utilization-side connection nozzles 101 and 111 may be obstructive and prevent the operator from visually recognizing the inside of the case 120 or inserting the hand into the case 120.

However, here, as described above, when the heat source-side connection nozzles are provided on the side surfaces (left surface and right surface) on which the case openings 133 and 134 are formed, the heat source-side connection nozzles are disposed closer to the side surface (rear surface) on which the utilization-side connection nozzles 101 and 111 are formed than the left surface and the right surface (see FIGS. 4, 8, 10 and 15 to 18).

As a result, here, the utilization-side connection nozzles and the utilization-side connection pipes connected to the utilization-side connection nozzles are less likely to be obstructive, thereby reducing possibility of preventing the operator from visually recognizing the inside of the case or inserting the hand into the case.

<D>

Further, here, the case openings 132, 133, and 134 (maintenance openings) are disposed at an upper part of the side surface of the case 120 (see FIGS. 4, 8, 10, and 15 to 18). Here, the flow path switching valves 46A to 46D and 47A to 47D and the supercooling expansion valves 58A to 58D are disposed in such a manner that the coil parts are located in the upper space in the case 120. This facilitates access to the flow path switching valves 46A to 46D and 47A to 47D and the supercooling expansion valves 58A to 58D (particularly, the coil parts).

(4) Modifications

<A>

In the refrigerant flow path switching unit 4 according to the above embodiments, the case openings 132, 133, and 134 (maintenance openings) are formed on the three side surfaces (the front surface, the left surface, and the right surface) of the case 120. However, the present disclosure is not limited to these, and the case openings may be formed on at least two side surfaces.

For example, the case openings 133 and 134 may be formed only on two side surfaces facing each other (the left surface and the right surface of the case 120) of the side surfaces of the case 120. In this case, the operator can also insert both hands into the case 120 from the two side surfaces facing each other, thereby improving the workability of maintenance of the flow path switching valves 46A to 46D and 47A to 47D and the supercooling expansion valve 58A to 58D. Further, the case openings 132 and 133 or the case openings 132 and 134 may be formed only on two of the side surfaces of the case 120 facing in the direction intersecting each other (the front surface and the left surface of the case 120 or the front surface and the right surface of the case 120). In this case, the operator can also insert both hands into the case 120 from two side surfaces facing in the direction intersecting each other or insert the hand in the case 120 while visually recognizing the inside of the case 120, thereby improving the workability of maintenance of the flow path switching valves 46A to 46D and 47A to 47D and the supercooling expansion valves 58A to 58D.

<B>

In the above embodiments and Modification A, the air conditioner 1 has one heat source unit 2. However, the present disclosure is not limited to this, and the air conditioner 1 may have a plurality of the heat source units 2. Further, the air conditioner 1 has 16 utilization units 3. However, the number is not limited to this, and the number of utilization units 3 may be larger or smaller than 16.

<C>

In the above embodiments and Modifications A and B, the refrigerant flow path switching unit 4 is connectable to four utilization units 3. However, the present disclosure is not limited to this, and the refrigerant flow path switching unit 4 may be connectable to two or three utilization units 3, or may be connectable to five or more utilization units 3.

<D>

In the above embodiments and Modifications A to C, the refrigerant flow path switching unit 4 has the supercooling heat exchanger 54, the ninth internal connection pipe 55 including the supercooling expansion valve 58 and the fourth filters 57A to 57D, the tenth internal connection pipe 56, and the eleventh internal connection pipe 59. However, the present disclosure is not limited to this, and the refrigerant flow path switching unit 4 does not have to have these components when the refrigerant flow path switching unit 4 does not have to have a function of cooling the refrigerant.

<E>

In the above embodiments and Modifications A to D, the refrigerant flow path switching units 4 are connected to each other via the heat source-side connection pipes 5 (7, 8, and 9). However, when a distance between the refrigerant flow path switching units 4 is significantly small, the heat source-side connection nozzles may be directly connected.

<F>

In the above embodiments and Modifications A to E, the first heat source-side connection nozzles 71, 81, and 91 and the second heat source-side connection nozzles 72, 82, and 92 are arranged in a row along the side surfaces facing each other of the case 120 along the up-down direction. However, the arrangement is not limited to this, and the first heat source-side connection nozzles 71, 81, and 91 and the second heat source-side connection nozzles 72, 82, and 92 do not have to be arranged in a row or may be formed on different surfaces of the case 120.

<G>

In the above embodiments and Modifications A to F, the first heat source-side connection nozzles 71, 81, and 91 and the second heat source side connection nozzles 72, 82, and 92 are provided with the different diameter parts 73, 83, and 93. However, the present disclosure in not limited to this, and the different diameter parts 73, 83, and 93 do not have to be provided.

<H>

In the above embodiments and Modifications A to G, in order to make a series connection between the refrigerant flow path switching units 4, a configuration is adopted in which the case 120 is provided with two sets of heat source-side connection nozzles of the first heat source-side connection nozzles 71, 81, and 91 and the second heat source-side connection nozzle 72, 82, and 92. However, the configuration is not limited to this, and a configuration having only one set of heat source-side connection nozzles may be adopted.

<I>

In the above embodiments and Modifications A to H, the case lids 135 and 136 are not fixed to the surfaces to which the electric component box 140 is attached (the front surface plate 123, left surface plate 125, or right surface plate 126). Then, as described above, when the electric component box 140 is attached to the left surface plate 125 or the right surface plate 126 instead of the front surface plate 123, the case lid 135 or the case lid 136 can be fixed to the case opening 132 by screwing. As shown in FIGS. 8 and 10, the case lids 135 and 136 are members that completely cover the case openings, and the case lids 135 and 136 are not provided with an opening.

Figure 23:
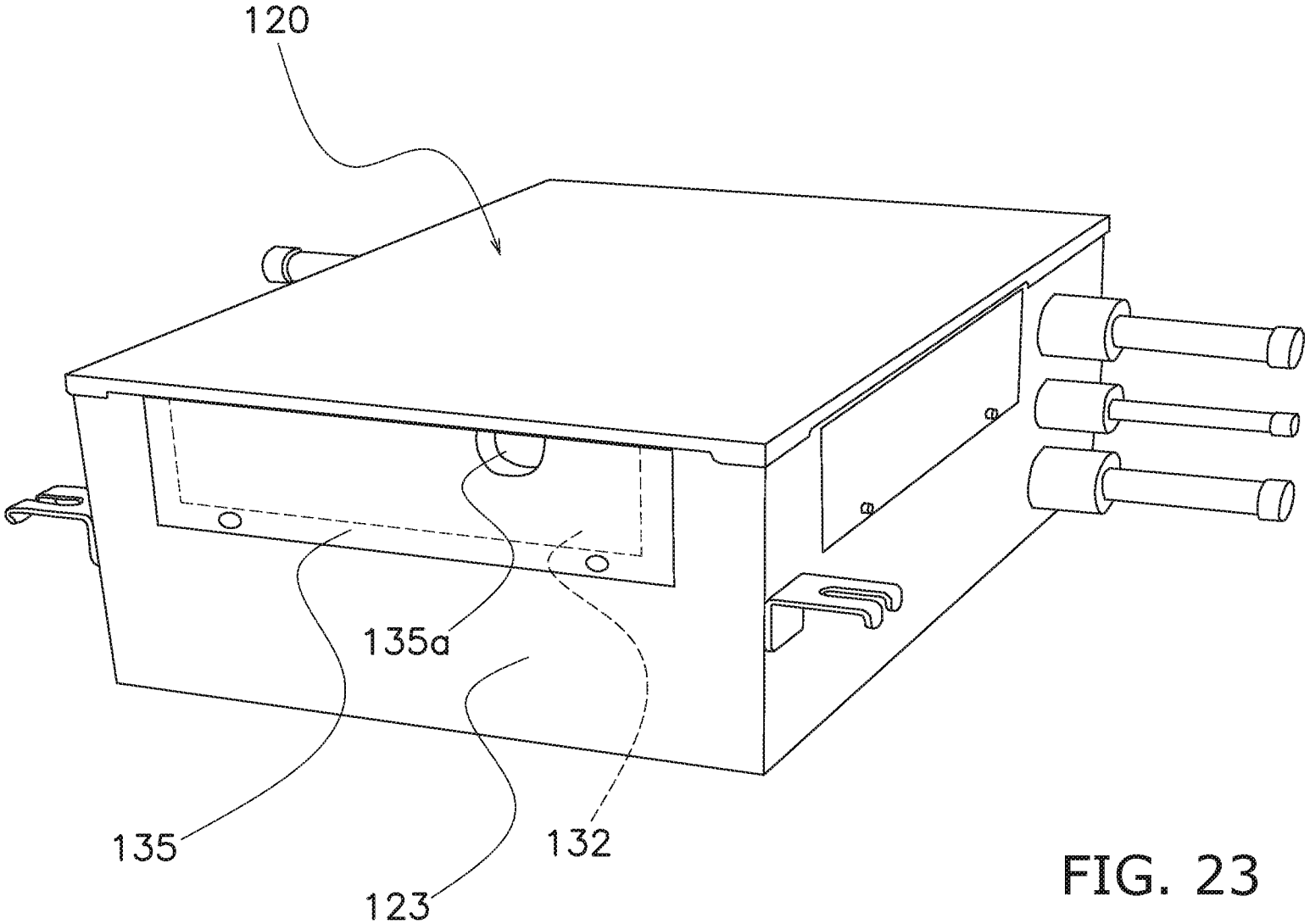
FIG. 23 is a perspective view of a case lid having a small opening and a case in which the case lid is fixed in the refrigerant flow path switching unit of Modification <I> (before the electric component box is attached to the front surface plate).
Figure 24:
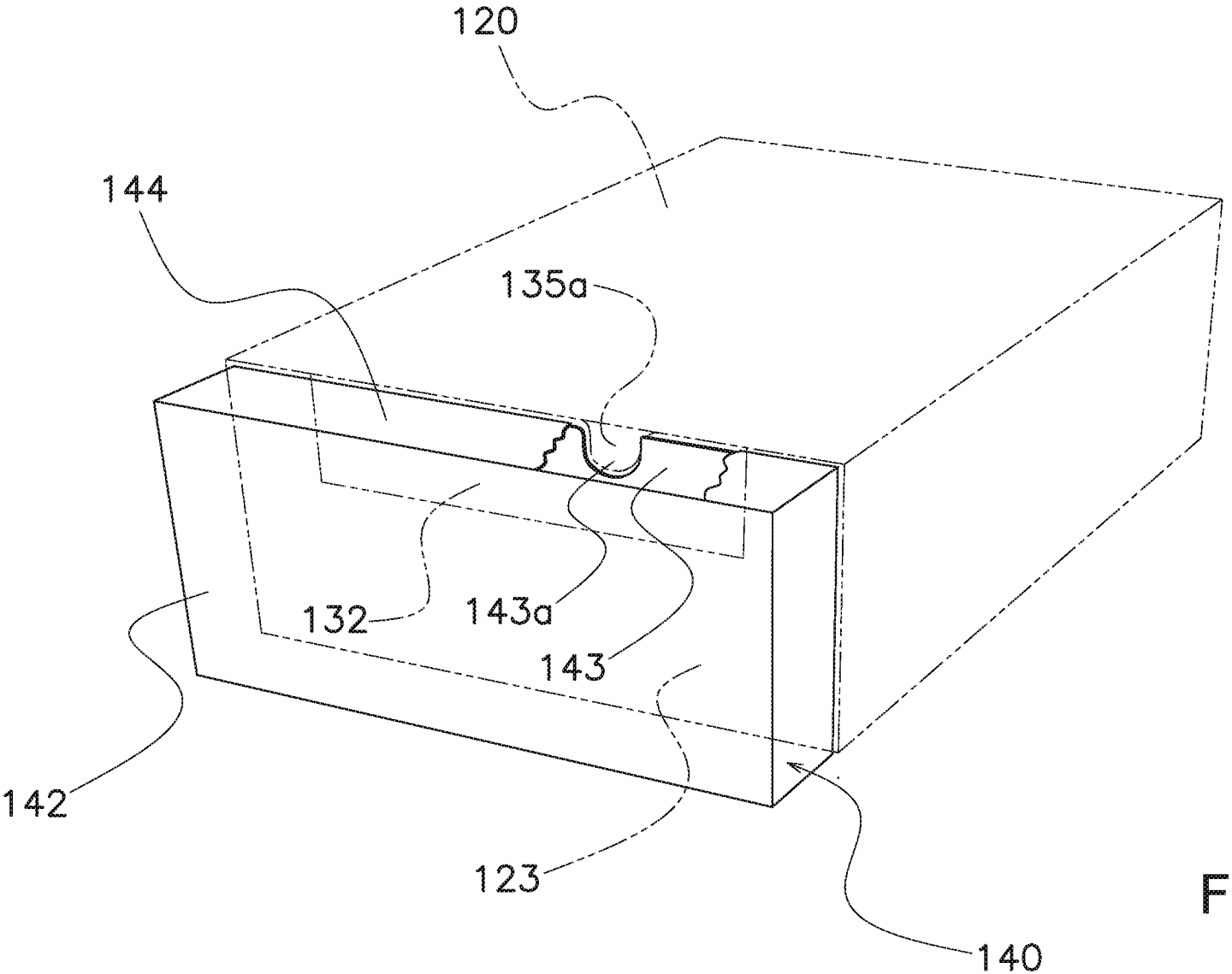
FIG. 24 is a perspective view of the electric component box having the small opening in an attachment surface part of the refrigerant flow path switching unit of Modification <I>, the electric component box being attached to the case with the case lid fixed.

Instead of this opening, in Modification I, as shown in FIGS. 23 and 24, a narrow opening (hereinafter referred to as a small opening) 135*a* is formed in the case lid 135. The small opening 135*a* is not a hole for human hands to enter, but a hole for passing a wire. Here, the small opening 135 is formed by cutting out a part of an upper part of the case lid 135. As a result, even when the case lid 135 is fixed to the front surface plate 123 so as to cover the case opening 132, the case 120 is provided with an inside-outside through hole including the case opening 132 and the small opening 135*a*. Meanwhile, in Modification I, as shown in FIG. 24, a small opening 143*a* is also provided in the attachment surface part 143 on a rear surface of the electric component box 140. FIG. 24 shows a state in which a part of the peripheral surface part 144 of the electric component box 140 is cut out to clearly show the small opening 143*a*. The small opening 143*a* of the attachment surface part 143 is disposed at the same position as the small opening 135*a* of the opposing case lid 135. Further, a shape and size of the small opening 143*a* of the attachment surface part 143 are substantially the same as those of the small opening 135*a* of the case lid 135. Thus, when the electric component box 140 is attached to the front surface plate 123 of the case 120 in which the case lid 135 covers the case opening 132, the inside-outside through hole of the case 120 including the case opening 132 and the small opening 135*a* communicates with the small opening 143*a* of the electric component box 140. Thus, by removing the box lid 142 of the electric component box 140, the electrical wire 152 (internal wire; see FIG. 14) can be drawn from the electric component box 140 into the case 120 through the small opening 143*a* and the small opening 135*a* even when the case lid 135 is fixed to the front surface plate 123 of the case 120.

In a structure of Modification I, although the small opening 143*a* and the small opening 135*a* exist, most of the case opening 132 is covered with the case lid 135 (see FIG. 23), and there is little possibility that water may enter the electrical equipment box 140 from between the electric component box 140 and the case 120.

In the refrigerant flow path switching unit 4 of Modification I, the case opening 132 is also a maintenance opening. The operator can insert the hand into the case 120 or visually recognize the inside of the case 120 by removing the case lid 135 and using the case opening 132. In this case, the case lid 135 is removed after measures are taken such as removing the box lid 142 of the electric component box 140 or removing the electric component box 140.

The present disclosure is widely applicable to a refrigerant flow path switching unit provided between a heat source unit and a utilization unit and configured to switch a refrigerant flow in the utilization unit, and an air conditioner provided with the refrigerant flow path switching unit.

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

REFERENCE SIGNS LIST

1: Air conditioner
2: Heat source unit
3: Utilization unit
4: Refrigerant flow path switching unit
46A to 46D: First flow path switching valve
47A to 47D: Second flow path switching valve
71: First heat source-side small nozzle (heat source-side connection nozzle)
72: Second heat source-side small nozzle (heat source-side connection nozzle)
81: First heat source-side medium nozzle (heat source-side connection nozzle)
82: Second heat source-side medium nozzle (heat source-side connection nozzle)
91: First heat source-side large nozzle (heat source-side connection nozzle)
92: Second heat source-side large nozzle (heat source-side connection nozzle)
101A to 101D: Utilization-side small nozzle (utilization-side connection nozzle)
111A to 111D: Utilization-side large nozzle (utilization-side connection nozzle)
120: Case
123: Front surface plate (side surface)
124: Rear surface plate (side surface)
125: Left surface plate (side surface)
126: Right surface plate (side surface)
132, 133, 134: Case opening (maintenance opening)
140: Electric component box
148: Control board (electric component)
149: Terminal block (electric component)
151: Box opening

PATENT LITERATURE

Patent Literature 1: JP 2015-227741 A

The invention claimed is:

1. A refrigerant flow path switching unit disposed between a heat source unit and a utilization unit and that switches a refrigerant flow in the utilization unit, the refrigerant flow path switching unit comprising:
a flow path switching valve; and
a case that houses the flow path switching valve, wherein
the case has:
a first maintenance opening on a first lateral side surface; and
a second maintenance opening on a second lateral side surface,
the case has a third maintenance opening on a third side surface,
the second lateral side surface faces the third side surface, and
the first lateral side surface faces a first direction and the second lateral side surface faces a second direction that intersects the first direction.

2. The refrigerant flow path switching unit according to claim 1, further comprising:
an electric component box disposed on the first lateral side surface, wherein
the electric component box houses an electric component that controls the flow path switching valve, and
the electric component box has a box opening facing the first maintenance opening.

3. The refrigerant flow path switching unit according to claim 2, wherein the box opening overlaps the first maintenance opening.

4. The refrigerant flow path switching unit according to claim 1, wherein the first and second maintenance openings are disposed at upper parts of the first and second lateral side surfaces, respectively.

5. An air conditioner comprising:
the refrigerant flow path switching unit according to claim 1;
the heat source unit; and
the utilization unit.

6. A refrigerant flow path switching unit disposed between a heat source unit and a utilization unit and that switches a refrigerant flow in the utilization unit, the refrigerant flow path switching unit comprising:
a flow path switching valve; and
a case that houses the flow path switching valve, wherein
the case has:
a first maintenance opening on a first lateral side surface; and
a second maintenance opening on a second lateral side surface, the refrigerant flow path switching unit further comprising:
a heat source-side connection nozzle disposed on the first lateral side surface, wherein
the heat source-side connection nozzle is disposed on a side of the first maintenance opening.

7. The refrigerant flow path switching unit according to claim 6, further comprising:
a utilization-side communication nozzle disposed on a third side surface, wherein
the heat source-side connection nozzle is disposed closer to the third side surface than the first maintenance opening is.

8. The refrigerant flow path switching unit according to claim 6, wherein the first and second maintenance openings are disposed at upper parts of the first and second lateral side surfaces, respectively.

9. An air conditioner comprising:
the refrigerant flow path switching unit according to claim 6;
the heat source unit; and
the utilization unit.

* * * * *